US005104782A

United States Patent [19]

Seto et al.

[11] Patent Number: 5,104,782

[45] Date of Patent: Apr. 14, 1992

[54] SILVER HALIDE COLOR PHOTOGRAPHIC MATERIAL CONTAINING A PYRAZOLOAZOLE BASED COUPLER AND HAVING EXCELLENT COLOR REPRODUCTION CHARACTERISTICS AND WHICH PROVIDES IMAGES HAVING EXCELLENT LIGHT FASTNESS

[75] Inventors: Nobuo Seto; Masakazu Morigaki, both of Kanagawa, Japan

[73] Assignee: Fuji Photo Film Co., Ltd., Minami Ashigara, Japan

[21] Appl. No.: 652,136

[22] Filed: Feb. 7, 1991

[30] Foreign Application Priority Data

Feb. 8, 1990 [JP] Japan ..... 2-28944

[51] Int. Cl.[5] ..... G03C 1/34; G03C 7/38

[52] U.S. Cl. ..... 430/551; 430/558

[58] Field of Search ..... 430/558, 551, 607, 610, 430/613

[56] References Cited

U.S. PATENT DOCUMENTS

| | | | |
|---|---|---|---|
| 3,936,305 | 2/1976 | Hiraishi et al. | 430/512 |
| 4,748,100 | 5/1988 | Umemoto et al. | 430/505 |
| 4,782,011 | 11/1988 | Goddard et al. | 430/551 |
| 4,906,559 | 3/1990 | Nishijima et al. | 430/551 |

FOREIGN PATENT DOCUMENTS

| | | | |
|---|---|---|---|
| 0298321 | 1/1989 | European Pat. Off. | 430/551 |
| 2135788 | 9/1984 | United Kingdom | 430/551 |

*Primary Examiner*—Charles L. Bowers, Jr.
*Assistant Examiner*—Lee C. Wright
*Attorney, Agent, or Firm*—Burns, Doane, Swecker & Mathis

[57] ABSTRACT

A silver halide color photographic material wherein at least one pyrazoloazole dye forming coupler, at least one compound represented by formula (A) and at least one compound represented by formula (B) are included in the same layer:

(A)

(B)

wherein the substituents are as defined in the specification.

18 Claims, No Drawings

SILVER HALIDE COLOR PHOTOGRAPHIC MATERIAL CONTAINING A PYRAZOLOAZOLE BASED COUPLER AND HAVING EXCELLENT COLOR REPRODUCTION CHARACTERISTICS AND WHICH PROVIDES IMAGES HAVING EXCELLENT LIGHT FASTNESS

FIELD OF THE INVENTION

This invention relates to a silver halide color photographic material and, more particularly, it relates to a silver halide color photographic material in which color fading and changes in color due to exposure to light of a dye image which has been formed from a pyrazoloazole based coupler are prevented.

BACKGROUND OF THE INVENTION

It is well known that colored images can be formed by reacting an oxidized product of a primary aromatic color developing agent which is the oxidizing agent for exposed silver halide with a coupler to form indophenol, indoaniline, indamine, azomethine, phenoxazine, phenazine dyes and dyes related to these materials.

In this case, 5-pyrazolone, cyanoacetophenone, indazolone, pyrazolobenzimidazole and pyrazolotriazole based couplers have been used for forming magenta images.

In the past, the 5-pyrazolone based couplers have been used most widely and have been the subject of most research as magenta image forming couplers. However, the dyes formed with 5-pyrazolone based couplers have a secondary absorbance at about 430 nm and they are known to be a cause of color turbidity.

The pyrazolobenzimidazole skeleton disclosed in British Patent 1,047,612, the indazolone skeleton disclosed in U.S. Pat. No. 3,770,447 and the pyrazolo[5,1-c]-1,2,4- triazole skeleton disclosed in U.S. Pat. No. 3,725,067 have been proposed as magenta image forming skeletons with which there is little absorbance in the yellow region.

Furthermore, magenta couplers based on, for example, pyrazoloazoles such as the imidazo[1,2-b]pyrazoles, the pyrazolo[1,5-b][1,2,4]triazoles, the pyrazolo[1,5-b]-tetrazoles, the pyrazolo[1,5-b]benzimidazoles and the pyrazolopyrazoles have also been developed as magenta couplers which have little unwanted yellow absorbance and which have good color forming properties.

Furthermore, more recently couplers which produce cyan colors have also been developed with the same parent nuclei.

However, the fastness with respect to light of the azomethine dyes formed from such pyrazoloazole based couplers is comparatively low and it has not been possible to prevent satisfactorily the occurrence of color fading using the color image stabilizers (for example, alkyl substituted hydroquinones) which have generally been used in the past.

Attempts have been made to resolve this problem by adding various compounds. For example, there are methods in which alkoxybenzene derivatives are added as disclosed, for example, in JP-A-59-125732 (U.S. Pat. No. 4,588,679), JP-A-60-262159 (U.S. Pat. No. 4,735,893, and U.S. Pat. No. 4,931,382), JP-A-61-282245, JP-A-62-244045, JP-A-62-44046 (U.S. Pat. No. 4,895,793), JP-A-62-273531 (U.S. Pat. No. 4,868,101), JP-A-61-158330 (U.S. Pat. No. 4,623,617), JP-A-63-95439 (U.S. Pat. No. 4,814,262), JP-A-63-95448, JP-A-63-95450 and JP-A-63-84548. (The term "JP-A" as used herein signifies an "unexamined published Japanese patent application"). The compounds disclosed in these specifications certainly have an excellent improving effect on light fastness in regions where the concentration of the dye which has been formed by color formation with the coupler is high (referred to hereinafter as high density regions).

However, the dyes formed from pyrazoloazole based couplers have especially low light fastness in regions where the concentration of the dye which has been formed by color formation with the coupler is low (referred to hereinafter as low density regions) and, with reflective type photosensitive materials in particular, this gives a strong cast and an undesirable balance with the fading of the other colors, and the improving effect on light fastness of the aforementioned alkoxybenzene derivatives is only slight in the low density regions and a better technique is required.

On the other hand, methods by which the yellow staining which is produced by 5-pyrazolone magenta couplers can be controlled and the light fastness of the colored image can be improved by using bis-phenol based compounds alone or by using bisphenol compounds and specified alkoxybenzene derivatives conjointly have been disclosed, for example, in JP-B-60-3173, JP-B-60-3174 (U.S. Pat. No. 4,174,220), JP-A-52-72225 (GB 1,529,908), JP-A-54-70830, JP-A-61-158333 and JP-A-62-24250. (The term "JP-B" as used herein signifies an "examined Japanese patent publication"). Although the compounds disclosed in the aforementioned patents are seen to inhibit yellow staining with 5-pyrazolone based magenta couplers and to strengthen the light fastness of the colored image, the effect achieved cannot be said to be satisfactory. Furthermore, application to pyrazoloazole based magenta couplers is proposed in European Patent 218,266, but here the improving effect in respect of color fading is poor.

Furthermore, methods involving the conjoint use of magenta couplers and ultraviolet absorbers and controlling the yellow staining which arises from the magenta coupler, and of improvement in respect of color fading by the conjoint use of alkoxybenzene based compounds have been disclosed, for example, in JP-A-50-87326, JP-A-55-50245, JP-A-54-73032 and JP-A-61-250644. In particular, the control of the yellow staining produced from the magenta coupler by the conjoint use of a pyrazoloazole based magenta coupler and an ultraviolet absorber, and the conjoint use of an alkoxybenzene based compound for improving the fading properties of the dye image have been proposed in JP-A-61-250644, but there is virtually no improving effect in respect of the fading of the dye image in the low density regions beyond the additive properties due to the conjoint use of these compounds.

In this sense, there is a demand for a technique which prevents color fading in light and which, in particular, prevents color fading in light in the low density regions.

SUMMARY OF THE INVENTION

A first object of the present invention is, therefore, to provide a silver halide color photographic material in which a pyrazoloazole based coupler which has excellent color forming properties is used, which has excellent color reproduction characteristics and which provides images which have excellent light fastness.

A second object of the invention is to provide a silver halide color photographic material with which the light fastness of the colored image is improved in the low density region and with which there is a good balance of fading of the three colors.

A third object of the invention is to provide a silver halide color photographic material which exhibits similarly excellent light fastness even when processed in different types of processing baths.

As a result of thorough investigation by the inventors, the above mentioned objects have been realized by means of the present invention.

Thus, the present invention provides a silver halide color photographic material wherein at least one pyrazoloazole dye forming coupler, at least one compound which is represented by the general formula (A) indicated below and a compound represented by general formula (B) indicated below are included in the same layer.

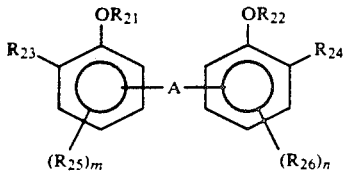

(A)

In formula (A), A represents a single bond,

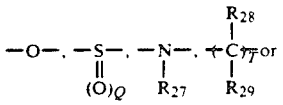

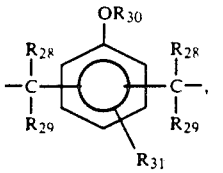

and $R_{21}$ and $R_{22}$ each represent a hydrogen atom,

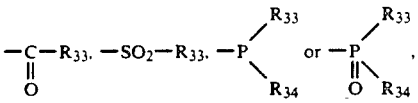

represent a halogen atom, an aryl group, an alkoxy group, an aryloxy group, an alkylthio group, an arylthio group, an acyl group, an alkoxycarbonyl group, an aryloxycarbonyl group, an acylamino group, an alkylsulfonamido group, an arylsulfonamido group, an imido group, an acyloxy group, an alklysulfonyl group, an arylsulfonyl group, an alkylsulfonyloxy group, an arylsulfonyloxy group, an alkoxycarbonylamino group, an aryloxycarbonylamino group, a carbamoylamino group, a sulfamoylamino group, a carbamoyl group, a sulfamoyl group or

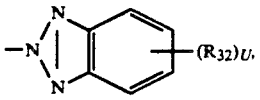

and m and n represent integers of value from 1 to 3. $R_{25}$ and $R_{26}$ each represent a substituent group as designated for $R_{23}$ or an alkyl group, and when m or n are two or more the plural $R_{25}$ groups and the plural $R_{26}$ groups may be the same or different. $R_{21}$ and $R_{22}$, $R_{21}$ and $R_{23}$, $R_{22}$ and $R_{24}$, $R_{23}$ and $R_{25}$, and $R_{25}$ and $R_{26}$ may be joined together to form a five to eight membered ring. $R_{27}$ represents a hydrogen atom, an alkyl group, an acyl group, an alkylsulfonyl group, an arylsulfonyl group, an alkoxycarbonyl group or an aryloxycarbonyl group, and $R_{28}$ and $R_{29}$ each represent a hydrogen atom, an alkyl group, an aryl group or an aralkyl group, $R_{30}$ is defined the same as $R_{21}$, and $R_{31}$ and $R_{32}$ are each defined the same as $R_{25}$. $R_{33}$ and $R_{34}$ represent an alkyl group, an aryl group, an aralkyl group, an alkoxy group or an aryloxy group. Q and U each represent 0, 1 or 2, and T represents 1 or 2. Total carbon number of the compounds (A) is preferably 18 to 120, more preferably 18 to 70.

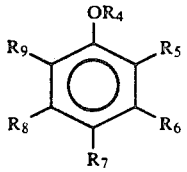

(B)

In formula (B), $R_4$ represents an alkyl group, an alkenyl group, an aryl group, a heterocyclic group or a silyl group. $R_5$, $R_6$, $R_7$, $R_8$ and $R_9$ may be the same or different, each representing a hydrogen atom, an alkyl group, an alkenyl group, an aryl group, a substituted amino group, an alkylthio group, an arylthio group, a halogen atom,

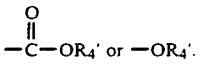

Here, $R_4'$ has the same significance as $R_4$. $R_4$ and $R_5$, $R_5$ and $R_6$, or $R_6$ and $R_7$ may be joined together to form a five or six membered ring or a spiro ring. Total carbon number of the compounds (B) is preferably 8 to 80, more preferably 13 to 50.

DETAILED DESCRIPTION OF THE INVENTION

The pyrazoloazole dye forming couplers employed in the present invention can be represented by the general formula (M) indicated below.

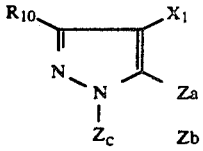

(M)

In formula (M), $R_{10}$ represents a hydrogen atom or a substituent group, and $X_1$ represents a hydrogen atom or a group which can be eliminated by a coupling reaction with an oxidized product of a primary aromatic amine color developing agent. Za, Zb and Zc each represents independently a substituted or unsubstituted methine, =N— or —NH—, and one of the bonds Za-Zb and Zb-Zc is a double bond and the other is a single bond. Those cases where the Zb-Zc bond is a carbon-carbon double bond include the cases in which the Zb-Zc is part of an aromatic ring. Dimers or larger oligomers may be formed via $R_{10}$ or $X_1$, or via the substituted methine group when Za, Zb or Zc is a substituted methine group. Total carbon number of the compounds (M) is preferably 10 to 120, more preferably 14 to 80.

The general formula (M) is described in detail below.

Among the compounds represented by the general formula (M), an oligomer signifies a compound which has two or more groups which can be represented by the general formula (M) in one molecule, and this includes dimeric and polymeric couplers. The polymeric coupler may be a homopolymer which is comprised only of monomers which have a part which can be represented by general formula (M) (and which preferably have a vinyl group, referred to hereinafter as vinyl monomers), or it may be a copolymer with an non-color forming ethylenic monomer which does not undergo a coupling reaction with an oxidized product of a primary aromatic amine color developing agent. Polymeric coupler latexes are especially desirable for the said polymeric couplers.

Among the pyrazoloazole dye forming couplers which can be represented by the general formula (M), those which can be represented by the general formulae (M-I), (M-II), (M -III), (M-IV), (M-V), (M-VI) and (M-VII) indicated below are especially desirable.

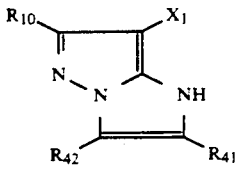
(M-I)

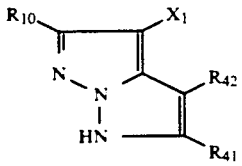
(M-II)

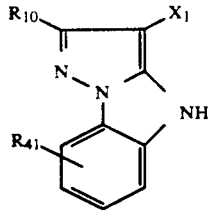
(M-III)

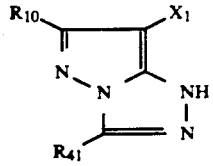
(M-IV)

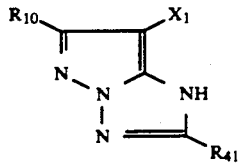
(M-V)

-continued

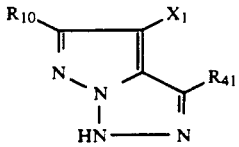
(M-VI)

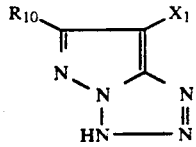
(M-VII)

Among the couplers represented by general formulae (M-I) to (M-VII), those represented by general formulae (M-I), M-IV) and M-V) are preferred in view of the objects of the present invention, and those represented by general formulae (M-IV) and (M-V) are especially desirable.

In general formulae (M) and (M-I) to (M-VII), $R_{10}$, $R_{41}$ and $R_{42}$ may be the same or different, each representing a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group, and $X_1$ represents a hydrogen atom, a halogen atom, a carboxyl group or a group which is eliminated on coupling, being bonded to the carbon atom in the coupling position via an oxygen atom, a nitrogen atom or a sulfur atom. Bis forms may be formed when $R_{10}$, $R_{41}$ and $R_{42}$ or $X_1$ is a divalent group. Examples of such divalent groups include substituted and unsubstituted alkylene groups (for example, methylene, ethylene, 1,10-decylene), $—CH_2CH_2OCH_2CH_2—$, substituted and unsubstituted phenylene groups (for example, 1,4-phenylene, 1,3-phenylene, 2,5-dimethyl-1,4-phenylene), and —NH-CO—$R^A$—CONH—(where RA represents a substituted or unsubstituted alkylene group or a substituted or unsubstituted phenylene group).

Furthermore, the form of the polymeric couplers may be such that coupler residual groups represented by general formula (M) and (M-I) to (M-VII) are present in the main chain or in the side chains of the polymer, and they are preferably polymers derived from vinyl monomers (in which the vinyl group may be substituted with a chlorine atom or a methyl group, for example) which have a part which can be represented by the aforementioned general formulae, and in this case $R_{10}$, $R_{41}$, $R_{42}$ or $X_1$ represents a linking group which has a vinyl group. Examples of groups which are linked to the vinyl group include substituted and unsubstituted alkylene groups (for example, methylene, ethylene, 1,10-decylene), $—CH_2CH_2OCH_2CH_2—$, substituted and unsubstituted phenylene groups (for example, 1,4-phenylene, 1,3-phenylene, 2,5-dimethyl-1,4-phenylene), —NHCO—, —O—, —NHCO—$R^A$—CONH— (where $R^A$ represents a substituted or unsubstituted alkylene group or a substituted or unsubstituted phenylene group), —COHN—, —OCO—, and aralkylene groups (for example,

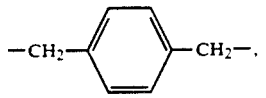

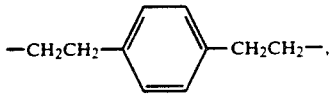

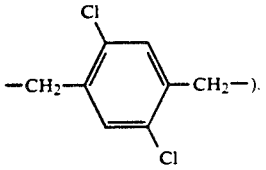

More precisely, the groups designated by $R_{10}$, $R_{41}$ and $R_{42}$ in general formulae (M) and (M-I) to (M-VII) may be a hydrogen atom, a halogen atom (for example, chlorine, bromine), an alkyl group (for example, methyl, propyl, isopropyl, tert-butyl, trifluoromethyl, tridecyl, 2-[α-{3-(2-octyloxy-5-tert-octylbenzenesulfonamido)pr 3-(2,4-di-tert-amylphenoxy)-propyl, allyl, 2-dodecyloxyethyl, 1-(2-octyloxy-5-tert-octylbenzenesulfonamido)-2-propyl, 1-{4-(2-butoxy-5-tert-octylbenzenesulfonamidophenl}propyl, 3-phenoxypropyl, 2-hexylsulfonyl-ethyl, cyclopentyl, benzyl), an aryl group (for example, phenyl, 4-tert-butylphenyl, 2,4-di-tert-amylphenyl, 4-tetradecanamidophenyl, 2,4,6-trichlorophenyl), a heterocyclic group (for example, 2-furyl, 2-thienyl, 2-pyrimicinyl, 2-benzothiazolyl), a cyano group, an alkoxy group (for example, methoxy, ethoxy, 2-methoxyethoxy, 2-dodecyloxyethoxy, 2-methanesulfonylethoxy), an aryloxy group (for example, phenoxy, 2-methylphenoxy, 4-tert-butylphenoxy), a heterocyclic oxy group (for example, 2-benzimidazolyloxy), an acyloxy group (for example, acetoxy, hexadecanoyloxy), a carbamoyloxy group (for example, N-phenylcarbamoyloxy, N-ethylcarbamoyloxy), a silyloxy group (for example, trimethylsilyloxy}, a sulfonyloxy group (for example, dodecylsulfonyloxy}, an acylamino group (for example, acetamido, benzamido, tetradecanamido, α-(2,4-di-tert-amylphenoxy)butylamido, γ-3-tert-butyl-4-hydroxyphenoxy)butylamido, α-{4-(4-hydroxyphenylsulfonyl)-phenoxy}decanamido), anilino groups (for example, phenylamino, 2-chloroanilino, 2 chloro-5-tetradecanamidoanilino, 2-chloro-5-dodecyloxycarbonylanilino, N-acetylanilino, 2-chloro-5-}α-(3-tert-butyl-4-hydroxyphenoxy)dodecanamido}anilino), ureido groups (for example, phenylureido, methylureido, N,N-dibutylureido), imido groups (for example, N-succinimido, 3-benzylhydantoinyl, 4-(2-ethylhexanoylamino)phthalimido), sulfamoylamino groups (for example, N,N-dipropylsulfamoylamino, N-methyldecylsulfamoylamino), carbamoylamino groups (for example, N,N-diethylcarbamoylamino, N-methyldecylcarbamoylamino), alkylthio groups (for example, methylthio, octylthio, tetradecylthio, 2-phenoxyethylthio, 3-phenoxypropylthio, 3-(4-tert-butylphenoxy)-propylthio), arylthio groups (for example, phenylthio, 2-butoxy-5-tert-octylphenylthio, 3-pentadecylphenylthio, 2-carboxyphenylthio, 4-tetradecanamidophenylthio) heterocyclylthio groups (for example, 2-benzothiazolylthio), alkoxycarbonylamino groups (for example, methoxycarbonylamino, tetradecyloxycarbonylamino), aryloxycarbonylamino groups (for example, phenoxycarbonylamino, 2,4-di-tert-butylphenoxycarbonylamino), sulfonamido groups (for example, methanesulfonamido, hexadecanesulfonamido, benzenesulfonamido, p-toluenesulfonamido, octadecanesulfonamido, 2-methyloxy-5-tert-butylbenzenesulfonamido), carbamoyl groups (for example, N-ethylcarbamoyl, N,N-dibutylcarbamoyl, N-(2-dodecyloxyethyl)carbamoyl, N-methyl-N-dodecylcarbamoyl, N-{3-(2,4-di-tert-amylphenoxy)propyl}-carbamoyl), acyl groups (for example, acetyl(2,4-di-tert-amylphenoxy)acetyl, benzoyl), sulfamoyl groups (for example, N-ethylsulfamoyl, N,N-dipropylsulfamoyl, N-(2-dodecyloxyethyl)sulfamoyl, N-(2-dodecyloxyethyl)-sulfamoyl, N-ethyl-N-dodecylsulfamoyl, N,N-diethylsulfamoyl), sulfonyl groups (for example, methanesulfonyl, octanesulfonyl, benzenesulfonyl, toluenesulfonyl), sulfinyl groups (for example, octanesulfinyl, dodecylsulfinyl, phenylsulfinyl), alkoxycarbonyl groups (for example, methoxycarbonyl, butyloxycarbonyl, dodecyloxycarbonyl, octadecyloxycarbonyl), or aryloxycarbonyl groups (for example, phenyloxycarbonyl, 3-pentadecylphenoxycarbonyl).

$X_1$ represents a hydrogen atom, a halogen atom (for example, chlorine, bromine, iodine), a carboxyl group or a group which is linked via an oxygen atom (for example, acetoxy, propanoyloxy, benzoyloxy, 2,4-dichlorobenzoyloxy, ethoxyoxaloyloxy, pyruvinyloxy, cinnamoyloxy, phenoxy, 4-cyanophenoxy, 4-methanesulfonamidophenoxy, 4-methanesulfonylphenoxy, α-naphthoxy, 3-pentadecylphenoxy, benzyloxycarbonyloxy, ethoxy, 2-cyanoethoxy, benzyloxy, 2-phenethyloxy, 2-phenoxyethoxy, 5-phenyltetrazolyloxy, 2-benzothiazolyloxy), a group which is linked via a nitrogen atom (for example, benzenesulfonamido, N-ethyltoluenesulfonamido, pentafluorobutanamido, 2,3,4,5,6-pentafluorobenzamido, octanesulfonamido, p-cyanophenylureido, N,N-diethylsulfamoylamino, 1-pyridyl, 5,5-dimethyl-2,4-dioxo-3-oxazolidinyl, 1-benzyl-ethoxy-3-hydantoinyl, 2-N-1,1-dioxo-3(2H)-oxo-1,2-benzisothiazolyl, 2-oxo-1,2-dihydro-1-pyridinyl, imidazolyl, pyrazolyl, 3,5-diethyl-1,2,4-triazol-1-yl, 5- or 6-bromo-benzotriazol-1-yl, 5-methyl-1,2,3,4-tetrazol-1-yl, benzimidazolyl, 3-benzyl-1-hydantoinyl, 1-benzyl-5-hexadecyloxy-3-hydantoinyl, 5-methyl-1-tetrazolyl), an arylazo group (for example, 4-methoxyphenylazo, 4-pivaloylaminophenylazo, 2-naphthylazo, 3-methyl-4-hydroxyphenylazo), or a group which is linked via a sulfur atom (for example, phenylthio, 2-carboxyphenylthio, 2-pivaloylaminophenylthio, 2-methoxy-5-tert-octylphenylthio, 4-methanesulfonylphenylthio, 4-octanesulfonylamidophenylthio, 2-butoxyphenylthio, 2-(2-hexanesulfonylethyl)-5-tert-octylphenylthio, benzylthio, 2-cyanoethylthio, 1-ethoxycarbonyltridecylthio, 5-phenyl-2,3,4,5-tetrazolylthio, 2-benzothiazolylthio, 2-dodecylthio-5-thiophenylthio, 2-phenyl-3-dodecyl-1,2,4-triazol-5-thio).

$R_{41}$ and $R_{42}$ in the couplers of general formulae (M-I) and (M II) may be joined together to form a five to seven membered ring.

Actual examples of couplers which can be used in the present invention and methods for their synthesis have been disclosed, for example, in JP-A-59-162548 (U.S.

Pat. No. 4,500,630), JP-A-60-43659, JP-A-59-171956 (U.S. Pat. No. 4,540,654 and U.S. Pat. No. 4,621,046), JP-A-60-33552, JP-A-60-172982 (U.S. Pat. No. 4,621,046), JP-A-63-264753, JP-B-47-27411 and U.S. Pat. No. 3,061,432.

Actual examples of typical couplers which can be used in the present invention are indicated below, but the invention is not limited by these examples.

| Compound | $R_{10}$ | $R_{41}$ | $R_{42}$ | $X_1$ |
|---|---|---|---|---|
| | | 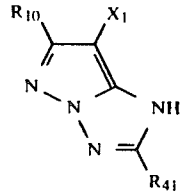 | | |
| M-1 | $CH_3$— | 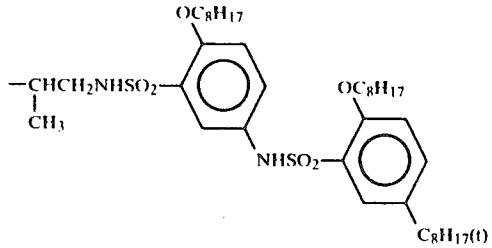 | | Cl |
| M-2 | As above | 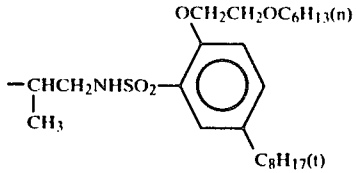 | | As above |
| M-3 | $(CH_3)_3C$— | 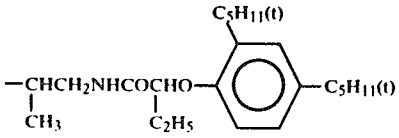 | | 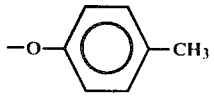 |
| M-4 | 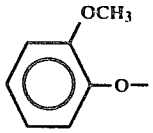 | 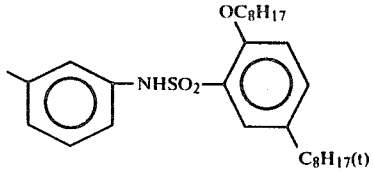 | | 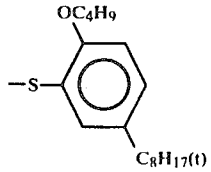 |

-continued
| Compound | $R_{10}$ | $R_{41}$ | $R_{42}$ | $X_1$ |
|---|---|---|---|---|
| M-5 | $CH_3$— | 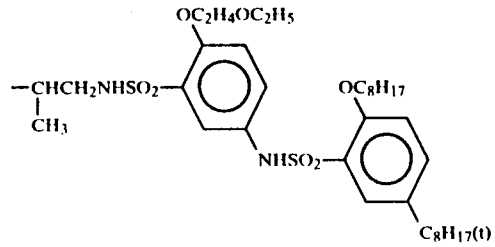 | | Cl |
| M-6 | As above | 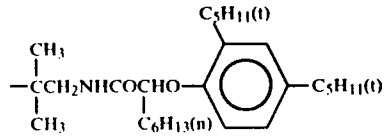 | | As above |
| M-7 | As above | 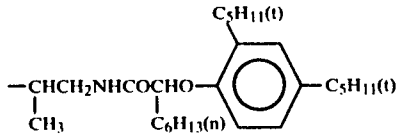 | | As above |
| M-8 | $CH_3$— | 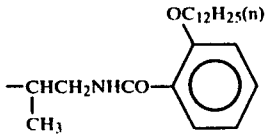 | | Cl |
| M-9 | As above | 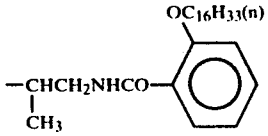 | | As above |

-continued
| Compound | $R_{10}$ | $R_{41}$ | $R_{42}$ | $X_1$ |
|---|---|---|---|---|
| M-10 | 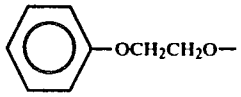 | 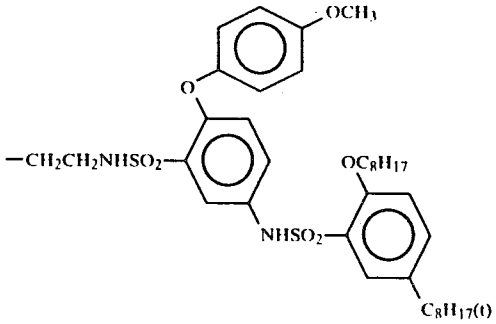 | | 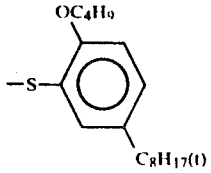 |
| M-11 | $CH_3CH_2O-$ | As above | | As above |
| M-12 | 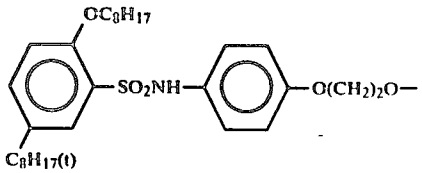 | 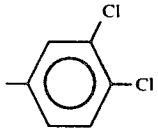 | | 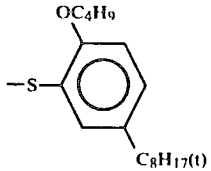 |
| M-13 | 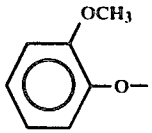 | 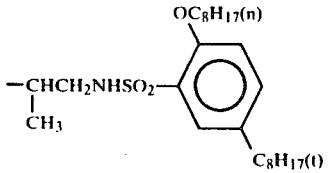 | | Cl |
| M-14 | 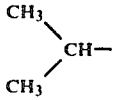 | 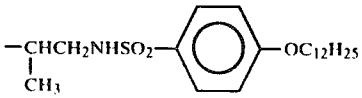 | | Cl |
| M-15 | 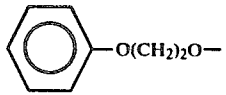 | 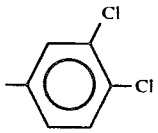 | 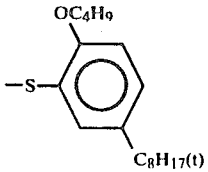 | |

-continued
| Compound | $R_{10}$ | $R_{41}$ | $R_{42}$ | $X_1$ |
|---|---|---|---|---|
| | | 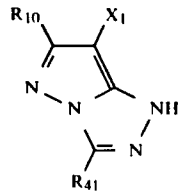 | | |
| M-16 | $CH_3$— | 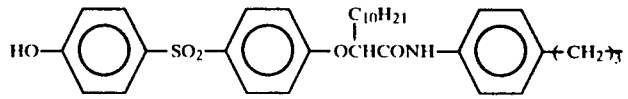 | | Cl |
| M-17 | As above | 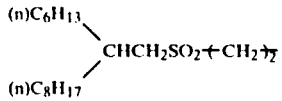 | | As above |
| M-18 | 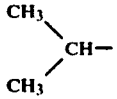 | 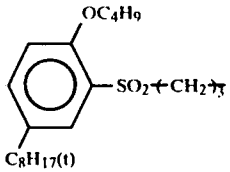 | | As above |
| M-19 | 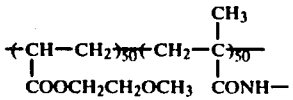 | 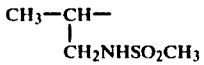 | | As above |
| M-20 | 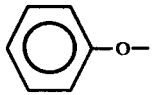 | 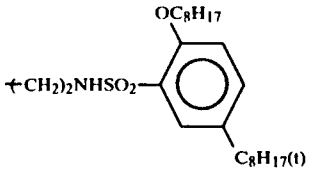 | | Cl |

-continued
| Compound | $R_{10}$ | $R_{41}$ | $R_{42}$ | $X_1$ |
|---|---|---|---|---|
| M-21 | $CH_3$— | 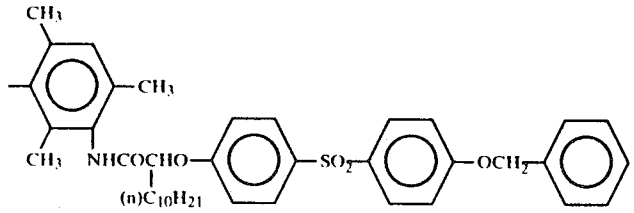 | | As above |
| M-22 | $(CH_3)_3C$— | 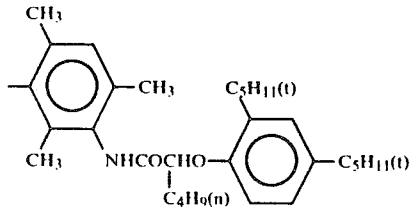 | | As above |
| M-23 | 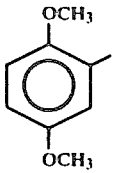 | 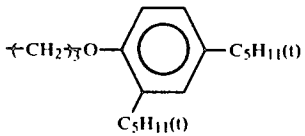 | | Cl |
| M-24 | $CH_3$— | 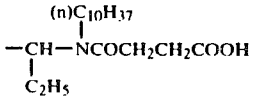 | | As above |
| M-25 | 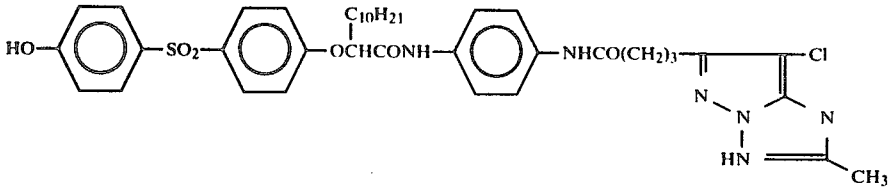 | | | |

-continued
| Compound | $R_{10}$ | $R_{41}$ | $R_{42}$ | $X_1$ |
|---|---|---|---|---|
| | | 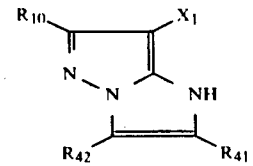 | | |
| M-26 | 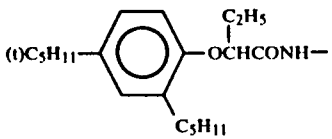 | H | $-CH_3$ | Cl |
| M-27 | 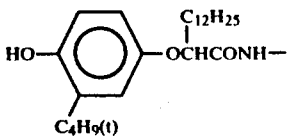 | H | $-CH_3$ | 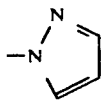 |
| M-28 | H | 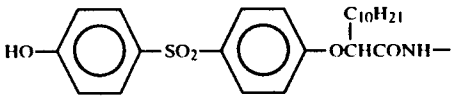 | H | 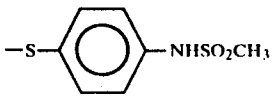 |
| | | 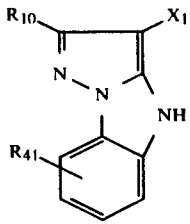 | | |
| M-29 | 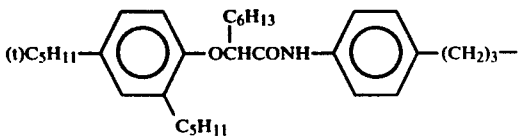 | H | | Cl |

-continued
| Compound | $R_{10}$ | $R_{41}$ | $R_{42}$ | $X_1$ |
|---|---|---|---|---|
| M-30 | 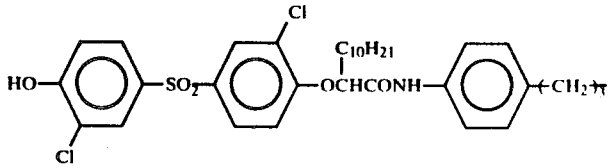 | H | | 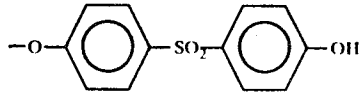 |

The couplers of the present invention which can be represented by the general formula (M) are added to the emulsion layer in an amount of from $1\times10^{-3}$ to 1 mol, and preferably from $5\times10^{-2}$ to $5\times10^{-1}$ mol, per mol of silver halide present in the same layer. Furthermore, two or more couplers of the present invention can also be added to the same emulsion layer.

General formula (A) is described in further detail below.

A represents a single bond,

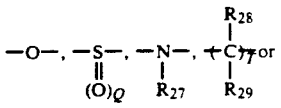

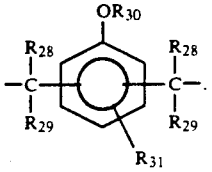

Next, examples of the substituent groups represented by $R_{21}$, $R_{22}$, $R_{23}$, $R_{24}$, $R_{25}$, $R_{26}$, $R_{27}$, $R_{28}$, $R_{29}$, $R_{31}$, $R_{32}$, $R_{33}$ and $R_{34}$ are described in detail. Thus, these groups are halogen atoms such as fluorine, chlorine or bromine, aryl groups such as phenyl, 4-methoxyphenyl or 2-hydroxyphenyl, alkoxy groups such as methoxy, octyloxy, iso-propyloxy, sec-butyloxy or dodecyloxy, aryloxy groups such as phenoxy, 4-methoxyphenoxy or 4-dodecyloxyphenoxy, alkylthio groups such as methylthio, tert-butylthio or dodecylthio, arylthio groups such as phenylthio or 2-tertbutylphenylthio, acyl groups such as acetyl, pivaloyl, iso-butylyl, myristyl, acryloyl, benzoyl or p-methoxybenzoyl, alkoxycarbonyl groups such as methoxycarbonyl or dodecyloxycarbonyl, aryloxycarbonyl groups such as phenoxycarbonyl or 4-tert-butylphenoxycarbonyl, acylamino groups such as acetylamino, myristylamino, N-methylacetylamino, methacryloylamino, 4-tert-butylphenoxyacetylamino or benzoylamino, alkylsulfonamido groups such as methanesulfonamido or octanesulfonamido, arylsulfonamido groups such as benzenesulfonamido or p-methoxybenzenesulfonamido, imido groups such as succinimido or dodecylsuccinimido, acyloxy groups such as acetyloxy, myristyloxy or benzoyloxy, alkylsulfonyl groups such as methanesulfonyl or hexadecylsulfonyl, arylsulfonyl groups such as benzenesulfonyl or p-dodecyloxybenzenesulfonyl, alkylsulfonyloxy groups, such as methanesulfonyloxy or dodecylsulfonyloxy, arylsulfonyloxy groups such as benzenesulfonyloxy or p-methoxybenzenesulfonyloxy, alkoxycarbonylamino groups such as methoxycarbonylamino or N-methyloctyloxycarbonylamino, aryloxycarbonylamino groups such as phenoxycarbonylamino or 2,4-di-tert-butylphenoxycarbonylamino, carbamoylamino groups such as N,N-dimethylcarbamoylamino or N-octylcarbamoylamino, sulfamoylamino groups such as N,N-diethylsulfamoylamino or N-octyl-N-methylsulfamoylamino, carbamoyl groups such as N,N-diethylcarbamoyl, N-octylcarbamoyl or N-phenylcarbamoyl, sulfamoyl groups such as N,N-dimethylsulfamoyl or N-phenylsulfamoyl, alkyl groups such as methyl, isopropyl, tert-butyl or dodecyl, or aralkyl groups such as benzyl or phenethyl.

Compounds which can be represented by general formula (A-I) indicated below are preferred from the point of view of the effect of the present invention.

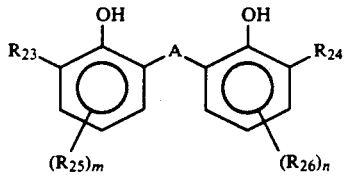

(A-I)

In formula (A-I), $R_{23}$, $R_{24}$, $R_{25}$, $R_{26}$, A, m and n are the same as those defined respectively in connection with general formula (A).

Of the compounds represented by the general formula (A-I), those in which A represents

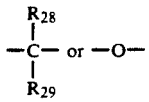

are especially desirable from the point of view of the effect of the present invention.

Among the groups of $R_{23}$ and $R_{24}$, an alkoxy group, an aryloxy group, an alkylthio group, an arylthio group, an acylamino group, an alkylsulfonamido group, an arylsulfonamido group, an imido group, an acyloxy group, an alkylsulfonyloxy group, an arylsulfonyloxy group, an arylsulfonyloxy group, an alkoxycarbonylamino group, an aryloxycarbonylamino group, a carbamoylamino group, a sulfamoylamino group, an acyl group or

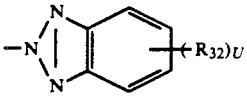

is preferable, and an alkoxy group, an acylamino group, an alkoxycarbonylamino group, or a carbamoylamino group is the most preferable.

$R_{25}$ and $R_{26}$ in the compound (A), are preferable when $R_{25}$ and $R_{26}$ are para position with respect to the —$OR_2$; and —$OR_{22}$ groups respectively. Among the groups of $R_{25}$ and $R_{26}$, an alkyl group, an acylamino group, an alkylsulfonamido group or an arylsulfonamido group is preferable.

$R_{28}$ and $R_{29}$ are preferable when at least one of these groups represent a hydrogen atom, and are the most preferable when $R_{28}$ represents a hydrogen atom and $R_{29}$ represents an alkyl group, am aryl group or an alalkyl group.

Actual examples of compounds which can be represented by general formula (A) are indicated below, but these compounds are not limited by the examples.

A-1
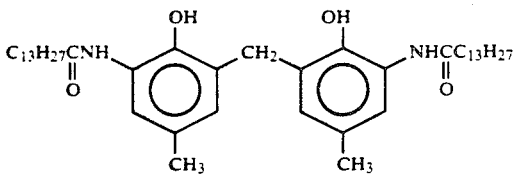
A-2
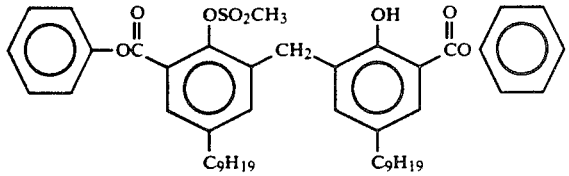
A-3
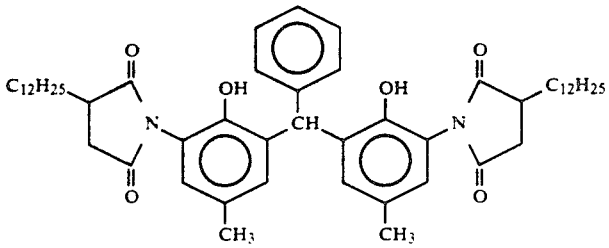
A-4
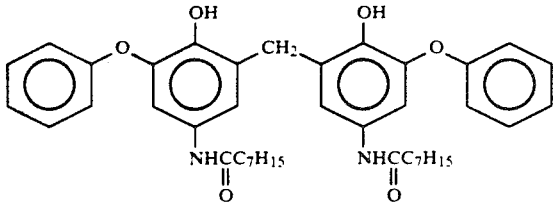
A-5
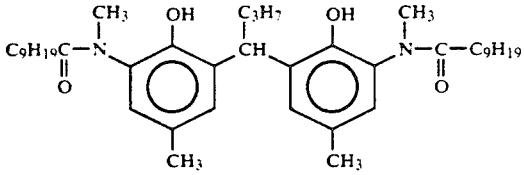
A-6
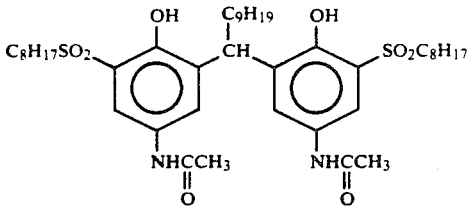
A-7
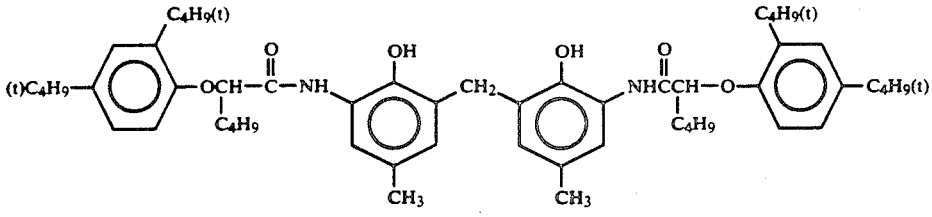
A-8
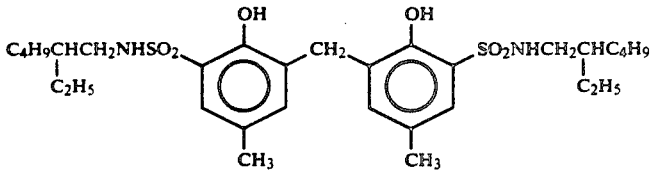

-continued
A-9
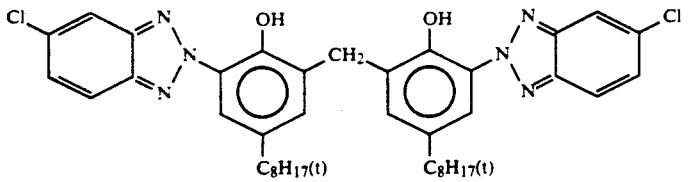
A-10
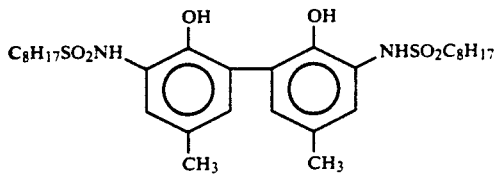
A-11
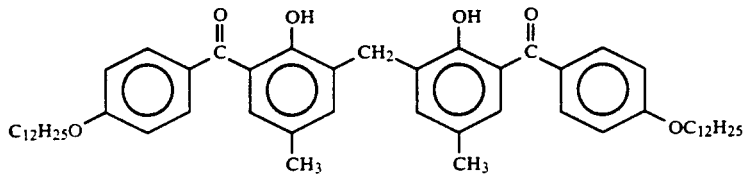
A-12
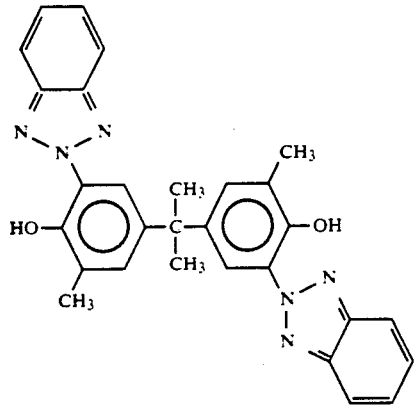
A-13
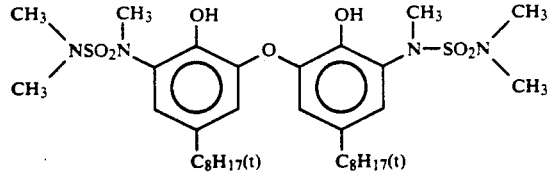
A-14
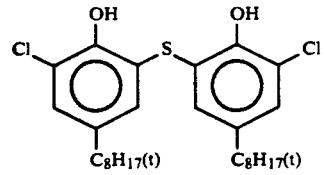
A-15
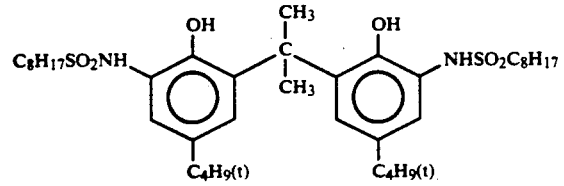

-continued
A-16
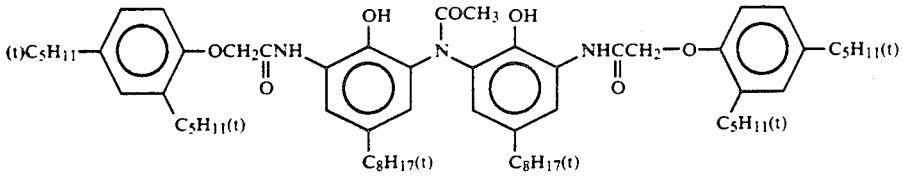
A-17
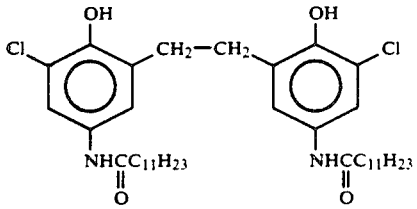
A-18
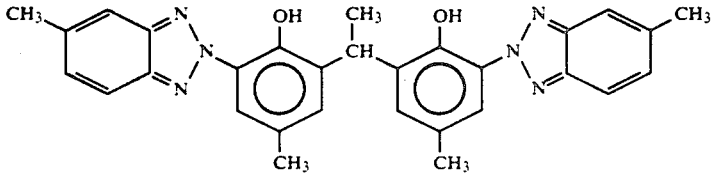
A-19
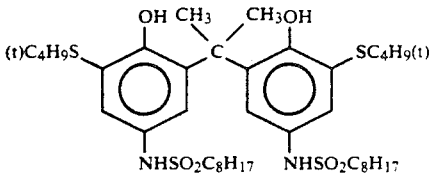
A-20
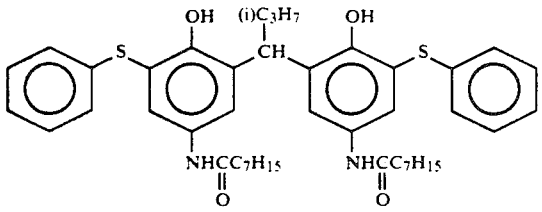
A-21
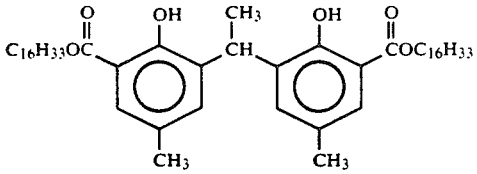
A-22
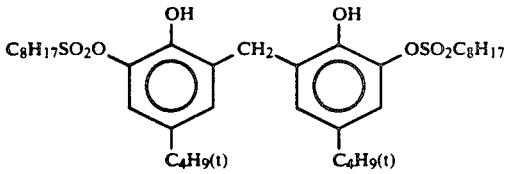
A-23
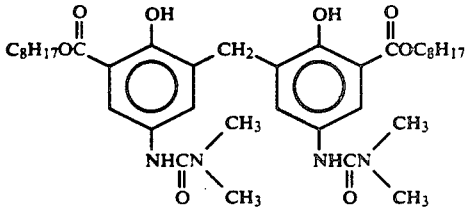

-continued
A-24
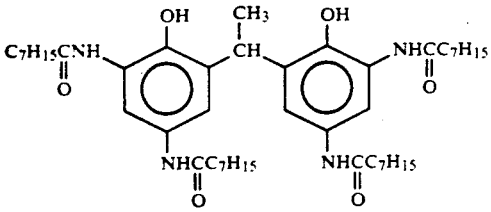
A-25
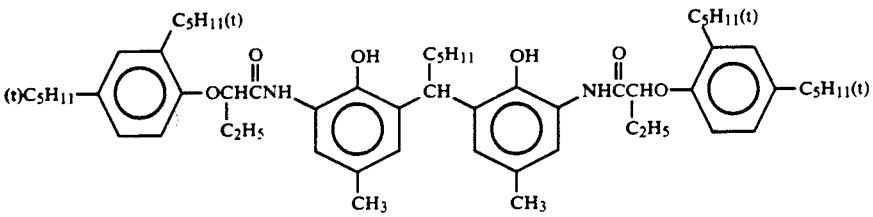
A-26
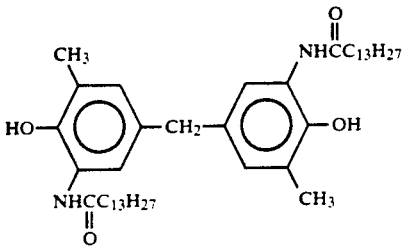
A-27
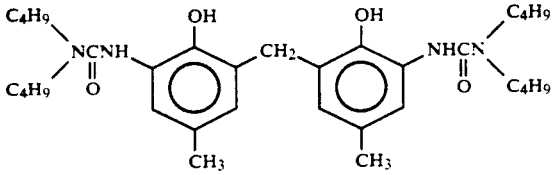
A-28
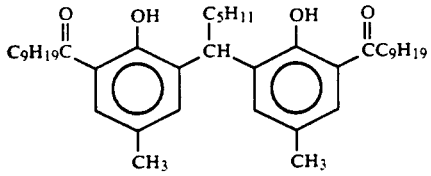
A-29
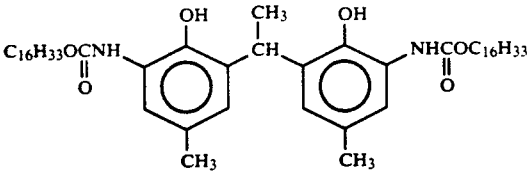
A-30
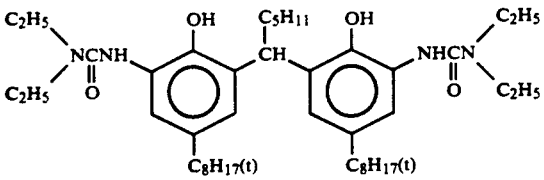
A-31
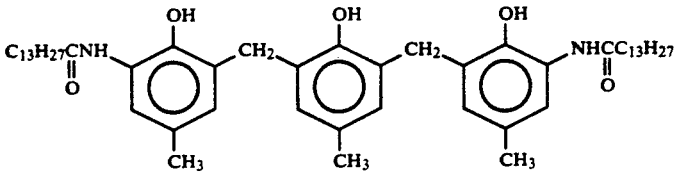

-continued
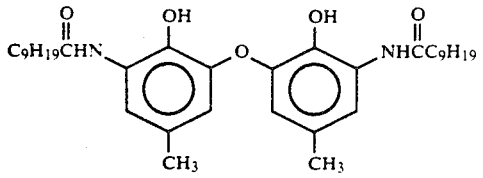
A-32
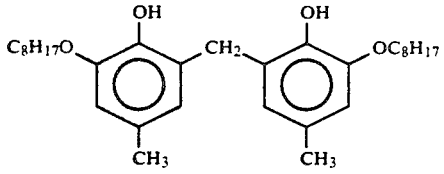
A-33
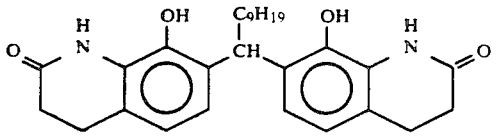
A-34
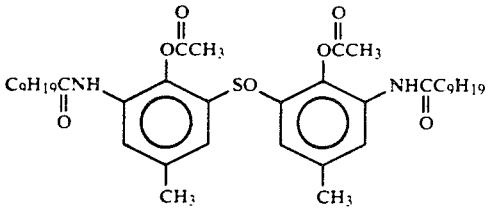
A-35
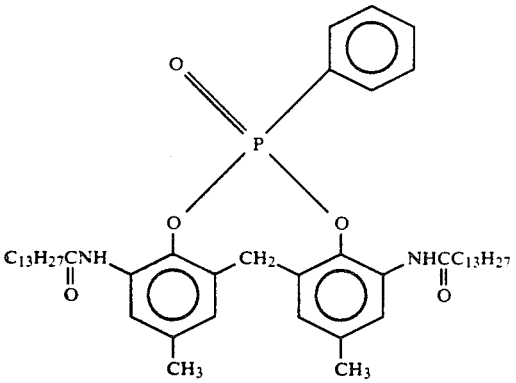
A-36
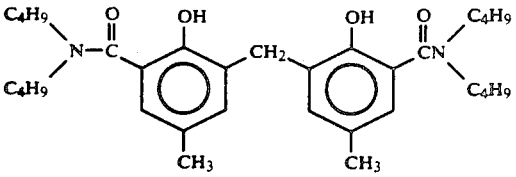
A-37
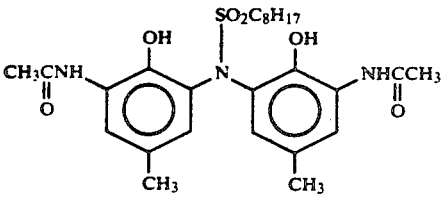
A-38

-continued

A-39

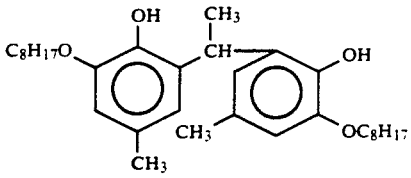

A-40

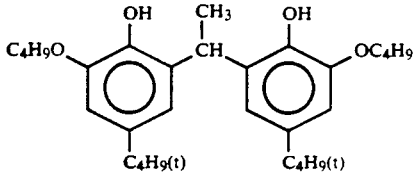

A-41

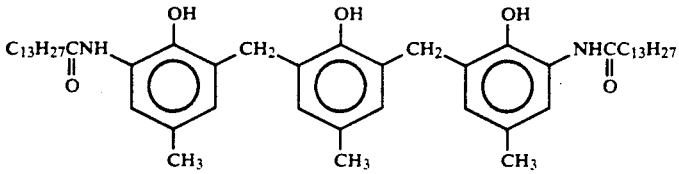

A-42

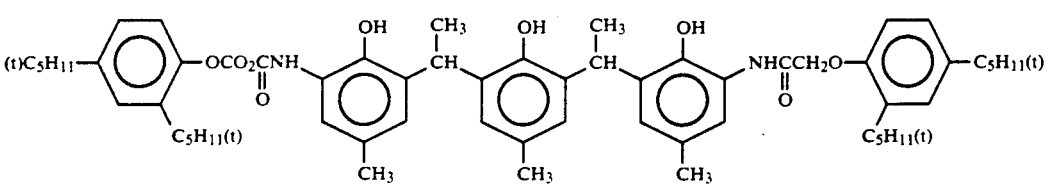

A-43

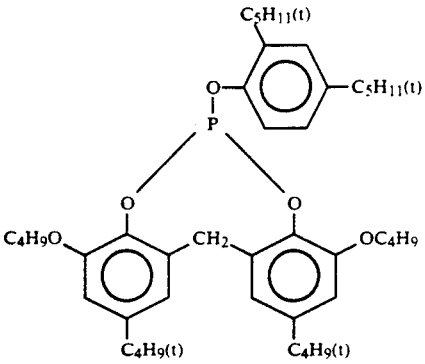

The compounds represented by general formula (A) which can be used in the present invention can be prepared using the methods disclosed in JP-A-50-6338, JP-A-50-87326, J. Am. Chem. Soc., Vol. 75, page 947 (1953) and J. Chem. Soc. page 243 (1954), and using methods based on these methods.

Furthermore, the amount of compound represented by general formula (A) added differs according to the type of compound and the pyrazoloazole coupler used, but it is generally from 1 to 300 mol %, and preferably from 2 to 100 mol %, with respect to the pyrazoloazole coupler used.

General formula (B) is described in detail below. Thus, in general formula (B), $R_4$ represents an alkyl group (for example, methyl, n-butyl, n-octyl, n-hexadecyl, ethoxyethyl, 3-phenoxypropyl, benzyl), an alkenyl group (for example, vinyl, allyl), an aryl group (for example, phenyl, naphthyl), a heterocyclic group (for example, pyridyl, tetrahydropyranyl) or a silyl group (for example, trimethylsilyl, tert-butyldimethylsilyl). $R_5$, $R_6$, $R_7$, $R_8$ and $R_9$ may be the same or different, each being a hydrogen atom, an alkyl group (for example, methyl, n-butyl, n octyl, sec-dodecyl, tert-butyl, tert-amyl, tert-hexyl, tert-octyl, tert-octadecyl, $\alpha,\alpha$-dimethylbenzyl, 1,1-dimethyl-4-hexyloxycarbonylbutyl), an alkenyl group (for example, vinyl, allyl), an aryl group (for example, phenyl, naphthyl, p-methoxyphenyl, 2,4-tert-butylphenyl), an amino group which has substituent groups (for example, acetylamino, propionylamino, benzamino, N-methylamino, N,N-dimethylamino, N,N-dihexylamino, N-cyclohexylamino, N-(tertbutyl)amino and nitrogen containing heterocyclic groups in which substituent groups have undergone ring closure (for example piperidino, 1-piperazinyl), an alkylthio group (for example, methylthio, n-butylthio, sec-butylthio, tert-butylthio, dodecylthio), an arylthio group (for example, phenylthio, naphthylthio), a halogen atom (for example, chlorine, bromine), $$-\underset{\underset{O}{\|}}{C}-OR_4'.$$

(for example, octyloxycarbonyl, 2,4-di-tert-butylphenoxycarbonyl) or —O—$R_4'$. Here, $R_4'$ is defined the same as $R_4$. $R_4$ and $R_5$ may be joined together to form a five or six membered ring or a spiro ring structure. These rings may be chroman rings, coumaran rings, spirochroman rings or spiroindane rings.

At least one of the substituent groups represented by $R_5$ to $R_9$ of the compound represented by general formula (B) is preferably bonded to the benzene ring via a hetero atom (most desirably oxygen or nitrogen) from the point of view of the effect of the present invention.

of the compounds represented by general formula (B), those which can be represented by general formulae (B-I) to (B-VIII) indicated below are especially desirable from the point of view of the effect of the present invention.

General Formula (B-I)

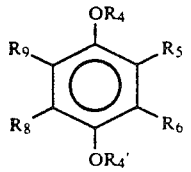

General Formula (B-II)

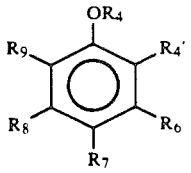

General Formula (B-III)

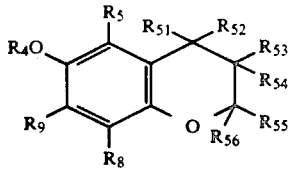

General Formula (B-IV)

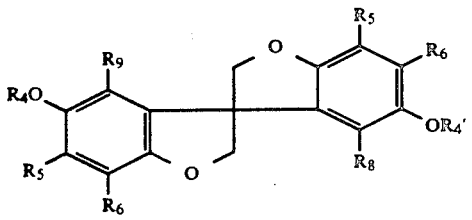

General Formula (B-V)

-continued

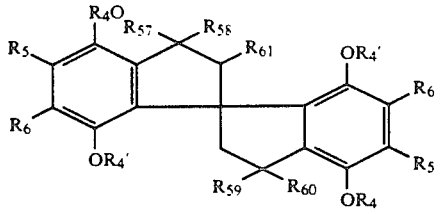

General Formula (B-VI)

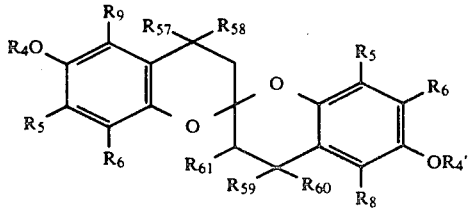

General Formula (B-VII)

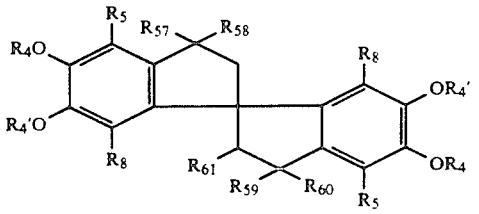

General Formula (B-VIII)

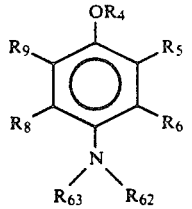

$R_{43}$, $R_4'$, $R_5$, $R_6$, $R_7$, $R_8$ and $R_9$ in general formulae (B-I) to B-VIII) are defined the same as the groups in general formula (B). $R_{51}$ to $R_{61}$ may be the same or different, each representing a hydrogen atom, an alkyl group (for example, methyl, ethyl, isopropyl, dodecyl) or an aryl group for example, phenyl, p-methoxyphenyl). $R_{54}$ and $R_{55}$, and $R_{55}$ and $R_{56}$ may be joined together to form a five to seven membered hydrocarbyl ring.

$R_{62}$ and $R_{63}$ may be the same or different, each representing a hydrogen atom, an alkyl group (for example, methyl, ethyl, dodecyl), an aryl group (for example, phenyl, 4-chlorophenyl), an acyl group (for example, acetyl, benzoyl, dodecanoyl), an oxycarbonyl group (for example, methoxy-carbonyl, 4-dodecyloxyphenoxycarbonyl) or a sulfonyl group (for example, methanesulfonyl, octanesulfonyl, benzenesulfonyl). However, $R_{62}$ and $R_{63}$ cannot both at the same time be hydrogen atoms. Furthermore, $R_{62}$ and $R_{63}$ may be joined together to form a five to seven membered ring (for example, a morpholine or piperidine ring).

Of the compounds represented by general formulae (B-I) to (B-VIII), those in which $R_4$ and $R_4'$ are alkyl groups or aryl groups are preferred, and those in which they are alkyl groups are most desirable. Furthermore, of the compounds represented by the general formulae (B-I) to (B-VIII), those in which $R_5$ to $R_9$ are hydrogen atoms, alkyl groups or aryl groups are preferred.

Of the compounds represented by the general formulae (B-I) to (B-VIII), those represented by (B-V), (B-VI) and (B-VII) are preferred, and those represented by general formula (B-VII) are the most desirable, from the point of view of the effect of the present invention.

Actual examples of compounds which can be represented by the general formula (B) are indicated below, but these compounds are not limited by these examples.

B-1

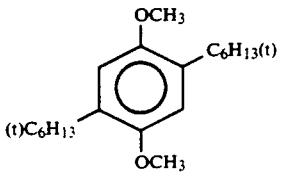

B-2

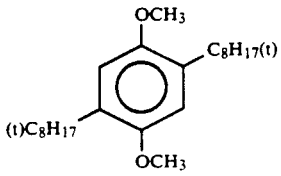

B-3

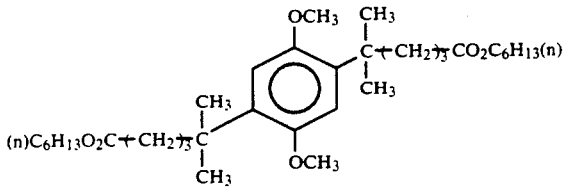

B-4

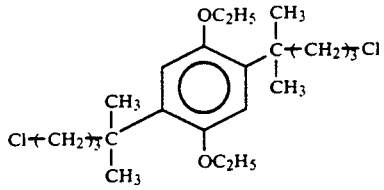

B-5

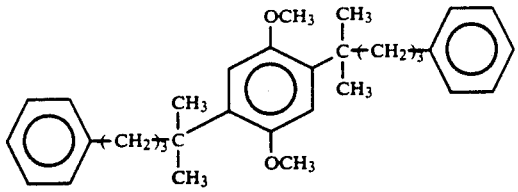

B-6

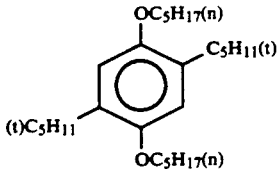

B-7

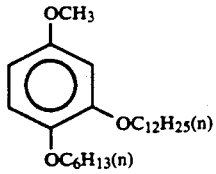

-continued
B-8
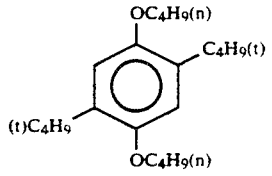
B-9
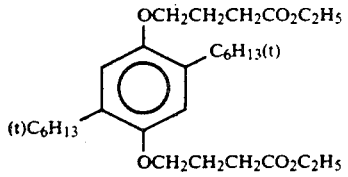
B-10
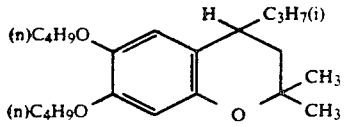
B-11
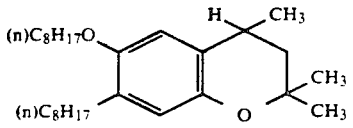
B-12
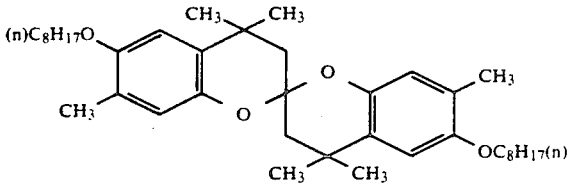
B-13
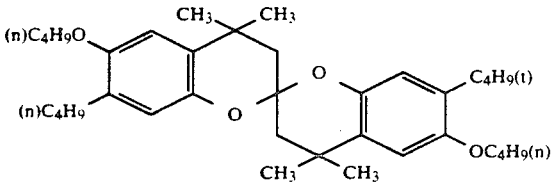
B-14
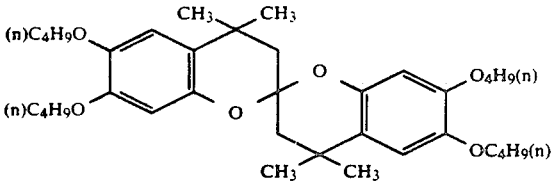
B-15
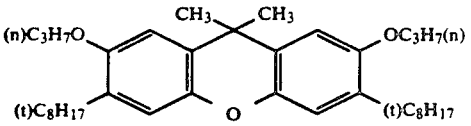
B-16
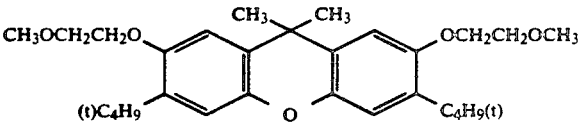
B-17
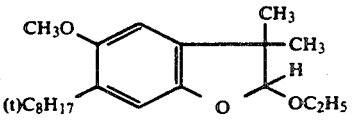

-continued
B-18
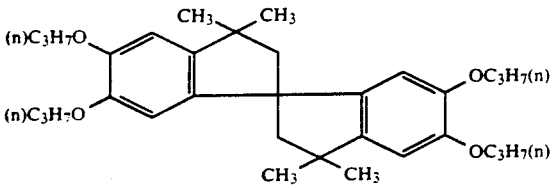
B-19
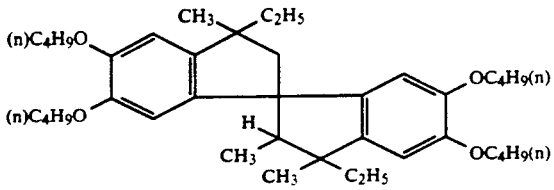
B-20
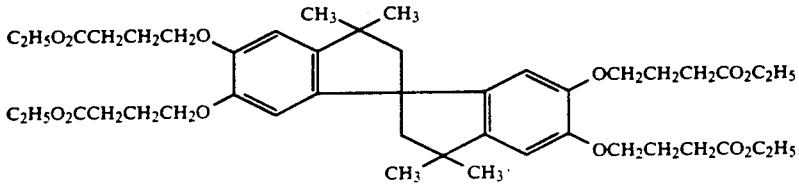
B-21
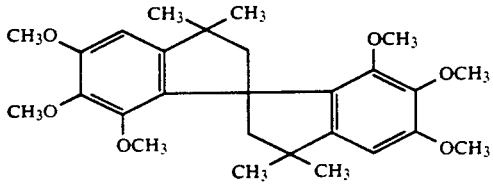
B-22
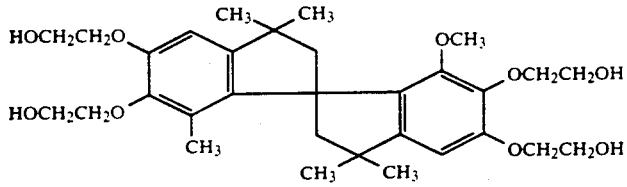
B-23
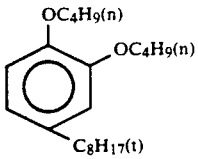
B-24
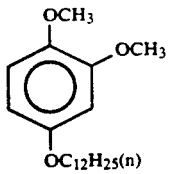
B-25
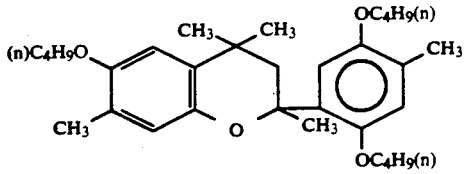
B-26
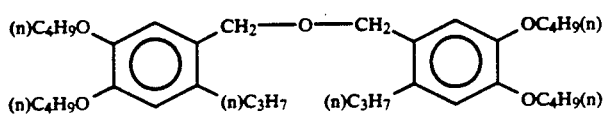

-continued
B-27
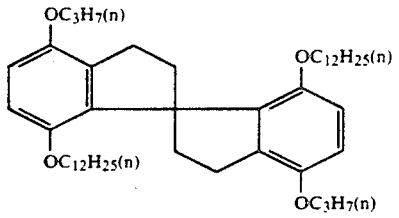
B-28
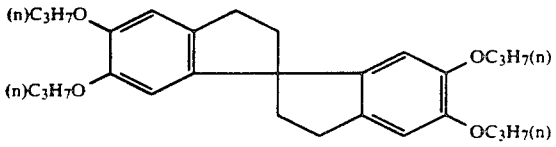
B-29
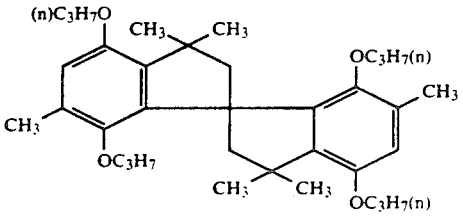
B-30
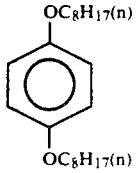
B-31
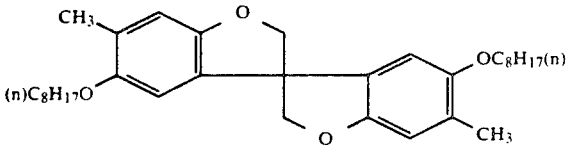
B-32
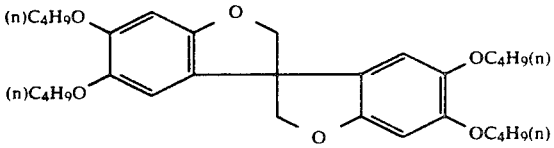
B-33
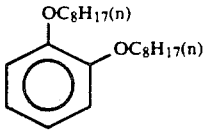
B-34
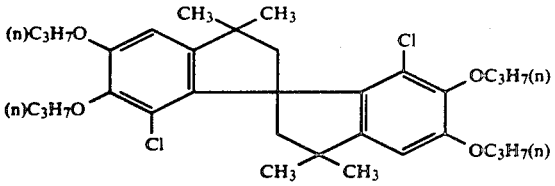
B-35
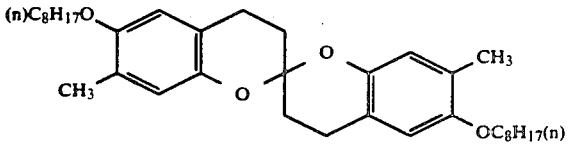

-continued
B-36
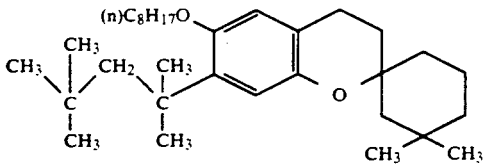
B-37
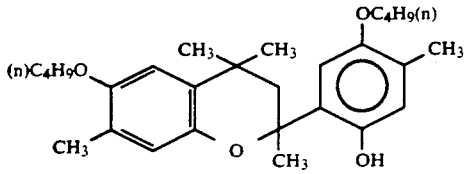
B-38
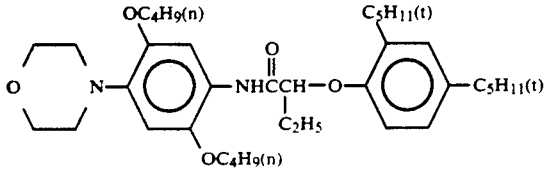
B-39
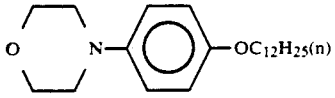
B-40
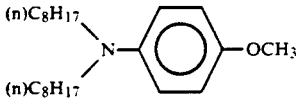
B-41
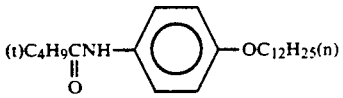
B-42
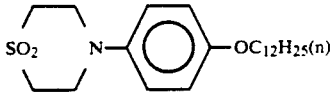
B-43
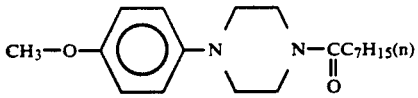
B-44
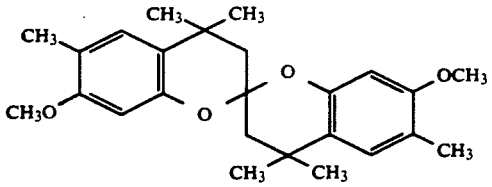
B-45
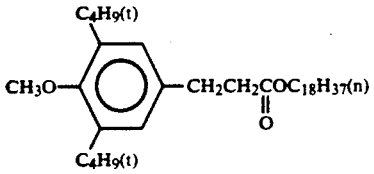

-continued

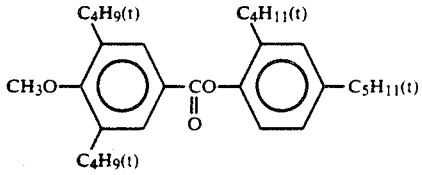

B-46

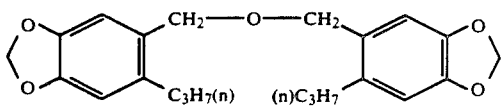

B-47

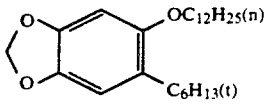

B-48

The compounds (B) can be prepared using the methods disclosed, for example, in JP-B-45-14034, JP-B-56-24257, JP-B-59-52421 (U.S. Pat. No. 4,155,765), JP-A-55-89835 (U.S. Pat. No. 4,264,720), JP-A-56-159644 (DE 3119252), JP-A-62-244045, JP-A-62-244046 (U.S. Pat. No. 4,895,793), JP-A-62-273531 (U.S. Pat. No. 4,868,101), JP-A-63-220142, JP-A-63-95439 (U.S. Pat. No. 4,814,262), JP-A-63-95448, JP-A-63-95450 and European Patent 0,239,972, and methods based upon the methods disclosed in these specifications.

The amount of the compounds (B) added is from 2 to 400 mol %, and preferably from 5 to 200 mol %, with respect to the pyrazoloazole coupler.

The pyrazoloazole coupler and the compounds represented by general formulae (A) and (B) may be dispersed in the hydrophilic colloid layer without using the high boiling point organic solvents described hereinafter, but the use of a high boiling point organic solvent is desirable from the point of view of the effect of the invention. In this case, the known methods, such as those disclosed in U.S. Pat. No. 2,322,027 for example, can be used in general for introducing these compounds into a silver halide emulsion layer.

When compounds which are represented by general formulae (A) and (B) of the present invention are used along with a pyrazoloazole based magenta coupler, the light fastness of the dye image, especially in the low density region, is improved to an extent which could not be predicted on the basis of the conventional technique, and silver halide color photographic materials which have the same degree of light fastness even on changing the processing baths are obtained, and it is possible to realize the objects of the present invention. This light fastness improving effect cannot be explained by adding together the effects obtained on adding the different types of compound individually.

Furthermore, there is a marked improvement in storage properties when compounds represented by general formula (V) and compounds represented by general formula (VI) are used in combination in addition to the combination of the pyrazoloazole coupler and compounds represented by the general formulae, (A) and (B) of the present invention. Hence, the combination use of these compounds is desirable.

Furthermore, these compounds of general formulae (V) and (VI) can also be used in combination with the yellow couplers and cyan couplers described hereinafter respectively in the same layer, as required.

General Formula (V)

$$R_{70}-V-\overset{\overset{\displaystyle O}{\|}}{C}-O-T$$

General Formula (VI)

$$T-SO_2M$$

In these formulae, $R_{70}$ represents an alkyl group, an alkenyl group, an aryl group or a heterocyclic group, and V represents —O— or a simple single bond. T represents an aryl group or a heterocyclic group, and M represents a hydrogen atom or a group of atoms which forms an inorganic or an organic salt.

General formulae (V) and (VI) are described in more detail below. Thus, $R_{70}$ represents an alkyl group (for example, methyl, ethyl, 2-ethylhexyl, hexadecyl, 2,4-di-tert-phenoxyethyl), an alkenyl group (for example, vinyl, allyl), an aryl group (for example, phenyl, p-methoxyphenyl) or a heterocyclic group (for example, 3-pyridyl, 4-pyridyl), and it preferably represents an alkyl group. T represents an aryl group (for example, phenyl, 2,6-dichlorophenyl, 2,6-dichloro-4-ethoxycarbonylphenyl, 3,5-di-2-ethylhexylcarbamoylphenyl) or a heterocyclic group (for example, 2-pyridyl, 3-(1-phenyl-2-pyrazolyl), 3-(1-phenyl-4-dimethyl-2-pyrazolyl), and it is preferably an aryl group. M represents, for example, a hydrogen atom, an atomic group which forms an inorganic salt (for example, a lithium salt, a sodium salt, a potassium salt, a magnesium salt or an ammonium salt) or an organic salt (for example, tetraethylammonium salt), and it is preferably a atomic group which forms an alkali metal salt.

Typical examples of these compounds are indicated below, but the compounds are not limited by these examples.

(V-1)
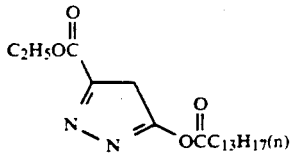
(V-2)
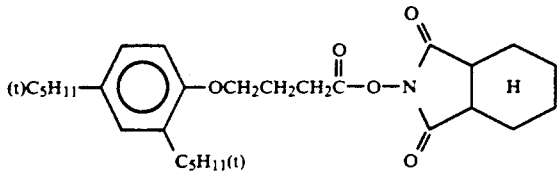
(V-3)
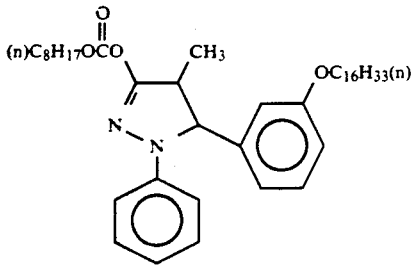
(V-4)
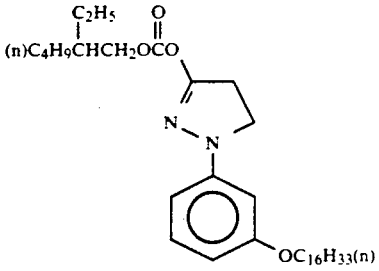
(V-5)
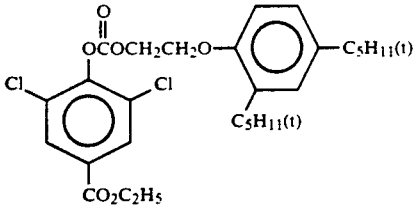
(V-6)
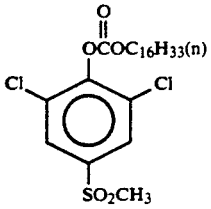
(V-7)
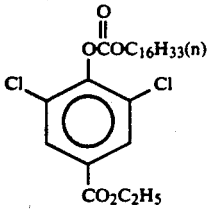

-continued
(V-8)
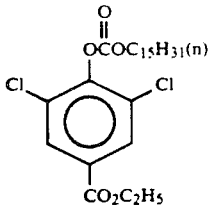
(V-9)
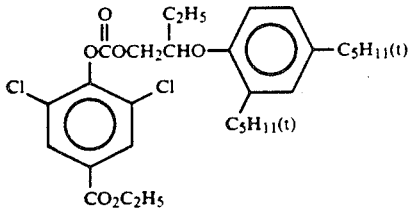
(V-10)
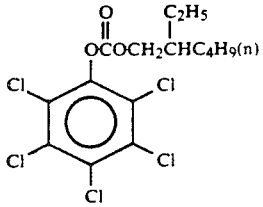
(V-11)
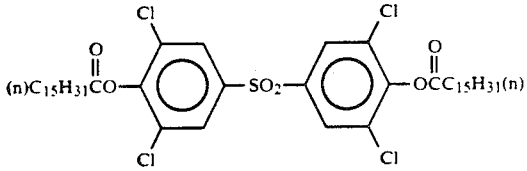
(V-12)
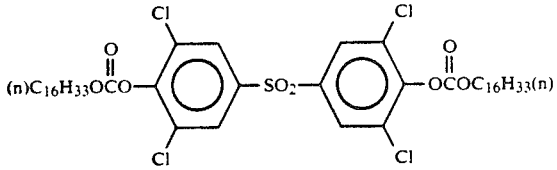
(V-13)
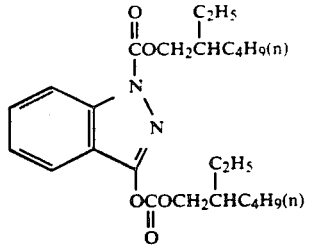
(VI-1)
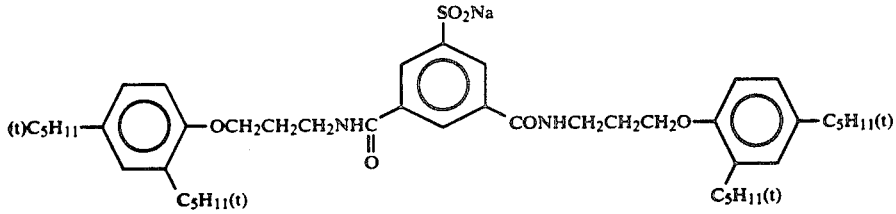
(VI-2)
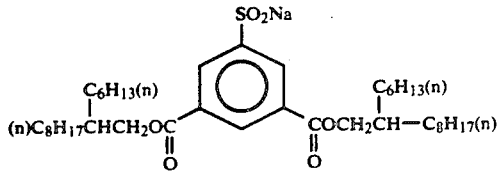

-continued
(VI-3)
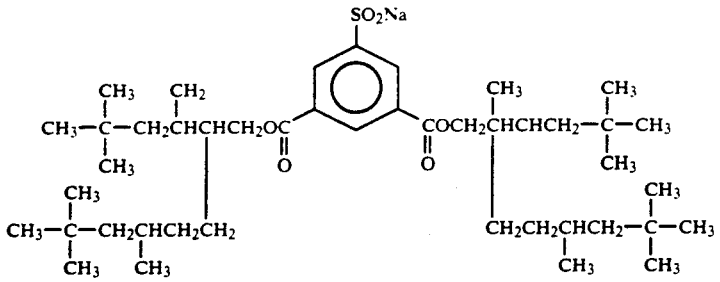
(VI-4)
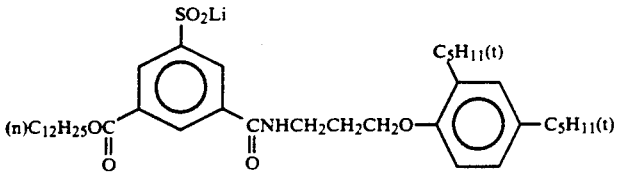
(VI-5)
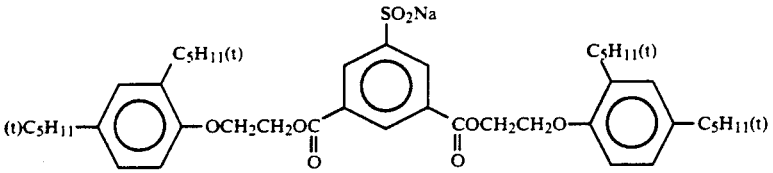
(VI-6)
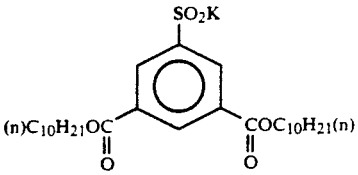
(VI-7)
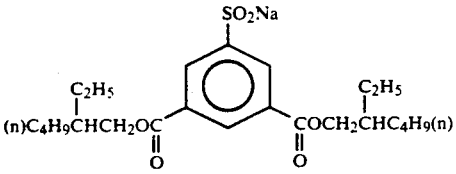
(VI-8)
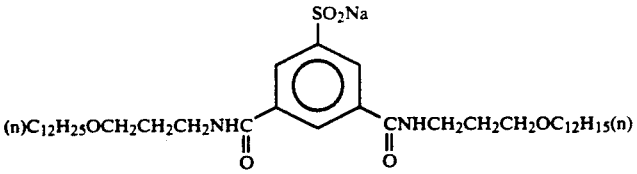
(VI-9)
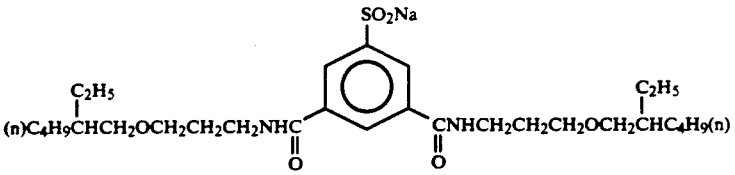
(VI-10)
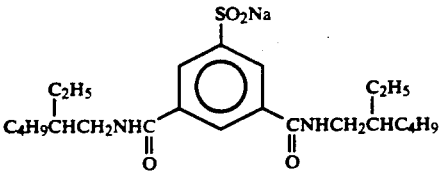

-continued
(VI-11)
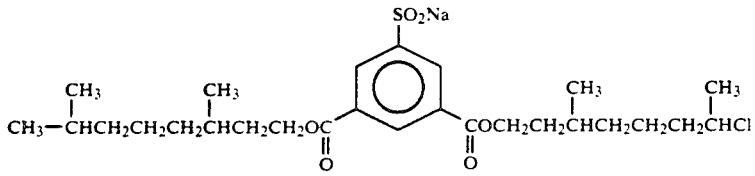
(VI-12)
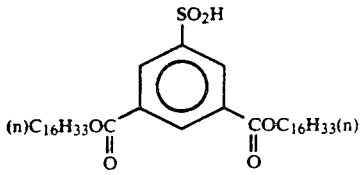
(VI-13)
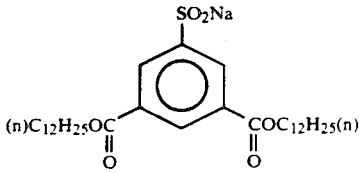
(VI-14)
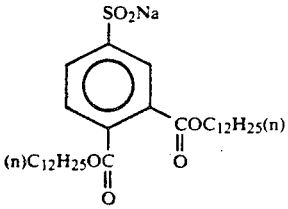
(VI-15)
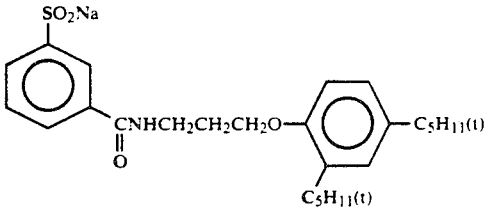
(VI-16)
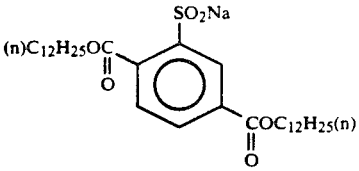
(VI-17)
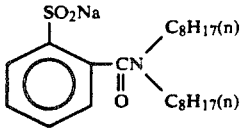
(VI-18)
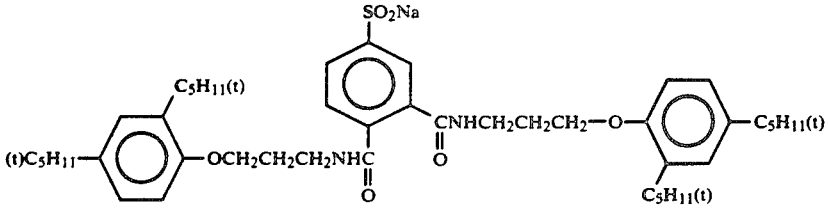

-continued

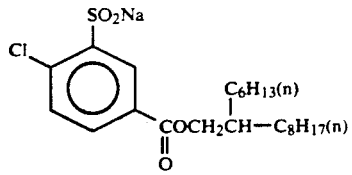
(VI-19)

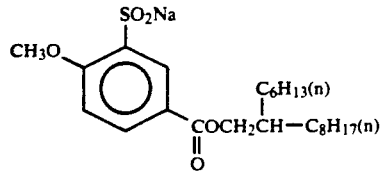
(VI-20)

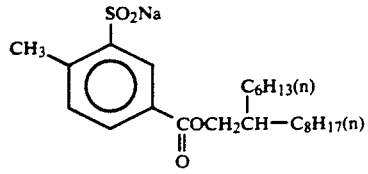
(VI-21)

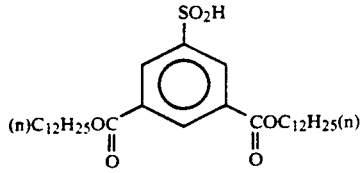
(VI-22)

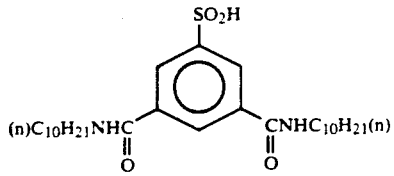
(VI-23)

Compounds of general formulae (V) and (VI) can be prepared using the methods disclosed in JP-A-62-283338 (EP 230048), JP-A-63-115866, JP-A-63-115855 and European Patent 255,722, or on the basis of the methods disclosed in these specifications.

These compounds may be used individually, and compounds of general formula (V) and (VI) may be used conjointly. Each amount of these compounds added is from 1 to 200 mol %, and preferably from 5 to 100 mol %, with respect to the coupler.

At least one pyrazoloazole dye forming coupler of the present invention, at least one compound which can be represented by general formula (A) and at least one compound which can be represented by general formula (B) are included in the same layer, and they can be introduced into the photosensitive material using various known methods of dispersion. Thus, they may be added by means of the known oil in water dispersion method using a general oil protection method, and they can be dissolved in a solvent and then be emulsified and dispersed in an aqueous gelatin solution which contains a surfactant. Alternatively, water or an aqueous gelatin solution can be added to a solution of the color coupler and compounds of the present invention which contains a surfactant and an oil in water dispersion can be formed by phase reversal. Furthermore, alkali soluble compounds and color couplers of the present invention can be dispersed using the so-called Fischer dispersion method. After removing the low boiling point organic solvent by evaporation, noodle washing or ultrafiltration for example, the dispersion of the compounds and color coupler of the present invention may be mixed with the photographic emulsion. The use of high boiling point organic solvents which have a dielectric constant (25° C) of from 2 to 20 and a refractive index (25° C) of from 1.3 to 1.7 and/or water insoluble polymeric compounds as the dispersion media for the compounds and color couplers of the present invention is preferred.

Examples of high boiling point solvents which can be used in the oil in water dispersion method have been disclosed, for example, in U.S. Pat. No. 2,322,027. Furthermore, actual examples of the process and effect of the latex loading method and of latexes for loading as one polymer dispersion method have been disclosed, for example, in U.S. Pat. No. 4,199,363, and West German Patent Applications (OLS) 2,541,274 and 2,541,230, and methods of dispersion by means of organic solvent soluble polymers have been disclosed in PTC International Patent W088/00723.

Examples of high boiling point organic solvents which can be used in the aforementioned oil in water dispersion method include esters of phthalic acid (for example, dibutyl phthalate, dioctyl phthalate, dicyclohexyl phthalate, di-2-ethylhexyl phthalate, decylphthalate, bis(2,4-di-tert-amylphenyl)isophthalate, bis(1,1-diethylpropyl)phthalate), phosphate esters or phosphonate esters (for example, diphenyl phosphate, triphenyl phosphate, tricresyl phosphate, 2-ethylhexyl diphenyl phosphate, dioctyl butyl phosphate, tricyclohexyl phosphate, tri-2-ethylhexyl phosphate, tridodecyl phosphate, di-2-ethylhexyl phenyl phosphate), benzoic acid esters (for example, 2-ethylhexyl benzoate, dodecyl-2,4-dichlorobenzoate, dodecyl benzoate, 2-ethylhexyl p-hydroxybenzoate), amides (for example, N,N-diethyldecanamide, N,N-diethyllaurylamide), alcohols or phenols (for example, isostearyl alcohol, 2,4-di-tert-amylphenol), fatty acid esters (for example, dibutoxyethyl succinate, di-2-ethylhexyl succinate, 2-hexyldecyl tetradecanoic acid, tributyl citrate, diethyl azelate, isostearyl lactate, trioctyl lactate), aniline derivatives (for example, N,N-dibutyl-2-butoxy-5-tert-octylaniline), chlorinated paraffins (paraffins which have a chlorine content of from 10% to 80%), trimesic acid esters (for example, tributyl trimesate), dodecylbenzene and di-isopropylnaphthalene. Moreover, organic solvents of boiling point at least 30° C. but not more than about 160° C. (for example, ethyl acetate, butyl acetate, ethyl propionate, methyl ethyl ketone, cyclohexanone, 2-ethoxyethyl acetate, dimethylformamide) can be used conjointly as auxiliary solvents.

Color photosensitive materials are generally constructed by coating sequentially at least one blue sensitive silver halide emulsion layer, at least one green sensitive silver halide emulsion layer and at least on red sensitive silver halide emulsion layer on a support, but the layers may be coated in an order different to that indicated above. Furthermore, an infrared sensitive silver halide emulsion layer can be used instead of at least one of the aforementioned photosensitive emulsion layers. Color reproduction can be achieved with the subtractive color method by including silver halide emulsions which are sensitive to the respective wavelength regions and dyes which are related to the complementary color of the light to which the layers are sensitive in these photosensitive emulsion layers. However, the structure may take a form which does not have the above mentioned correspondence between the photosensitive layers and the hues formed by the couplers.

At least one pyrazoloazole type dye forming coupler of the present invention, at least one compound which can be represented by general formula (A) and at least one compound which can be represented by general formula (B) are included in the same layer, and this is preferably one of the above mentioned photosensitive silver halide layers, and most desirably the green sensitive silver halide emulsion layer.

The present invention can be applied, for example, to color papers, color reversal papers, direct positive color photosensitive materials, color negative films, color positive films and color reversal films. From among these materials, the invention is preferably applied to the color photosensitive materials which have a reflective support (for example, color papers, color reversal papers), and color photosensitive materials with which a positive image is formed (for example, direct positive color photosensitive materials, color positive films, color reversal films), and it is most desirably applied to color photosensitive materials which have a reflective support.

The silver halide emulsions which are used in the present invention may have any halogen composition, being comprised, for example, of silver iodobromide, silver iodochlorobromide, silver bromide, silver chlorobromide or silver chloride.

The halogen composition in the emulsion may differ from grain to grain or it may be uniform, but the nature of the grains can easily be made homogeneous when emulsions which have a halogen composition which is the same from grain to grain are used. Furthermore, the halogen composition distribution within the grains of the silver halide emulsion may be such that the grains have a so-called uniform structure in which the composition is the same in all parts of the silver halide grain, or it may be such that the grains have a so-called laminated structure in which the core inside the silver halide grains has a different halogen composition from the shell (a single layer or a plurality of layers) which surrounds the core, or it may be such that the grains are of a structure which has parts which have a different halogen composition which are not in the form of a layer within the grains or at the grain surface (when present at the grain surface, the structure is such that the parts which have a different composition are joined onto the edges or corners of the grains, or onto the surfaces of the grain) for example, and grains which have any such halogen composition distribution can be selected appropriately for use. The use of either of the latter two types of grain structure is preferable to the use of grains which have a uniform halogen composition for obtaining higher photographic speeds, and it is also preferred from the viewpoint of controlling the occurrence of pressure fogging. In those cases where the silver halide grains have a structure as described above, the boundaries between the parts which have different halogen compositions may be distinct boundaries, or there may be an indistinct boundary with the formation of mixed crystals due to the difference in composition, or there may be a positive continuous variation in the structure.

The preferred halogen composition differs according to the type of photosensitive material in which it is being used, and silver chlorobromide emulsions are used mainly for color papers, silver iodobromides are used mainly for camera photosensitive materials such as color negative films, and silver bromide and silver chlorobromide emulsions are used for direct positive color photosensitive materials. Furthermore, the use of so-called high silver chloride emulsions which have a high silver chloride content is preferred for photosensitive materials for color paper purposes which are suitable for rapid processing. The silver chloride content of a high silver chloride emulsion is preferably at least 90 mol %, and most desirably at least 95 mol %.

A structure which has a silver bromide local phase in the form of a layer or in some other form, as described above, within and/or at the surface of the silver halide grain is desirable for these high silver chloride emulsions. The halogen composition of the above mentioned local phase preferably has a silver bromide content of at least 10 mol %, and most desirably it has a silver bromide content in excess of 20 mol %. This local phase can be present within the grain, or at the edges and corners of the grain surface, or on the surface of the grain, and in a preferred embodiment the local phase is grown epitaxially on the corners of the grain.

The use of essentially silver iodide free silver chlorobromide or silver chloride is preferred in the present invention. Here, the term "essentially silver iodide free" signifies that the silver iodide content is not more than 1 mol %, and preferably not more than 0.2 mol %.

The average grain size (where the grain size is taken to be the diameter of a circle which has an area equal to the projected area of the grain and the average grain size is taken to be the average of these values) of the silver halide grains which are included in the silver halide emulsions which are used in the present invention is preferably from 0.1 μm to 2 μm, and most desirably from 0.15 μm to 1.5 μm. Furthermore, the grain size distribution is preferably that of a so-called mono-dispersion of which the variation coefficient (the value obtained on dividing the standard deviation of the grain size distribution by the average grain size) is not more than 20%, and preferably not more than 15%. The above mentioned mono-disperse emulsions are preferably blended and coated in the same layer, or coated in a form of laminated layers, in order to achieve a wide applicating latitude.

The form of the silver halide grains which are included in the emulsion may be a regular crystalline form such as a cubic from, tetradecahedral form or an octahedral form, an irregular crystalline form such as a spherical or plate-like form, or a form which is a composite of such crystalline forms. Furthermore, the grains may be tabular grains.

The silver halide emulsions which can be used in the present invention may be so-called surface latent image type emulsions with which the latent image is formed principally on the grain surface, or so-called internal latent image type with which the latent image is formed principally within the grains.

The silver halide photographic emulsions which can be used in the present invention can be prepared, for example, using the methods disclosed in *Research Disclosure* (RD) No. 17643 (December, 1978) pages 22–23, "I. Emulsion Preparation and Types", and *Research Disclosure* No. 18716 (November 1979) page 648, by P. Glafkides in *Chimie et Physique Photographique*, published by Paul Montel, 1967, by G. F. Duffin in *Photographic Emulsion Chemistry*, published by Focal Press, 1966, and by V. L. Zelikmann et al. in *Making and Coating Photographic Emulsions*, published by Focal Press, 1964.

The mono-dispersions disclosed, for example, in U.S. Pat. Nos. 3,574,628 and 3,655,394, and British Patent 1,413,748 are also desirable.

Furthermore, tabular grains which have an aspect ratio of at least about 5 can be used in the invention. Tabular grains can be prepared easily using the methods described, for example, by Gutoff in *Photographic Science and Engineering*, Volume 14, pages 248–257 (1970), and in U.S. Pat. Nos. 4,434,226, 4,414,310, 4,433,048 and 4,439,520, and British Patent 2,112,157.

The crystal structure may be uniform, or the interior and exterior parts of the grains may have different halogen compositions, or the grains may have a layer-like structure and, moreover, silver halides which have different compositions may be joined with an epitaxial junction or they may be joined with compounds other than silver halides, such as silver thiocyanate or lead oxide, for example. Furthermore, mixtures of grains which have various crystalline forms can be used.

The silver halide emulsions which are used in the present invention have generally been subjected to physical ripening, chemical ripening and spectral sensitization.

Various poly-valent metal ion impurities can be introduced into the silver halide emulsions which are used in the present invention during the course of emulsion grain formation or physical ripening. Examples of compounds which can be used, for example, include salts of cadmium, zinc, lead, copper and thallium for example, and salts and complex salts of iron, ruthenium, rhodium, palladium, osmium, iridium and platinum which are group VIII elements in the Periodic Table.

Additives which can be used in the physical ripening, chemical ripening and spectral sensitization processes of the silver halide emulsions which can be used in the present invention have been disclosed in *Research Disclosure* No. 17643 and ibid No. 18716, and the locations of these disclosures are summarized in the table below. Known photographically useful additives which can be used in the present invention are also disclosed in the two *Research Disclosures* referred to above, and the locations of these disclosures are also indicated in the table below.

| Type of Additive | RD 17643 | RD 18716 |
|---|---|---|
| 1. Chemical sensitizers | Page 23 | Page 648, right col. |
| 2. Speed increasing agents | | As above |
| 3. Spectral sensitizers and super-sensitizers | Pages 23–24 | Pages 648 right col. to 649 right col. |
| 4. Whiteners | Page 24 | |
| 5. Anti-foggants and stabilizers | Pages 24–25 | Page 649, right col. |
| 6. Light absorbers, filter dyes and UV absorbers | Pages 25–26 | Pages 649, right col. to 650, left col. |
| 7. Anti-staining agents | Page 25, right col. | Page 650, left - right cols. |
| 8. Dye image stabilizers | Page 25 | |
| 9. Film hardening agents | Page 26 | Page 651, left col. |
| 10. Binders | Page 26 | As above |
| 11. Plasticizers, lubricants | Page 27 | Page 650, right col. |
| 12. Coating promotors, surfactants | Pages 26–27 | Page 650, right col. |
| 13. Anti-static agents | Page 27 | As above |

Furthermore, the addition of the compounds which can react with and fix formaldehyde disclosed in U.S. Pat. Nos. 4,411,987 and 4,435,503 to the photosensitive material is desirable for preventing the deterioration of photographic performance due to formaldehyde gas.

Various color couplers can be used conjointly in those cases where the photosensitive material of the present invention is a color photosensitive material, and actual examples have been disclosed in the patents cited in the aforementioned *Research Disclosure* (RD) No. 17643, sections VII-C - G.

The preferred cyan couplers and yellow couplers which can be used conjointly in the present invention can be represented by the general formulae (C-I), (C-II) and (Y) indicated below.

General Formula (C-I)

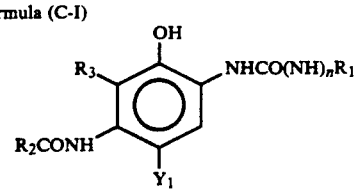

General Formula (C-II)

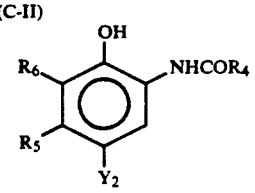

-continued

General Formula (Y)

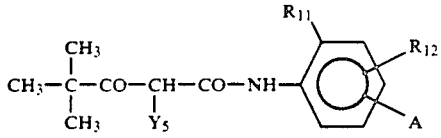

In general formulae (C-I) and (C-II), $R_1$, $R_2$ and $R_4$ represent substituted or unsubstituted aliphatic, L aromatic, or heterocyclic groups, $R_3$, $R_5$ and $R_6$ represent hydrogen atoms, halogen atoms, aliphatic groups, aromatic groups or acylamino groups, and $R_3$ may represent a group of non-metal atoms which, together with $R_2$, forms a five or six membered nitrogen containing ring. $Y_1$ and Y2 represent hydrogen atoms or groups which can be eliminated during a coupling reaction with an oxidized product of a developing agent. Moreover, n represents 0 or 1.

An aliphatic group, for example a methyl, ethyl, propyl, butyl, pentadecyl, tert-butyl, cyclohexyl, cyclohexylmethyl, phenylthiomethyl, dodecyloxy-phenylthiomethyl, butanamidomethyl or methoxymethyl group, is preferred for $R_5$.

$R_1$ is preferably an aryl group or a heterocyclic group, and aryl groups which are substituted with halogen atoms, alkyl groups, alkoxy groups, aryloxy groups, acylamino groups, acyl groups, carbamoyl groups, sulfonamido groups, sulfamoyl groups, sulfonyl groups, sulfamido groups, oxycarbonyl groups and cyano groups are especially desirable.

In those cases where $R_3$ and $R_2$ do not form a ring, $R_2$ is preferably a substituted or unsubstituted alkyl group or aryl group, and most desirably a substituted aryloxy substituted alkyl group, and $R_3$ is preferably a hydrogen atom.

$R_4$ is preferably a substituted or unsubstituted alkyl group or aryl group, and most desirably it is a substituted aryloxy substituted alkyl group.

$R_5$ is preferably an alkyl group which has from 2 to 15 carbon atoms or a methyl group which has a substituent group which has at least 1 carbon atom, and the preferred substituent groups are arylthio groups, alkylthio groups, acylamino groups, aryloxy groups and alkyloxy groups.

$R_5$ is most desirably an alkyl group which has from 2 to 15 carbon atoms, and alkyl groups which have from 2 to 4 carbon atoms are especially desirable.

$R_6$ is preferably a hydrogen atom or a halogen atom, and most desirably it is a chlorine atom or a fluorine atom. $Y_1$ and $Y_2$ each preferably represents a hydrogen atom, a halogen atom, an alkoxy group, an aryloxy group, an acyloxy group or a sulfonamido group.

In general formula (Y), $R_{11}$ represents a halogen atom, an alkoxy group, a trifluoromethyl group or an aryl group, and $R_{12}$ represents a hydrogen atom, a halogen atom or an alkoxy group. A represents $-NHCOR_{13}$, $-NHSO_2-R_{13}$, $-SO_2NHR_{13}$, $-COOR_{13}$ or $$-SO_2\underset{\underset{R_{14}}{|}}{N}-R_{13},$$

where $R_{13}$ and $R_{14}$ each represent an alkyl group, an aryl group or an acyl group. $Y_5$ represents a leaving group. The substituent groups for $R_{12}$, and for $R_{13}$ and $R_{14}$, are the same as those permitted for $R_1$, and the leaving group $Y_5$ is preferably a group of the type with which elimination occurs at an oxygen atom or nitrogen atom, and it is most desirably of the nitrogen atom elimination type.

Actual examples of couplers which can be represented by general formulae (C-I), (C-II) and (Y) are indicated below.

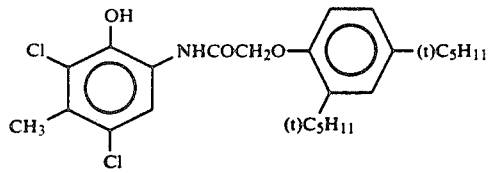

(C-1)

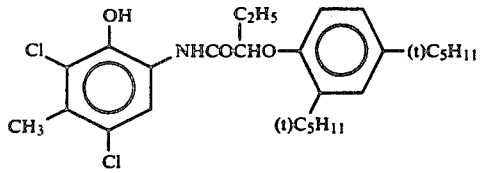

(C-2)

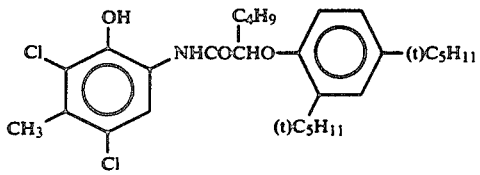

(C-3)

-continued
(C-4)
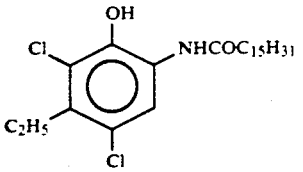
(C-5)
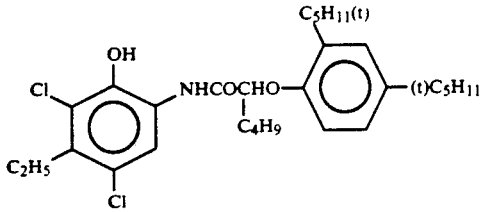
(C-6)
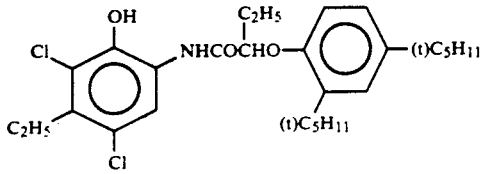
(C-7)
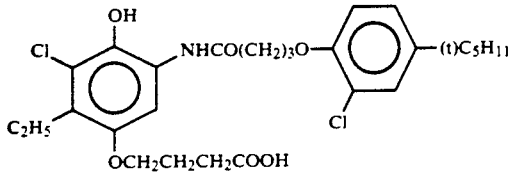
(C-8)
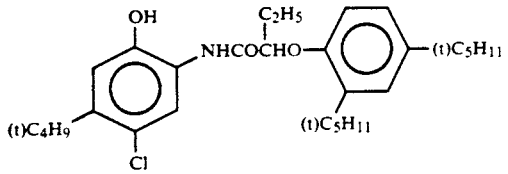
(C-9)
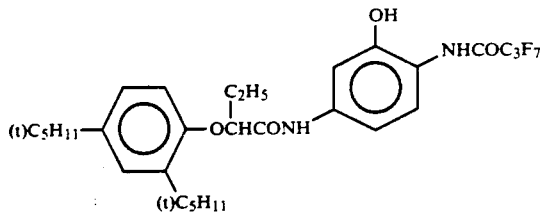
(C-10)
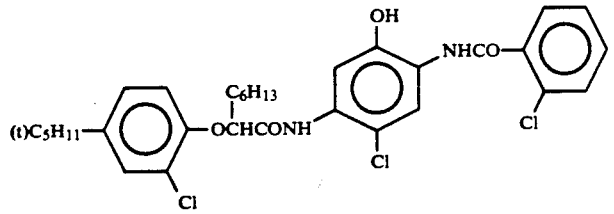
(C-11)
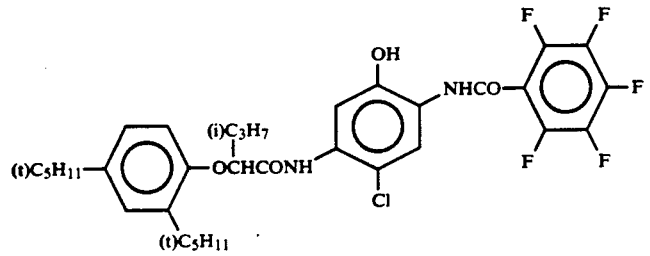

-continued
(C-12)
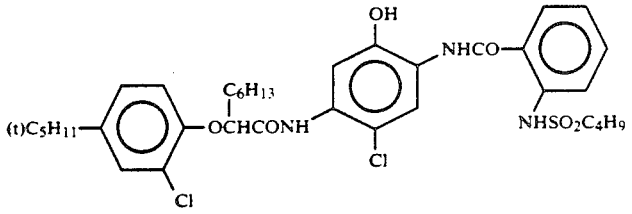
(C-13)
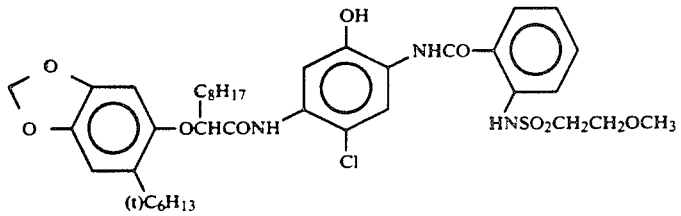
(C-14)
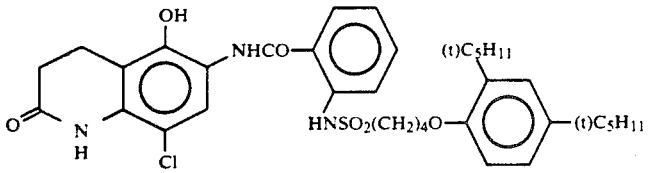
(C-15)
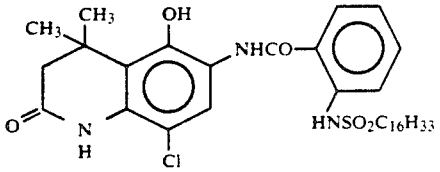
(C-16)
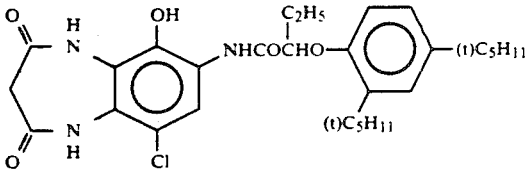
(C-17)
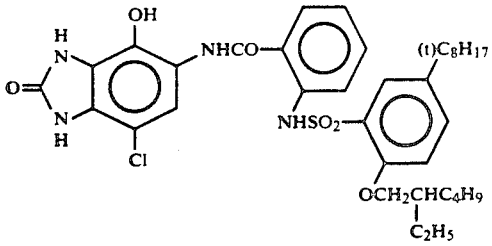
(C-18)
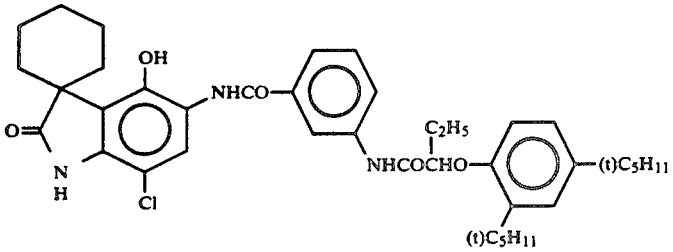

-continued
(C-19)
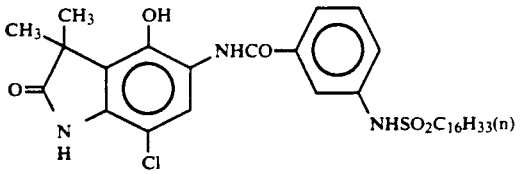
(C-20)
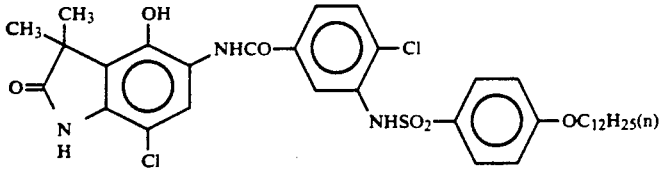
(C-21)
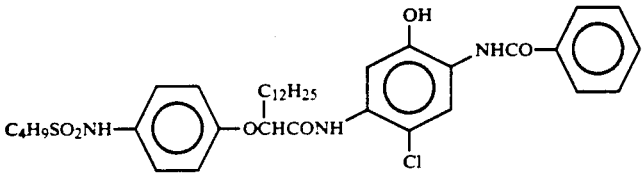
(C-22)
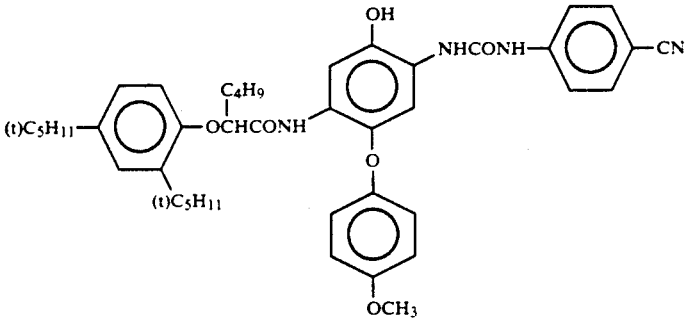
(Y-1)
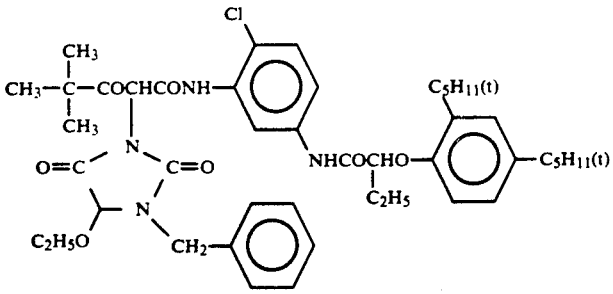
(Y-2)
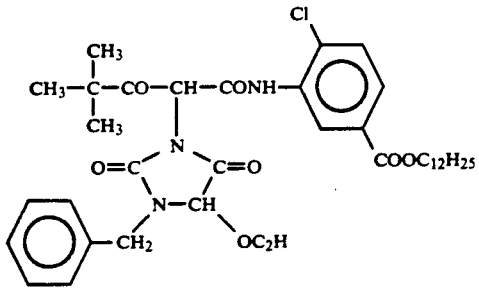

-continued
(Y-3)
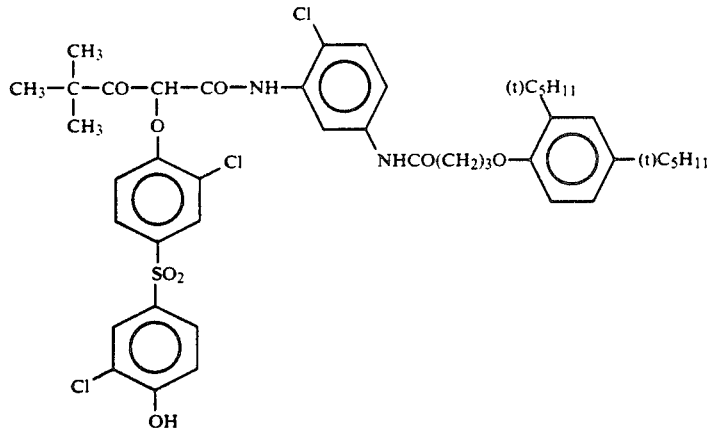
(Y-4)
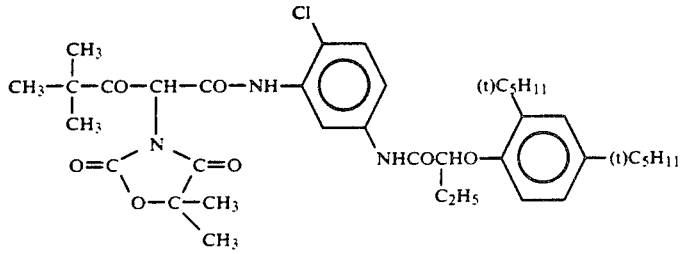
(Y-5)
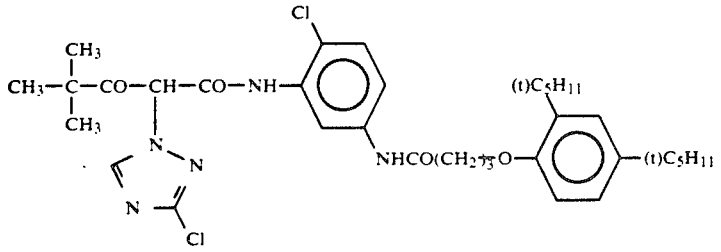
(Y-6)
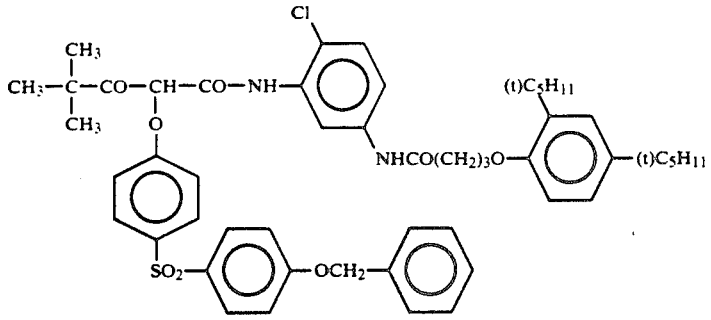
(Y-7)
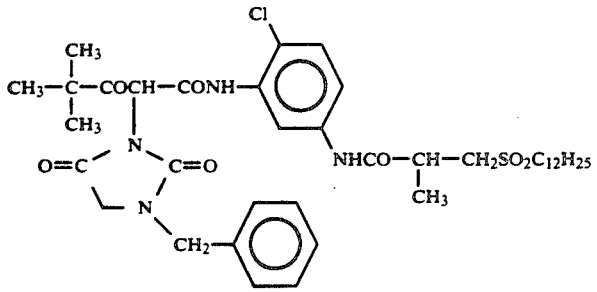

-continued
(Y-8)
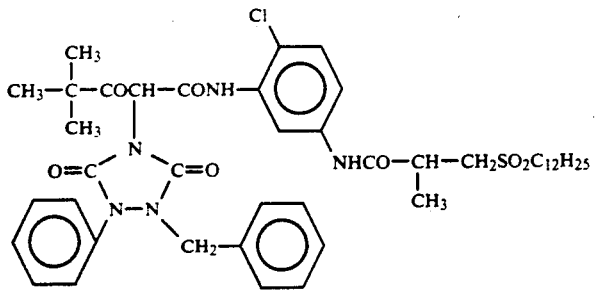
(Y-9)
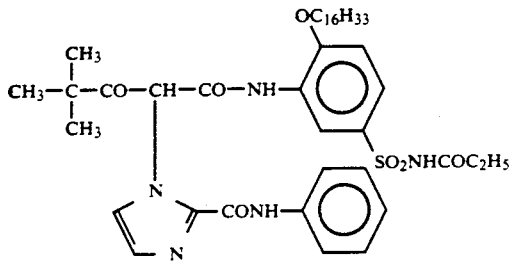
(Y-10)
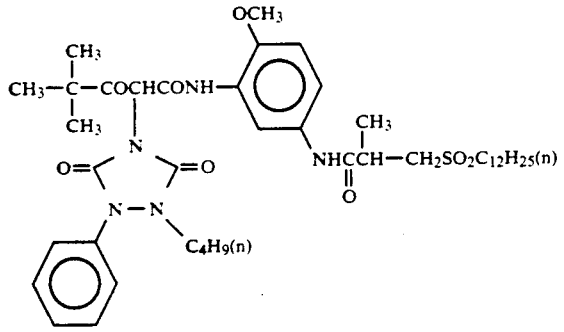
(Y-11)
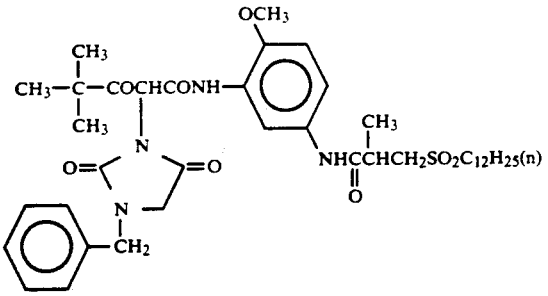
(Y-12)
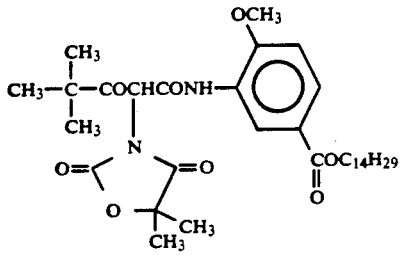

-continued (Y-13)

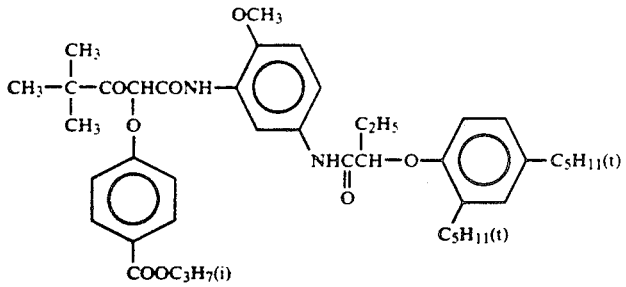

Colored couplers for correcting the unwanted absorptions of the colored dyes can be used, and those disclosed, for example, in section VII-G of *Research Disclosure* No. 17643, U.S. Pat. No. 4,163,670, JP-B-57-39413, U.S. Pat. Nos. 4,004,929 and 4,138,258, and British Patent 1,146,368 are preferred. Furthermore, the use of couplers which correct the unwanted absorption of colored dyes by means of fluorescent dyes which are released on coupling as disclosed in U.S. Pat. No. 4,774,181, and couplers which have, as leaving groups, dye precursor groups which can form dyes on reaction with the developing agent disclosed in U.S. Pat. No. 4,777,120 is also desirable.

The couplers disclosed in U.S. Pat. No. 4,366,237, British Patent 2,125,570, European Patent 96,570 and West German Patent (Laid Open) 3,234,533 are preferred as couplers of which the colored dyes have a suitable degree of diffusibility.

Typical examples of polymerized dye forming couplers have been disclosed, for example, in U.S. Pat. Nos. 3,451,820, 4,080,211, 4,367,282, 4,409,320 and 4,576,910, and British Patent 2,102,173.

Couplers which release photographically useful groups on coupling can be used in the present invention. The DIR couplers which release development inhibitors disclosed in the patents cited in section VII-F of the aforementioned *Research Disclosure* 17643, JP-A-57-151944, JP-A-57-154234, JP-A-60-184248, JP-A-63-37346 and U.S. Pat. Nos. 4,248,962 and 4,782,012 are preferred.

The couplers disclosed in British Patents 2,097,140 and 2,131,188, JP-A-59-157638 and JP-A-59-170840 are preferred as couplers which release nucleating agents or development accelerators in the form of the image during development.

Other compounds which can be used in photosensitive materials of the present invention include the competitive couplers disclosed, for example, in U.S. Pat. No. 4,130,427, the multi-equivalent couplers disclosed, for example, in U.S. Pat. Nos. 4,283,472, 4,338,393 and 4,310,618, the DIR redox compound releasing couplers, DIR coupler releasing couplers, DIR coupler releasing redox compounds or DIR redox releasing redox compounds disclosed, for example, in JP-A-60-185950 and JP-A-62-24252, the couplers which release dyes of which the color is restored after elimination disclosed in European Patent 173,302A, the bleach accelerator releasing couplers disclosed, for example, in *Research Disclosure* No. 11449, ibid No. 24241 and JP-A-61-201247, the ligand releasing couplers disclosed, for example, in U.S. Pat. No. 4,553,477, the leuco dye releasing couplers disclosed in JP-A-63-75747, and the couplers which release fluorescent dyes disclosed in U.S. Pat. No. 4,774,181.

The known methods of dispersion described earlier can be used with these couplers which are used in combination.

The standard amount of color coupler which can be used simultaneously in the present invention is from 0.001 to 1 mol per mol of photosensitive silver halide, and the yellow coupler is preferably added in an amount of from 0.01 to 0.5 mol per mol of photosensitive silver halide and the cyan coupler is preferably added in an amount of from 0.002 to 0.3 mol per mol of photosensitive silver halide.

Photosensitive materials of the present invention may contain, for example hydroquinone derivatives, aminophenol derivatives, gallic acid derivatives and ascorbic acid derivatives as anti-color fogging agents.

Various anti-color fading agents can be used conjointly within the range where they have no adverse effect on the effect of the invention in the photosensitive materials of the present invention. That is to say, hydroquinones, 6-hydroxychromans, 5-hydroxycoumarans, hydroxycoumarans, spirochromans, p-alkoxyphenols, hindered phenols centering on bisphenols, gallic acid derivatives, methylenedioxybenzenes, aminophenols, hindered amines, and ether and ester derivatives in which phenolic hydroxyl groups of these compounds have been silylated or alkylated are typical organic antifading agents which can be used for cyan, magenta and/or yellow images. Furthermore, metal complexes as typified by (bis-salicylaldoximato) nickel and (bis-N,N-dialkyldithiocarbamato) nickel complexes for example can also be used for this purpose.

Actual examples of organic anti-color fading agents include the hydroquinones disclosed, for example, in U.S. Pat. Nos. 2,360,290, 2,418,613, 2,700,453, 2,701,197, 2,728,659, 2,732,300, 2,735,765, 3,982,944 and 4,430,425, British Patent 1,363,921 and U.S. Pat. Nos. 2,710,801 and 2,816,028, the 6-hydroxychromans, 5-hydroxycoumarans and spirochromans disclosed, for example, in U.S. Pat. Nos. 3,432,300, 3,573,050, 3,574,627, 3,698,909 and 3,764,337, and JP-A-52-152225, the spiroindanes disclosed in U.S. Pat. No. 4,360,589, the p-alkoxyphenols disclosed, for example, in U.S. Pat. No. 2,735,765, British Patent 2,066,975, JP-A-59-10539 and JP-B-57-19765, the hindered phenols disclosed, for example, in U.S. Pat. Nos. 3,700,455 and 4,228,235, JP-A-52-72224 and JP-B-52-6623, the gallic acid derivatives disclosed in U.S. Pat. No. 3,457,079, the methylenedioxybenzenes disclosed in U.S. Pat. No. 4,332,886, the aminophenols disclosed in JP-B-56-21144, the hindered amines disclosed, for example, in U.S. Pat. Nos. 3,336,135 and 4,268,593, British Patents 1,326,889, 1,354,313 and 1,410,846, JP-B-51-1420, JP-A-58-114036, JP-A-59-53846 and JP-A-59-78344, and the metal complexes disclosed, for example, U.S. Pat. Nos.

4,050,938 and 4,241,155, and British Patent 2,027,731(A). The objective can be realized by adding these compounds to the photosensitive layer after co-emulsification with the corresponding color coupler, generally in an amount of from 5 to 100 wt % with respect to the coupler.

The inclusion of ultraviolet absorbers in the cyan color forming layer and in the layers on both sides adjacent thereto is effective for preventing deterioration of the cyan dye image due to heat and, more especially, due to light.

For example, benzotriazole compounds substituted with aryl groups (for example, those disclosed in U.S. Pat. No. 3,533,794), 4-thiazolidone compounds (for example, those disclosed in U.S Pat. Nos. 3,314,794 and 3,352,681), benzophenone compounds (for example, those disclosed in JP-A-46-2784), cinnamic acid ester compounds (for example, those disclosed in U.S. Pat. Nos. 3,705,805 and 3,707,395), butadiene compounds (for example, those disclosed in U.S. Pat. No. 4,045,229), or benzoxazole compounds (for example, those disclosed in U.S. Pat. Nos. 3,406,070 and 4,271,307) can be used as ultraviolet absorbers. Ultraviolet absorbing couplers (for example, α-naphthol based cyan dye forming couplers) and ultraviolet absorbing polymers, for example, can also be used for this purpose These ultraviolet absorbers may be mordanted in a specified later.

From among these compounds, the aforementioned benzotriazole compounds which have been substituted with aryl groups are preferred.

The use of gelatin as the binding agent or protective colloid which is used in the emulsion layers of a photosensitive material of the present invention is convenient, but other hydrophilic colloids, either alone or in conjunction with gelatin, can be used for this purpose.

The gelatin in the present invention may be a lime treated gelatin, or it may be a gelatin which has been treated using acids. Details of the preparation of gelatins have been disclosed by Arthur Weise in *The Macromolecular Chemistry of Gelatin* (published by Academic Press, 1964).

The addition of various fungicides and biocides such as the 1,2-benzisothiazolin-3-one, n-butyl p-hydroxybenzoate, phenol, 4-chloro-3,5-dimethylphenol, 2-phenoxyethanol and 2-(4-thiazolyl)benzimidazole for example disclosed in JP-A-63-257747, JP-A-62-272248 and JP-A-1-80941 to a photosensitive material of the present invention is desirable.

The transparent films such as cellulose nitrate films and poly(ethylene terephthalate) films and the reflective supports which are generally used in photographic materials can be used as the supports which are used in the present invention. The use of a reflective support is preferred in view of the aims of the invention.

The "reflective supports" which can be preferably used in the present invention have a high reflectivity and are such that the dye image which is formed in the silver halide emulsion layer is bright, and supports which have been covered with a hydrophobic resin which contains a dispersion of light reflecting material, such as titanium oxide, zinc oxide, calcium carbonate or calcium sulfate, and supports comprising a hydrophobic resin which contains a dispersion of a light reflecting substance, are included among such reflective supports. For example, use can be made of baryta paper, polyethylene coated paper, polypropylene based synthetic paper and transparent supports (for example glass plates, polyester films such as poly(ethylene terephthalate), cellulose triacetate or cellulose nitrate films, polyamide films, polycarbonate films, polystyrene films and poly(vinyl chloride) resins) on which a reflecting layer has been established or in which a reflective substance has been used conjointly.

Photosensitive materials according to the present invention can be developed and processed using the general methods disclosed in the aforementioned *Research Disclosure* No. 17643, pages 28–29, and in *Research Disclosure*, No. 18716, left hand - right hand columns on page 615. For example, they can be subjected to a color development process, a de-silvering process and a water washing process. In the de-silvering process, a bleach-fix process in which a bleach-fixer is used can be carried out instead of a bleaching process in which a bleach is used and a fixing process in which a fixer is used, and a combination of bleaching process, fixing process and bleach-fixing process in any order can be used. A stabilization process may be carried out in place of the water washing process, or a stabilization process can be carried out after a water washing process. Furthermore, mono-bath processing in which a single bath development, bleaching and fixing processing liquid is used can be carried out for achieving color development, bleaching and fixing with a single bath. Film pre-hardening processes, neutralization processes, stop fixing processes, film post-hardening processes, conditioning processes and intensification processes, for example, may be established in combination with these processes. Intermediate water washing processes may also be established optionally between the aforementioned processes. A so-called activator process can also be used in place of the color development process in these processing operations.

The color developer which is used in the development processing of a photosensitive material of the present invention is preferably an aqueous alkaline solution which contains a primary aromatic amine based color developing agent as the principal component. Aminophenol based compounds are also useful as color developing agents, but the use of p-phenylenediamine based compounds is preferred, and typical examples include 3-methyl-4-amino-N,N-diethylaniline, 3-methyl-4-amino-N-ethyl-N-8-hydroxyethylaniline, 3-methyl-4-amino-N-ethyl-N-8-methanesulfonamidoethylaniline, 3-methyl-4-amino-N-ethyl-β-methoxyethylaniline, and the sulfate, hydrochloride and p-toluenesulfonate salts of these compounds. Two or more of these compounds can be used conjointly, according to the intended purpose.

The color developer generally contains pH buffers such as alkali metal carbonates, borates or phosphates, and development inhibitors or anti-foggants such as chlorides, bromides, iodides, benzimidazoles, benzothiazoles or mercapto compounds. They may also contain, as required, various preservatives such as hydroxylamine, diethylhydroxylamine, sulfite, hydrazines such as N,N-biscarboxymethylhydrazine, phenylsemicarbazides, triethanolamine and catecholsulfonic acids, organic solvents such as ethylene glycol and diethylene glycol, development accelerators such as benzyl alcohol, polyethylene glycol, quaternary ammonium salts and amines, dye forming couplers, competitive couplers, auxiliary developing agents such as 1-phenyl-3-pyrazolidone, nucleating agents such as sodium borohydride and hydrazine based compounds, thickeners, and various chelating agents as typified by the aminopolycarboxylic acids, aminopolyphosphonic acids, alkylphosphonic acids and phosphonocarboxylic acids (for example, ethylenediamine tetra-acetic acid, nitrilo triacetic acid, diethylenetriamine penta-acetic acid, cyclohexanediamine tetra-acetic acid, hydroxyethylimino diacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid) and salts thereof), fluorescent whiteners such as the 4,4'-diamino-2,2'-disulfostilbene based compounds and various surfactants such as alkylsulfonic acid, arylsulfonic acid, aliphatic carboxylic acid or aromatic sulfonic acid. The pH of the color developer is generally from 9 to 12.

Furthermore, a black and white development process, a water washing or rinse process, a reversal process and a color development process are generally carried out in a color reversal development process. A reversal bath which contains a fogging agent or a light reversal process can be used for the reversal process. Furthermore, the above mentioned fogging agent may be included in the color developer and the reversal processing operation can then be omitted.

The black-and-white developers which are used in the black and white processing are those used to process the generally known black-and-white photographic materials, and various additives which can generally be added to black and white developers can be included.

Typical additives include developing agents such as 1-phenyl-3-pyrazolidone, N-methyl-p-aminophenol and hydroquinone, preservatives such as sulfite, pH buffers comprised of water soluble acids such a boric acid, pH buffers or development accelerators comprised of alkalies such as sodium hydroxide, sodium carbonate and potassium carbonate, inorganic or organic development inhibitors such as potassium bromide and methylbenzotriazole and methylbenzthiazole, hard water softening agents such as ethylenediamine tetra-acetic acid and polyphosphoric acid, antioxidants such as ascorbic acid and diethanolamine, organic solvents such as triethyleneglycol and cellosolve, and anti-surface superdeveloping agents such as trace amounts of iodide and mercapto compounds, for example.

The replenishment rate of these developers depends on the color photographic material which is being processed, but it is generally not more than 3 liters per square meter of photosensitive material, and it can be set below 500 ml per square meter of photographic material by reducing the bromide ion concentration in the replenisher. The prevention of evaporation and aerial oxidation of the liquid by reducing the area of contact with the air in the processing tank is desirable in those cases where the replenishment rate has been reduced.

As well as the establishment of a shielding device such as a floating lid on the surface of the photographic processing liquid in the processing tank, a movable lid as disclosed in JP-A-1-82033 and the method of slit development processing disclosed in JP-A-63-216050 can be used as means of minimizing the area of contact with the air in a processing tank in this way. These techniques are preferably applied not only to the color development and black and white development processes but also to all the subsequent processes such as the bleaching, bleach-fixing, fixing, water washing and stabilization processes. Furthermore, the replenishment rate can be reduced by the application of some means of suppressing the accumulation of bromide ion in the developer.

The color development processing time is generally set between 2 and 5 minutes, but shorter processing times can be devised by using higher temperatures and pH levels, and by using higher concentrations of the color developing agent.

The color developed photographic emulsion layer is subjected to a de-silvering process. The desilvering process may be such that the bleaching process and the fixing process are carried out separately, or it may be such that these processes are carried out at the same time (bleach-fix process). Moreover, a method of processing in which bleach-fixing is carried out after a bleaching process can be used in order to speed up processing. Furthermore, bleach-fixing can be carried out in two connected baths, a fixing process can be carried out prior to a bleach-fix process, or a bleaching process may be carried out after a bleach-fix process, in accordance with the intended purpose of the processing.

Compounds of multi-valent metals, such as iron(III), cobalt(III), chromium(IV) and copper(II), peracids, quinones, and nitro compounds, for example, can be used as bleaching agents in the bleach and bleach-fix baths. Thus, iron chloride; ferricyanide; dichromates; organic complex salts of iron(III) (for example metal complex salts with aminopolycarboxylic acids such as ethylenediamine tetra-acetic acid, diethylenetriamine penta-acetic acid, cyclohexanediamine tetra-acetic acid, methylimino diacetic acid, 1,3-diaminopropane tetra-acetic acid, glycol ether diamine tetra-acetic acid) persulfates; bromates; permanganates; and nitrobenzenes can be used as typical bleaching agents. From among these materials, the use of the aminopolycarboxylic acid iron(III) complex salts, principally ethylenediamine tetra-acetic acid iron(III) complex salts and 1,3-diaminopropane tetra-acetic acid iron(III) complex salts, is preferred from the points of view of both rapid processing and the prevention of environmental pollution. Moreover, the aminopolycarboxylic acid iron(III) complex salts are especially useful in both bleach baths and bleach-fix baths. The bleach baths and bleach-fix baths in which these aminopolycarboxylic acid iron(III) complex salts are generally used at pH from 3.0 to 8.

Known additives including re-halogenating agents such as ammonium bromide and ammonium chloride, pH buffers such as ammonium nitrate, and metal corrosion inhibitors such as ammonium sulfate, for example, can be added to the bleach and bleach-fix baths.

In addition to the compounds mentioned above, the inclusion of organic acids in the bleach and bleach fix baths is desirable for preventing the occurrence of bleach staining. The most desirable organic acids are compounds which have an acid dissociation constant (pKa) value of from 2 to 5.5, and preferred examples of such compounds include acetic acid and propionic acid.

Thiosulfate, thiocyanate, thioether based compounds, thioureas and large amounts of iodide can be used, for example, as the fixing agents which are used in the fixing and bleach-fixing baths, but thiosulfates are normally used, and ammonium thiosulfate is the most desirable. Furthermore, the conjoint use of thiocyanate, thioether based compounds and thiourea, for example, with thiosulfate is also desirable.

Sulfite, bisulfite, carbonyl/bisulfite addition compounds and the sulfinic acid compounds disclosed in European Patent 294,769A are preferred as preservatives for the fixing and bleach-fixing baths. Moreover, the addition of various aminopolycarboxylic acids and organic phosphonic acids (for example, 1-hydroxyethylidene-1,1-diphosphonic acid, N,N,N',N'-ethylenediaminetetraphosphonic acid) to the fixing and bleach-fixing baths is desirable for the stabilization of the bath.

Moreover, various fluorescent whiteners, anti-foaming agents, surfactants, polyvinylpyrrolidone and methanol, for example, can also be included in the fixing and bleach fixing baths.

Bleaching accelerators can be added, as required, to the bleach baths, bleach-fix baths or bleach or bleach-fix pre-baths. Actual examples of useful bleach accelerators include the compounds which have a mercapto group or a disulfide group disclosed, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630 JP-A-53-95631, JP-A-53-104232, JP-A-53-124424, JP-A-53-141623, JP-A-53-28426, and *Research Disclosure* No. 17129 (July 1978); the thiazolidine derivatives disclosed in JP-A-50-140129; the thiourea derivatives disclosed in JP-B-45-8506, JP-A-52-20832, JP-A-53-32735 and U.S. Pat. No. 3,706,561; the iodides disclosed in West German Patent 1,127,715 and JP-A-58-16235; the polyoxyethylene compounds disclosed in West German Patents 966,410 and 2,748,430; the polyamide compounds disclosed in JP-B-45-8836; the other compounds disclosed in JP-A-49-42434, JP-A-49-59644, JP-A-53-94927, JP-A-54-35727, JP-A-55-26506 and JP-A-58-163940; and bromide ion. From among these compounds, those which have a mercapto group or a disulfide group are preferred in view of their large accelerating effect, and the compounds disclosed in U.S. Pat. No. 3,893,858, West German Patent 1,290,812 and JP-A-53-95630 are especially desirable. Moreover, the compounds disclosed in U.S. pat. No. 4,552,834 are also desirable. These bleach accelerators may also be included in a sensitive material. These bleaching accelerators are especially effective when bleach-fixing camera color photosensitive materials.

The total de-silvering process time is preferably short within the range where de-silvering failure does not occur. The preferred time is from 1 to 3 minutes. Furthermore, the processing temperature is from 25° C. to 50° C., and preferably from 35° C. to 45° C.

Agitation as strongly as possible is desirable in the de-silvering process. Actual methods of strong agitation include those in which the processing liquid is forced as a jet onto the emulsion surface of the photosensitive material as disclosed in JP-A-62-183460 and JP-A-62-183461. Such methods of improved agitation are effective in bleach baths, bleach-fix baths and fixing baths.

A color photosensitive material is generally subjected to a water washing process after the desilvering process. A stabilization process may be carried out instead of the water washing process. The known methods disclosed in JP-A-57-8543, JP-A-58-14834 and JP-A-60-220345 can all be used for such a stabilization process. Furthermore, a water washing process stabilization process in which a stabilizing bath which contains dye stabilizing agent and surfactant as typified by the processing of camera color photosensitive materials is used as a final bath can also be employed.

Hard water softening agents such as inorganic phosphoric acid, polyaminocarboxylic acid and organic aminophosphonic acid, metal salts such as Mg salts, Al salts and Bi salts, surfactants and film hardening agents, for example, can be included in the washing water or stabilizer.

The amount of wash water used in the water washing process can be fixed within a wide range, depending on the characteristics (for example, the materials such as couplers used therein) and application of the photosensitive material, the wash water temperature, the number of water washing tanks (the number of water washing stages), the replenishment system, i.e. whether a counter-flow or sequential co-current flow system is used, and various other factors. The relationship between the amount of water used and the number of washing tanks in a multi-stage counter-flow system can be determined using the method outlined on pages 248–253 of the *Journal of the Society of Motion Picture and Television Engineers*, Vol. 64 (May 1955). Furthermore, the method of reducing the calcium ion and magnesium ion concentrations disclosed in JP-A-62-288838 is very effective as a means of resolving the problems such as the proliferation of bacteria which occurs when the amount of wash water is greatly reduced by using a multi-stage counter-flow system, and the attachment of the suspended matter which is produced the photosensitive material. Furthermore, the thiabendazoles and isothiazolone compounds disclosed in JP-A-57-8542, the chlorine based disinfectants such as chlorinated sodium isocyanurate, and benzotriazole, for example, and the disinfectants disclosed in *The Chemistry of Biocides and Fungicides* by Horiguchi (1986), in *Killing Micro-organisms, Biocidal and Fungicidal Techniques* published by the Health and Hygiene Technical Society (1982), and in *A Dictionary of Biocides and Fungicides* published by the Japanese Biocide and Fungicide Society (1986), can also be used.

The pH value of the wash water when processing photosensitive materials of the present invention is from 4 to 9, and preferably from 5 to 8. The washing water temperature and the washing time can be set variously in accordance with the characteristics and application of the photosensitive material but, in general, washing conditions of from 20 seconds to 10 minutes at a temperature of from 15° C. to 45° C., and preferably of from 30 seconds to 5 minutes at a temperature of from 25° C. to 40° C., are selected.

Dye stabilizing agents which can be used in the stabilizer include aldehydes such as formalin and glutaraldehyde, N-methylol compounds, hexamethylenetetramine and aldehyde/bisulfite addition compounds for example. Furthermore, pH controlling buffers such as boric acid and sodium hydroxide, chelating agents such as 1-hydroxyethylidene-1,1-diphosphonic acid and ethylenediamine tetra-acetic acid, agents for preventing the occurrence of sulfiding such as alkanolamine, fluorescent whiteners and fungicides, for example, can also be included in the stabilizer.

The various processing baths in the present invention can be used at a temperature of from 10° C. to 50° C. The standard temperature is generally from 33° C. to 38° C., but development is sometimes accelerated and the processing time is shortened by using higher temperatures and, conversely, an improvement in image quality and an improvement in processing bath stability can be achieved at lower temperatures.

As is clear from the illustrative examples, this present invention provides excellent image stability with various types of silver halide color photographic photosensitive material and it provides in particular a marked improvement in light fastness in the low density regions of the magenta dye image.

The invention is described in practical terms below by means of illustrative examples, but the invention is not limited by these examples.

EXAMPLE 1

A multi-layer color printing paper of which the layer structure is indicated below was prepared on a paper support which had been laminated on both sides with polyethylene. The coating liquids were prepared in the way described below.

Preparation of the First Layer Coating Liquid

Ethyl acetate (27.2 cc) and 4.1 grams of each of the solvents (Solv-3) and (Solv-6) were added to 19.1 gram of yellow coupler (ExY) and 4.4 grams and 1.8 grams of color image stabilizers (Cpd-1) and (Cpd-7) respectively to form a solution which was then emulsified and dispersed in 185 cc of a 10% aqueous gelatin solution which contained 8 cc of 10% sodium dodecylbenzenesulfonate (emulsified dispersion A). On the other hand, a silver chlorobromide emulsion A (a 1:3 (Ag mol ratio) mixture of a large size emulsion A of silver bromide content 80.0 mol %, cubic, average grain size 0.85 μm and variation coefficient 0.08, and a small size emulsion A of silver bromide content 80.0 mol %, cubic, average grain size 0.62 μm, variation coefficient 0.07) was sulfur sensitized and then the blue sensitive sensitizing dye indicated hereinafter was added in an amount of $5.0\times10^{-4}$ mol per mol of silver to prepare an emulsion. This silver chlorobromide emulsion A was mixed with the aforementioned emulsified dispersion A to prepare a first layer coating liquid of which the composition was as shown by the layer structure described hereinafter.

The coating liquids for the second to the seventh layers were prepared using the same procedure as for the first layer coating liquid. Moreover, 1-oxy-3,5-dichloro-s-triazine, sodium salt, was used as a gelatin hardening agent for each layer.

The spectrally sensitizing dyes indicated below were used in the silver chlorobromide emulsions of each photosensitive emulsion layer.

Blue Sensitive Emulsion Layer

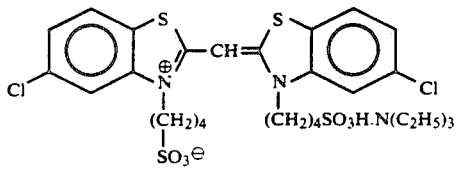

($5.0\times10^{-4}$ mol per mol of silver halide)

Green Sensitive Emulsion Layer

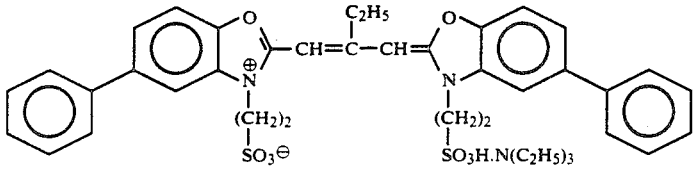

($4.0\times10^{-4}$ mol per mol of silver halide)

and

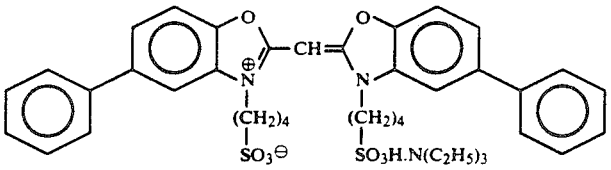

($7.0\times10^{-5}$ mol per mol of silver halide)

Red Sensitive Emulsion Layer

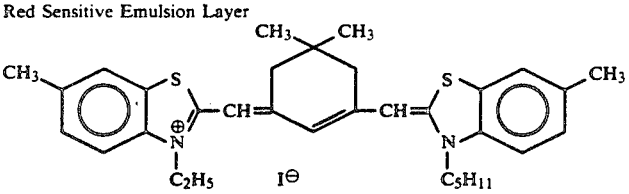

($0.9\times10^{-4}$ mol per mol of silver halide)

The compound indicated below was added in an amount of $2.6\times10^{-3}$ mol per mol of silver halide to the red sensitive emulsion layer in addition to the above mentioned spectrally sensitizing dye.

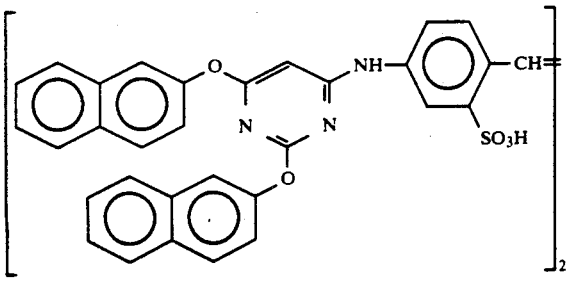

Furthermore, 1-(5-methylureidophenyl)-5-mercaptotetrazole was added to the blue, green and red sensitive emulsion layers in amounts, per mol of silver halide, of $4.0\times10^{-6}$ mol, $3.0\times10^{-5}$ mol and $1.0\times10^{-5}$ mol respectively, and 2-methyl-5-tert-octylhydroquinone was added to the blue, green and red sensitive emulsion layers in amounts, per mol of silver halide, of $8\times10^{-3}$ mol, $2\times10^{-2}$ and $2\times10^{-2}$ mol respectively.

Furthermore, 4-hydroxy-6-methyl-1,3,3a,7-tetraazaindene was added to the blue and green sensitive emulsion layers in amounts, per mol of silver halide, of $1.2\times10^{-2}$ mol and $1.1\times10^{-2}$ mol respectively.

Furthermore, the mercaptoimidazoles indicated below were added in an amount, per mol of silver halide, of $2\times10^{-4}$ mol, and the mercaptothiadiazoles indicated below were added in an amount, per mol of silver halide, of $4\times10^{-4}$ mol, to the red sensitive emulsion layer.

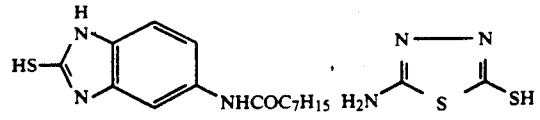

The dyes indicated below were added to the emulsion layers for anti-irradiation purposes.

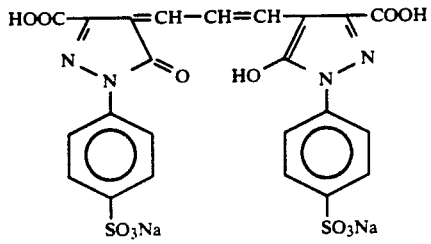

and

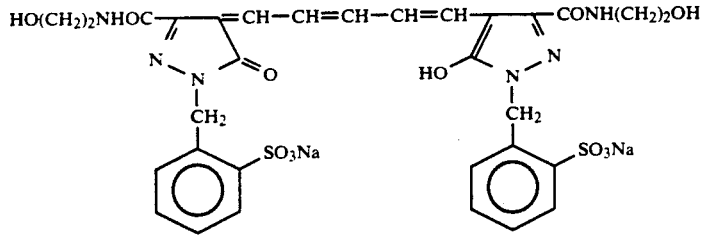

Layer Structure

The composition of each layer was as indicated below. The numerical values indicated coated weights (g/m²). In the case of silver halide emulsions the coated weight is shown as the calculated coated weight of silver.

Support

Polyethylene laminated paper (White pigment ($TiO_2$) and blue dye (ultramarine) included in the polyethylene on the first layer side)

| | |
|---|---|
| First Layer (Blue Sensitive Layer) | |
| The aforementioned silver chlorobromide emulsion A (AgBr: 80 mol %) | 0.26 |
| Gelatin | 1.83 |
| Yellow coupler (ExY) | 0.83 |
| Color image stabilizer (Cpd-1) | 0.19 |
| Color image stabilizer (Cpd-7) | 0.08 |
| Solvent (Solv-3) | 0.18 |
| Solvent (Solv-6) | 0.18 |
| Second Layer (Anti-color Mixing Layer) | |
| Gelatin | 0.99 |
| Anti-color mixing agent (Cpd-5) | 0.08 |
| Solvent (Solv-1) | 0.16 |
| Solvent (Solv-4) | 0.08 |
| Third Layer (Green Sensitive Layer) | |
| Silver chlorobromide emulsion (a 1:1 (silver mol ratio) mixture of a large size emulsion B of AgBr 90 mol %, cubic, average grain size 0.47 μm and variation coefficient 0.12, and a small size emulsion B of AgBr 90 mol %, cubic, average grain size 0.36 μm and variation coefficient 0.09) | 0.16 |
| Gelatin | 1.79 |

-continued

| | |
|---|---|
| Magenta coupler (ExM) | 0.32 |
| Color image stabilizer 1 | — |
| Color image stabilizer (Cpd-3) | 0.20 |
| Color image stabilizer (Cpd-4) | 0.01 |
| Color image stabilizer (Cpd-8) | 0.03 |
| Color image stabilizer (Cpd-9) | 0.04 |
| Solvent (Solv-2) | 0.65 |
| Fourth Layer (Ultraviolet Absorbing Layer) | |
| Gelatin | 1.58 |
| Ultraviolet absorber (UV-1) | 0.47 |
| Anti-color mixing agent (Cpd-5) | 0.05 |
| Solvent (Solv-5) | 0.24 |
| Fifth Layer (Red Sensitive Layer) | |
| Silver chlorobromide emulsion (a 1:2 (silver mol ratio) mixture of a large size emulsion C of AgBr 70 mol %, cubic, average grain size 0.49 μm and variation coefficient 0.08, and a small size emulsion C of AgBr 70 mol %, cubic, average grain size 0.34 μm and variation coefficient 0.10) | 0.23 |
| Gelatin | 1.34 |
| Cyan coupler (ExC) | 0.30 |
| Color image stabilizer (Cpd-6) | 0.17 |
| Color image stabilizer (Cpd-7) | 0.40 |
| Solvent (Solv-6) | 0.20 |
| Sixth Layer (Ultraviolet Absorbing Layer) | |
| Gelatin | 0.53 |
| Ultraviolet absorber (UV-1) | 0.16 |
| Anti-color mixing agent (Cpd-5) | 0.02 |
| Solvent (Solv-5) | 0.08 |
| Seventh Layer (Protective Layer) | |
| Gelatin | 1.33 |
| Acrylic modified poly(vinyl alcohol) copolymer (17% modification) | 0.17 |
| Liquid paraffin | 0.03 |

(Cpd-1) Color Image Stabilizer

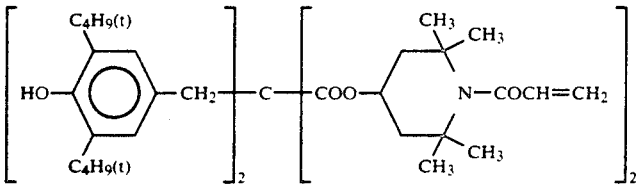

(Cpd-3) Color Image Stabilizer 2

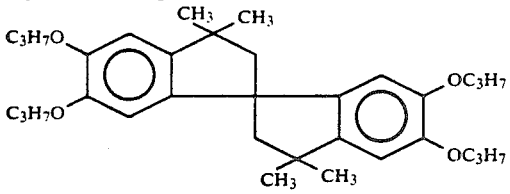

(Cpd-4) Color Image Stabilizer

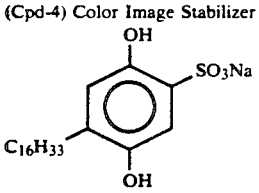

(Cpd-5) Anti-color Mixing Agent

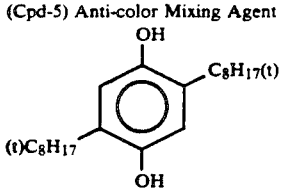

(Cpd-6) Color Image Stabilizer
A 2:4:4 (by weight) mixture of:

-continued
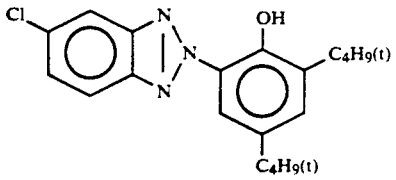
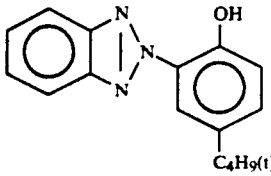
and
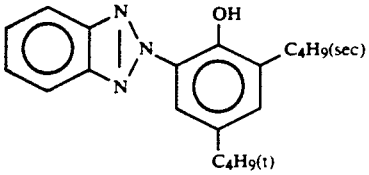
(Cpd-7) Color Image Stabilizer
$$\left(CH_2-\underset{\underset{CONHC_4H_9(t)}{|}}{CH}\right)_n$$
(Average molecular weight 80,000)
(Cpd-8) Color Image Stabilizer
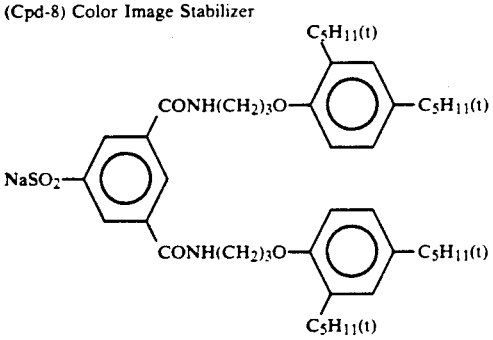
(Cpd-9) Color Image Stabilizer
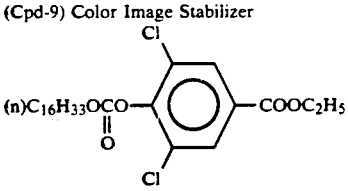
(UV-1) Ultraviolet Absorber
A 4:2:4 (by weight) mixture of:
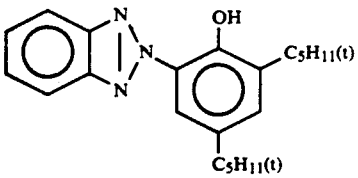
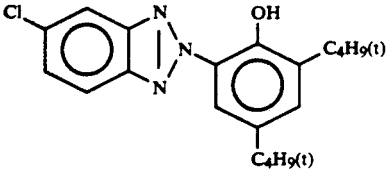
and -continued
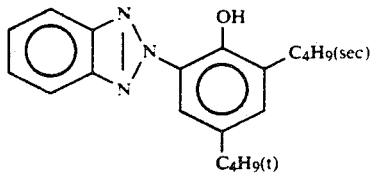
(Solv-1) Solvent
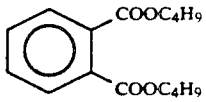
(Solv-2) Solvent 3
A 2:1 (by weight) mixture of
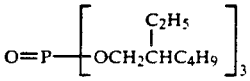
and
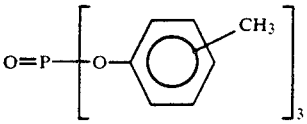
(Solv-3) Solvent 1
$O{=}P{+}O{-}C_9H_{19}(iso)]_3$
(Solv-4) Solvent
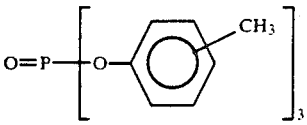
(Solv-5) Solvent
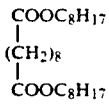
(Solv-6) Solvent 2
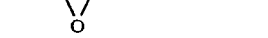
(ExY) Yellow Coupler
A 1:1 (mol) mixture of:
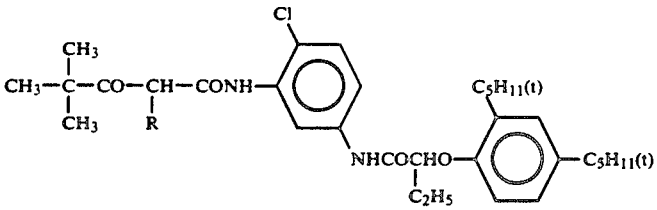
and
where R =
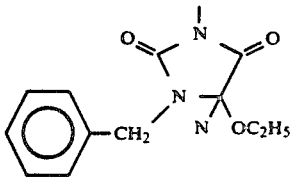
and -continued R = 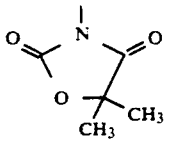

(ExM) Magenta Coupler
A 1:1 (mol ratio) mixture of:

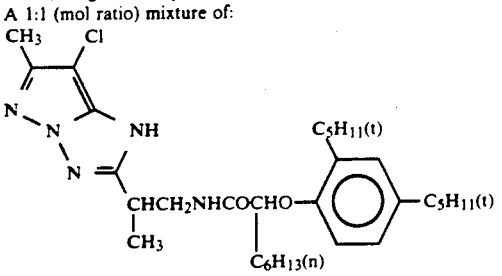

and

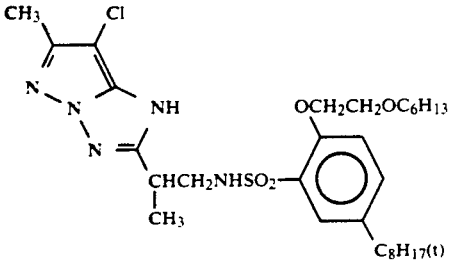

(ExC) Cyan Coupler
A 1:1 (mol ratio) mixture of:

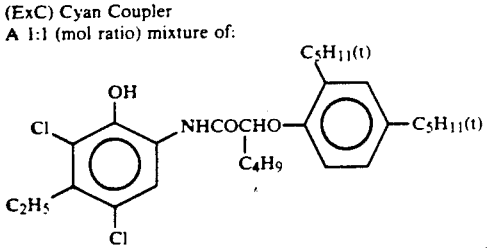

and

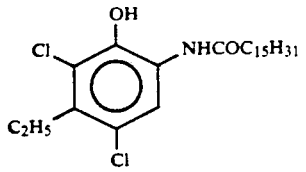

The sample obtained in this way was taken as Sample IA, and other samples 2A-55A were prepared in the same way as sample IA except that the magenta coupler and the color image stabilizer 1 (compound of general formula (A), 50 mol % with respect to the coupler) and the color image stabilizer 2 (compound of general formula (B), 100 mol % with respect to the coupler) in the third layer were combined as shown in Table 1.

Comparative Compound (a)

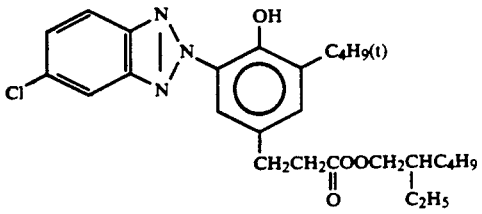

-continued

Compound disclosed in JP-A-61-250644

Comparative Compound (b)

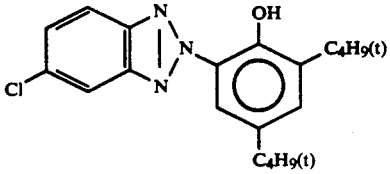

Compound disclosed in JP-A-54-73032

Comparative Compound (c)

-continued

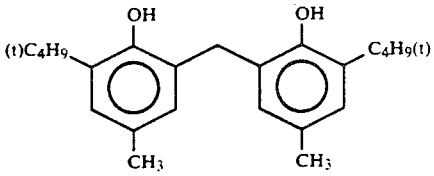

Compound disclosed in JP-B-60-3173, JP-B-60-3174 JP-A-54-70830, JP-A-62-24250 and European Patent 218,266

Comparative Coupler (a)

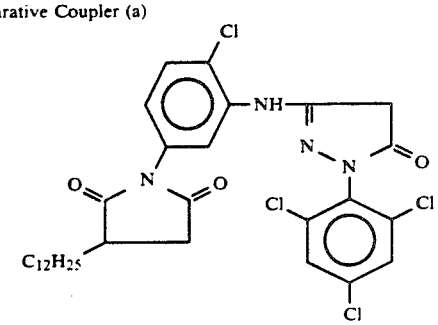

Coupler disclosed in JP-A-54-73032

Comparative Coupler (b)

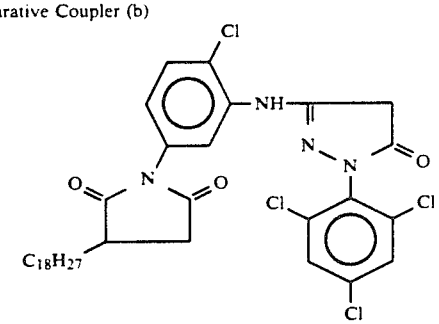

Coupler disclosed in JP-B-60-3173, JP-A-60-3174 and JP-A-54-70830

Comparative Coupler (c)

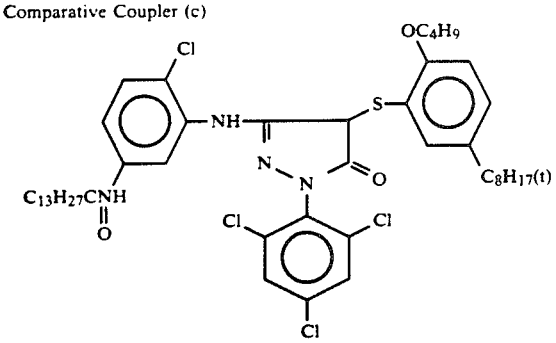

Coupler disclosed in JP-A-62-24250

These samples were subjected to photographic processing as outlined below.

First of all, each sample was subjected to a graded exposure using sensitometric tri-color separation filters in a sensitometer (Model FWH, light source temperature 3200° K., made by the Fuji Photo Film Co., Ltd.). The exposure at this time was carried out in such a way as to provide an exposure of 250 CMS with an exposure time of 0.1 second.

The exposed samples were processed in an automatic processor using the processing operations and processing bath compositions indicated below.

| Processing Operation | Temperature | Time |
|---|---|---|
| Color development | 37° C. | 3 minutes 30 seconds |
| Bleach-fix | 33° C. | 1 minute 30 seconds |
| Water wash | 24–34° C. | 3 minutes |
| Drying | 70–80° C. | 1 minute |

The composition of each processing bath was as indicated below.

| | |
|---|---|
| Color Development Bath | |
| Water | 800 ml |
| Diethylenetriamine penta-acetic acid | 1.0 gram |
| Nitrilotriacetic acid | 2.0 grams |
| Benzyl alcohol | 15 ml |
| Diethyleneglycol | 10 ml |
| Sodium sulfite | 2.0 grams |
| Potassium bromide | 1.0 grams |
| Potassium carbonate | 30 grams |
| N-Ethyl-N-(β-methanesulfonamidoethyl)-3-methyl-4-aminoaniline sulfate | 4.5 grams |
| Hydroxylamine sulfate | 3.0 grams |
| Fluorescent whitener (WHITEX 4B, made by Sumitomo Chemicals) | 1.0 gram |
| Water to make up to | 1000 ml |
| pH (25° C.) | 10.25 |
| Bleach-fix Bath | |
| Water | 400 ml |
| Ammonium thiosulfate (700 g/l) | 150 ml |
| Sodium sulfite | 18 grams |
| Ethylenediamine tetra-acetic acid, iron(III) ammonium salt | 55 grams |
| Ethylenediamine tetra-acetic acid, di-sodium salt | 5 grams |
| Water to make up to | 1000 ml |
| pH (25° C.) | 6.70 |

Color fading tests were carried out using each sample in which a colored image had been formed in this way. The color fading tests involved evaluation of the residual magenta dye at initial densities of 1.0 and 0.5 after an 8 day exposure in a xenon tester (Xe) (luminance 200,000 lux). The measurements were made using a Fuji recording densitometer. The results obtained are shown in Table 1.

TABLE 1

| Sample | Magenta Coupler | Color image Stabilizer 1 | Color image stabilizer 2 | Residual Magenta Density Xe, 8 Days: Initial Density 1.0 | Residual Magenta Density Xe, 8 Days: Initial Density 0.5 | Remarks |
|---|---|---|---|---|---|---|
| 1A | EXM(M-7/M-2) | — | Cpd-3(B-18) | 68% | 47% | Comparative Example |
| 2A | " | — | B-6 | 64 | 44 | Comparative Example |
| 3A | " | — | B-12 | 66 | 43 | Comparative Example |
| 4A | " | — | B-28 | 66 | 45 | Comparative Example |

TABLE 1-continued

| Sample | Magenta Coupler | Color image Stabilizer 1 | Color image stabilizer 2 | Residual Magenta Density Xe. 8 Days Initial Density 1.0 | Initial Density 0.5 | Remarks |
|---|---|---|---|---|---|---|
| 5A | " | — | B-29 | 67 | 45 | Comparative Example |
| 6A | " | — | B-39 | 55 | 33 | Comparative Example |
| 7A | " | A-1 | — | 30 | 23 | Comparative Example |
| 8A | " | A-9 | — | 32 | 23 | Comparative Example |
| 9A | " | A-21 | — | 33 | 25 | Comparative Example |
| 10A | " | A-25 | — | 31 | 21 | Comparative Example |
| 11A | " | A-39 | — | 34 | 23 | Comparative Example |
| 12A | " | A-40 | — | 35 | 27 | Comparative Example |
| 13A | EXM(M-7/M-2) | Comparative Compound (a) | — | 32% | 21% | Comparative Example |
| 14A | " | Comparative Compound (b) | — | 30 | 22 | Comparative Example |
| 15A | " | Comparative Compound (c) | — | 34 | 25 | Comparative Example |
| 16A | " | Comparative Compound (a) | Cpd-3(B-18) | 70 | 49 | Comparative Example |
| 17A | Comparative Coupler (a) | Comparative Compound (b) | B-6 | 52 | 47 | Comparative Example |
| 18A | Comparative Coupler (b) | Comparative Compound (c) | " | 52 | 43 | Comparative Example |
| 19A | Comparative Coupler (b) | Comparative Compound (c) | B-12 | 53 | 44 | Comparative Example |
| 20A | Comparative Coupler (c) | Comparative Compound (c) | Cpd-3(B-18) | 54 | 49 | Comparative Example |
| 21A | Comparative Coupler (d) | — | B-6 | 51 | 45 | Comparative Example |
| 22A | Comparative Coupler (b) | — | " | 52 | 46 | Comparative Example |
| 23A | Comparative Coupler (b) | — | B-12 | 54 | 46 | Comparative Example |
| 24A | Comparative Coupler (c) | — | Cpd-3(B-18) | 56 | 52 | Comparative Example |
| 25A | EXM(M-7/M-2) | Comparative Compound (b) | B-6 | 66% | 43% | Comparative Example |
| 26A | " | Comparative Compound (c) | " | 66 | 44 | Comparative Example |
| 27A | " | Comparative Compound (b) | B-12 | 67 | 46 | Comparative Example |
| 28A | " | Comparative Compound (c) | Cpd-3(B-18) | 66 | 49 | Comparative Example |
| 29A | " | A-1 | " | 78 | 77 | This Invention |
| 30A | " | A-9 | " | 77 | 74 | This Invention |
| 31A | " | A-21 | " | 79 | 78 | This Invention |
| 32A | " | A-25 | " | 80 | 78 | This Invention |
| 33A | " | A-39 | " | 80 | 78 | This Invention |
| 34A | " | A-40 | " | 77 | 79 | This Invention |
| 35A | " | A-1 | B-6 | 72 | 66 | This Invention |
| 36A | " | A-25 | " | 70 | 63 | This Invention |
| 37A | " | A-40 | " | 74 | 66 | This Invention |
| 38A | EXM(M-7/M-2) | A-1 | B-12 | 80% | 78% | This Invention |
| 39A | " | A-9 | " | 77 | 76 | This Invention |
| 40A | " | A-21 | " | 79 | 78 | This Invention |
| 41A | " | A-25 | " | 78 | 77 | This Invention |
| 42A | " | A-39 | " | 80 | 79 | This Invention |
| 43A | " | A-40 | " | 79 | 76 | This |

TABLE 1-continued

| Sample | Magenta Coupler | Color image Stabilizer 1 | Color image stabilizer 2 | Residual Magenta Density Xe. 8 Days Initial Density 1.0 | Initial Density 0.5 | Remarks |
|---|---|---|---|---|---|---|
| 44A | " | A-9 | B-28 | 82 | 79 | Invention This Invention |
| 45A | " | A-25 | " | 80 | 78 | Invention This Invention |
| 46A | " | A-40 | " | 80 | 78 | Invention This Invention |
| 47A | " | A-1 | B-29 | 79 | 77 | Invention This Invention |
| 48A | " | A-9 | " | 80 | 78 | Invention This Invention |
| 49A | " | A-21 | " | 79 | 77 | Invention This Invention |
| 50A | " | A-25 | " | 81 | 80 | Invention This Invention |
| 51A | " | A-39 | " | 79 | 78 | Invention This Invention |
| 52A | EXM(M-7/M-2) | A-40 | B-29 | 79% | 77% | Invention This Invention |
| 53A | " | A-26 | " | 72 | 59 | Invention This Invention |
| 54A | " | A-25 | B-39 | 69 | 60 | Invention This Invention |
| 55A | " | A-40 | " | 72 | 62 | Invention This Invention |

It is clear from Table 1 that the samples of the present invention were excellent in respect of the prevention of fading by light, and especially in respect of the prevention of fading by light of the low density regions in which the magenta dye concentration was low, and this is a surprising result which could not be anticipated on the basis of the conventional technique.

EXAMPLE 2

A multi-layer color printing paper of which the layer structure is indicated below was prepared on a paper support which had been laminated on both sides with polyethylene. The coating liquids were prepared in the way described below.

Preparation of the First Layer Coating Liquid

Ethyl acetate (27.2 cc) and 8.2 grams of the solvent (Solv-1) were added to 19.1 gram of yellow coupler (ExY) 4.4 grams of color image stabilizer (Cpd-1) and 0.7 gram of the color image stabilizer (Cpd-10) to form a solution which was then emulsified and dispersed in 185 cc of a 10% aqueous gelatin solution which contained 8 cc of 10% sodium dodecylbenzenesulfonate (emulsified dispersion A). On the other hand, the blue sensitive sensitizing dyes A and B indicated below were added to silver chlorobromide emulsion A (a 3:7 (Ag mol ratio) mixture of a large size cubic emulsion A of average grain size 0.88 μm and a small size cubic emulsion A of average grain size 0.70 μm; the variation coefficients of the grain size distributions being 0.08 and 0.10, and each emulsion had 0.2 mol % silver bromide included locally on the surface of the grains) in amounts of $2.0\times10^{-4}$ mol of each per mol of silver in the emulsion which had large grains and in amounts of $2.5\times10^{-4}$ mol of each per mol of silver halide in the emulsion which had small grains, after which the emulsion was sulfur sensitized. This silver chlorobromide emulsion A was mixed with the aforementioned emulsified dispersion A to prepare the first layer coating liquid of which the composition is indicated below.

The coating liquids for the second to the seventh layers were prepared using the same procedure as for the first layer coating liquid. 1-Oxy-3,5-dichloro-s-triazine, sodium salt, was used as a gelatin hardening agent for each layer.

The spectrally sensitizing dyes indicated below were used respectively in the silver chlorobromide emulsions of each photosensitive emulsion layer.

Blue Sensitive Emulsion Layer Sensitizing Dye A

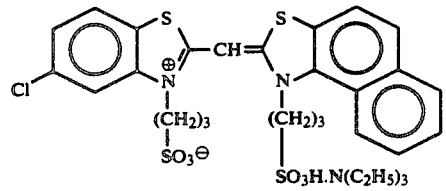

Blue Sensitive Emulsion Layer Sensitizing Dye B

-continued

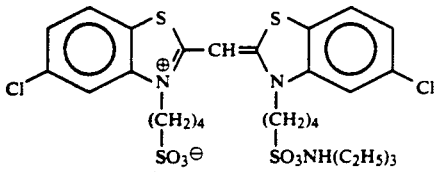

(2.0 × $10^{-4}$ mol of each per mol of silver halide for the large size emulsion and 2.5 × $10^{-4}$ mol of each per mol of silver halide for the small size emulsion)

Green Sensitive Emulsion Layer Sensitizing Dye C

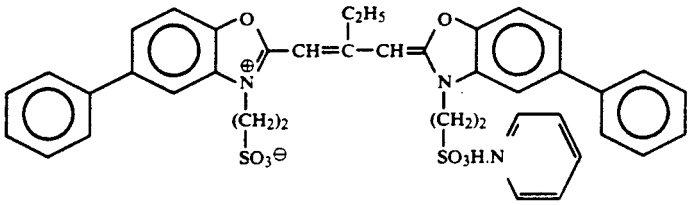

(4.0 × $10^{-5}$ mol per mol of silver halide for the large size emulsion and 5.6 × $10^{-4}$ mol per mol of silver halide for the small size emulsion)

and Green Sensitive Emulsion Layer Sensitizing Dye D

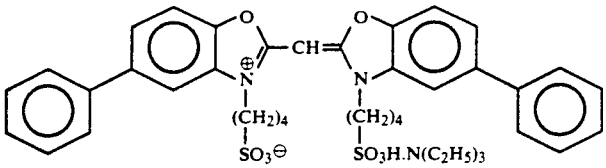

(7.0 × $10^{-5}$ mol per mol of silver halide for the large size emulsion and 1.0 × $10^{-5}$ mol per mol of silver halide for the small size emulsion)

Red Sensitive Emulsion Layer Sensitizing Dye E

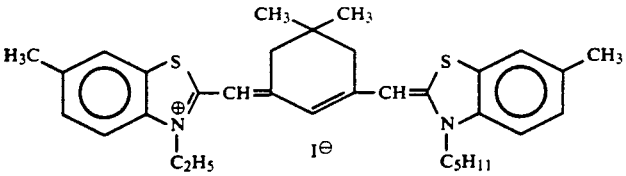

(0.9 × $10^{-4}$ mol per mol of silver halide for the large size emulsion and 1.1 × $10^{-4}$ mol per mol of silver halide for the small size emulsion)

The compound indicated below was added in an amount of $2.6\times10^{-3}$ mol per mol of silver halide to the red sensitive emulsion layer.

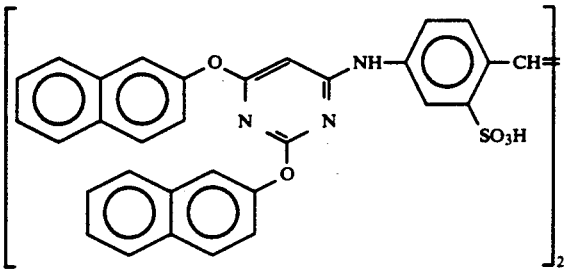

Furthermore, 1-(5-methylureidophenyl)-5-mercaptotetrazole was added to the blue, green and red sensitive emulsions layers in amounts, per mol of silver halide, of $8.5\times10^{-5}$ mol, $7.7\times10^{-4}$ mol and $2.5\times10^{4}$ mol respectively.

Furthermore, 4-hydroxy-6-methyl-1,3,3a,7-tetraazaindene was added to the blue and green sensitive emulsion layers in amounts, per mol of silver halide, of $1\times10^{-4}$ mol and $2\times10^{-4}$ mol respectively.

The dyes indicated below were added to the emulsion layers for anti-irradiation purposes.

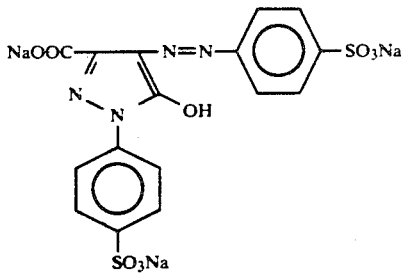

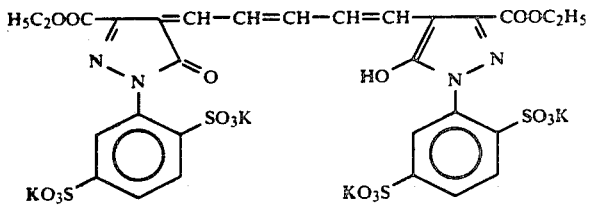

and

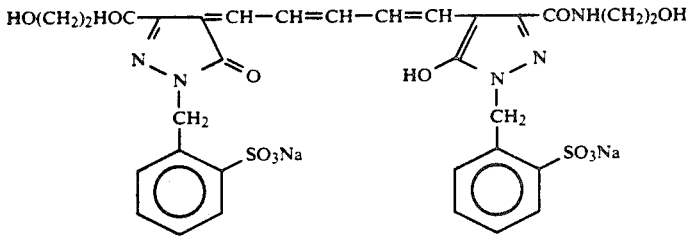

Layer Structure

The composition of each layer is indicated below. The numerical values indicate coated weights (g/m$^2$). In the case of silver halide emulsions the coated weight is shown as the calculated coated weight of silver.

Support

Polyethylene laminated paper (White pigment ($TiO_2$) and blue dye (ultramarine) included in the polyethylene on the first layer side)

| | |
|---|---|
| First Layer (Blue Sensitive Layer) | |
| The aforementioned silver chlorobromide emulsion A | 0.30 |
| Gelatin | 1.86 |
| Yellow coupler (ExY) | 0.82 |
| Color image stabilizer (Cpd-1) | 0.19 |
| Solvent (Solv-1) | 0.35 |
| Color image stabilizer (Cpd-7) | 0.06 |
| Second Layer (Anti-color Mixing Layer) | |
| Gelatin | 0.99 |
| Anti-color mixing agent (Cpd-5) | 0.08 |
| Solvent (Solv-1) | 0.16 |
| Solvent (Solv-4) | 0.08 |
| Third Layer (Green Sensitive Layer) | |
| Silver chlorobromide emulsion (a 1:3 (silver mol ratio) mixture of a large size cubic emulsion of average grain size 0.55 μm and a small size cubic emulsion of average grain size 0.39 mm; the variation coefficients of the grain size distributions were 0.10 and 0.08, and each emulsion had 0.8 mol % AgBr included locally on the grain surfaces) | 0.12 |
| Gelatin | 1.24 |
| Magenta coupler (ExM) | 0.20 |

-continued

| | |
|---|---|
| Color image stabilizer 1 | — |
| Color image stabilizer 2 (Cpd-3) | 0.15 |
| Color image stabilizer (Cpd-8) | 0.02 |
| Color image stabilizer (Cpd-9) | 0.02 |
| Solvent (Solv-2) | 0.40 |
| Fourth Layer (Ultraviolet Absorbing Layer) | |
| Gelatin | 1.58 |
| Ultraviolet absorber (UV-1) | 0.47 |
| Anti-color mixing agent (Cpd-5) | 0.05 |
| Solvent (Solv-5) | 0.24 |
| Fifth Layer (Red Sensitive Layer) | |
| Silver chlorobromide emulsion (a 1:4 (silver mol ratio) mixture of a large size cubic emulsion C of average grain size 0.58 μm and a small size cubic emulsion C of average grain size 0.45 mm; the variation coefficients of the grain size distributions were 0.09 and 0.11, and each emulsion had 0.6 mol % AgBr included locally on the grain surfaces) | 0.23 |
| Gelatin | 1.34 |
| Cyan coupler (ExC) | 0.32 |
| Color image stabilizer (Cpd-6) | 0.17 |
| Color image stabilizer (Cpd-10) | 0.40 |
| Color image stabilizer (Cpd-11) | 0.04 |
| Solvent (Solv-7) | 0.15 |
| Sixth Layer (Ultraviolet Absorbing Layer) | |
| Gelatin | 0.53 |
| Ultraviolet absorber (UV-1) | 0.16 |
| Anti-color mixing agent (Cpd-5) | 0.02 |
| Solvent (Solv-5) | 0.08 |
| Seventh Layer (Protective Layer) | |
| Gelatin | 1.33 |
| Acrylic modified poly(vinyl alcohol) copolymer (17% modification) | 0.17 |
| Liquid paraffin | 0.03 |

The sample obtained in this way was taken as Sample 1B, and Samples 2B–48B were prepared in the same way as Sample B except that the magenta coupler and the color image stabilizer 1 (compound of general formula (A), 50 mol % with respect to the said coupler) and the color image stabilizer 2 (compound of general formula (B), 100 mol % with respect to the said coupler) in the third layer were combined as shown in Table 1.

Moreover, the compound codes used were the same as those used in example 1 except for those indicated below.

(ExC-2) Cyan Coupler

A 2:4:mixture by weight of:

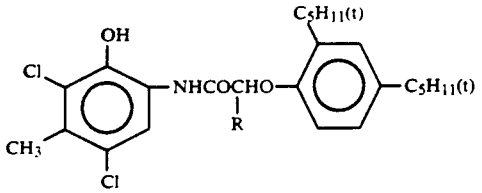

R = $C_2H_5$ and $C_4H_9$ and

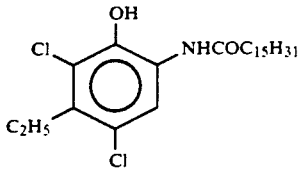

(Cpd-10) Color Image Stabilizer

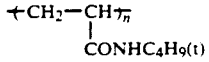

(Average molecular weight 60,000)

(Cpd-11) Color Image Stabilizer

A 1:1:1 (weight ratio) mixture of:

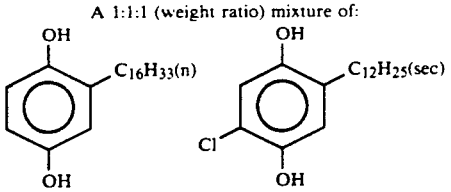

and

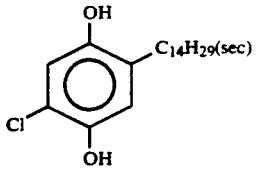

(Solv-7)

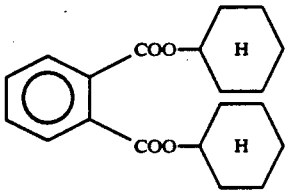

These samples were subjected to photographic processing in the way outlined below.

Thus, each sample was exposed using the method described in Example 1. The exposed samples were subjected to continuous processing (a running test) using a paper processor until replenishment had been carried out to twice the color development tank capacity in the processing operations indicated below.

| Processing Operation | Temperature (°C.) | Time (sec.) | Replenishment Rate* | Tank Capacity |
|---|---|---|---|---|
| Color Development | 35 | 45 | 161 ml | 17 liters |
| Bleach-fix | 30–35 | 45 | 215 ml | 17 liters |
| Rinse (1) | 30–35 | 20 | — | 10 liters |
| Rinse (2) | 30–35 | 20 | — | 10 liters |
| Rinse (3) | 30–35 | 20 | 350 ml | 10 liters |
| Drying | 70–80 | 60 | | |

*Replenishment rate per square meter of photosensitive material.
(A three tank counter flow system from rinse (3) Rinse (1) was used)

The composition of each processing bath was as indicated below.

| | Tank Solution | Replenisher |
|---|---|---|
| Color Development Bath | | |
| Water | 800 ml | 800 ml |
| Ethylenediamine-N,N,N,N-tetramethylenephosphonic acid | 1.5 grams | 2.0 grams |
| Potassium bromide | 0.015 gram | — |
| Triethanolamine | 8.0 grams | 12.0 grams |
| Sodium chloride | 1.4 grams | — |
| Potassium carbonate | 25 grams | 25 grams |
| N-Ethyl-N-(β-methanesulfonamidoethyl)-3-methyl-4-aminoaniline sulfate | 5.0 grams | 7.0 grams |
| N,N-Bis(carboxymethyl)-hydrazine | 5.5 grams | 7.0 grams |
| Fluorescent whitener (WHITEX 4B, made by Sumitomo Chemicals) | 1.0 gram | 2.0 grams |
| Water to make up to | 1000 ml | 1000 ml |
| pH (25° C.) | 10.05 | 10.45 |
| Bleach-fix Bath (Tank Solution = Replenisher) | | |
| Water | | 400 ml |
| Ammonium thiosulfate (700 g/l) | | 100 ml |
| Sodium sulfite | | 17 grams |
| Ethylenediamine tetra-acetic acid, iron(III) ammonium salt | | 55 grams |
| Ethylenediamine tetra-acetic acid, di-sodium salt | | 5 grams |
| Ammonium bromide | | 40 grams |
| Water to make up to | | 1000 ml |
| pH (25° C.) | | 6.0 |
| Rinse Bath (Tank Solution = Replenisher) | | |
| Ion exchanged water (Calcium and magnesium both less than 3 ppm) | | |

Each sample in which a dye image had been formed in this way was subjected to a fading test. The fading test involved evaluating the residual magenta dye at initial densities of 1.0 and 0.5 after irradiation for 8 days in a xenon tester (Xe) (luminance 200,000 lux). The measurements were made using a Fuji recording densitometer. The results obtained are shown in Table 2.

TABLE 2

| Sample | Magenta Coupler | Color image Stabilizer 1 | Color image stabilizer 2 | Residual Magenta Density Xe. 8 Days 200,000 lux Initial Density 1.0 | Initial Density 0.5 | Remarks |
|---|---|---|---|---|---|---|
| 1B | EXM(M-7/M-2) | — | Cpd-3(B-18) | 68% | 50% | Comparative Example |
| 2B | " | — | B-27 | 67 | 48 | Comparative Example |
| 3B | " | A-7 | Cpd-3(B-18) | 82 | 78 | This Invention |
| 4B | " | A-16 | " | 79 | 76 | This Invention |
| 5B | " | A-32 | " | 82 | 79 | This Invention |
| 6B | " | A-33 | " | 80 | 77 | This Invention |
| 7B | " | A-7 | B-27 | 80 | 76 | This Invention |
| 8B | " | A-16 | " | 79 | 75 | This Invention |
| 9B | " | A-32 | " | 80 | 77 | This Invention |
| 10B | " | A-33 | " | 80 | 79 | This Invention |
| 11B | M-12 | — | Cpd-3(B-18) | 70 | 53 | Comparative Example |
| 12B | " | — | B-3 | 67 | 52 | Comparative Example |
| 13B | M-12 | — | B-35 | 69% | 51% | Comparative Example |
| 14B | " | Comparative Compound (a) | — | 34 | 23 | Comparative Example |
| 15B | " | Comparative Compound (b) | — | 32 | 22 | Comparative Example |
| 16B | " | Comparative Compound (c) | — | 36 | 27 | Comparative Example |
| 17B | Comparative Coupler (b) | Comparative Compound (b) | B-3 | 53 | 46 | Comparative Example |
| 18B | Comparative Coupler (b) | Comparative Compound (c) | " | 53 | 40 | Comparative Example |
| 19B | Comparative Coupler (c) | Comparative Compound (c) | Cpd-3(B-18) | 57 | 47 | Comparative Example |
| 20B | Comparative Coupler (b) | — | B-3 | 52 | 44 | Comparative Example |
| 21B | Comparative Coupler (c) | — | Cpd-3(B-18) | 55 | 48 | Comparative Example |
| 22B | M-12 | Comparative Compound (a) | " | 70 | 55 | Comparative Example |
| 23B | " | Comparative Compound (b) | B-3 | 68 | 54 | Comparative Example |
| 24B | " | Comparative Compound (c) | " | 67 | 53 | Comparative Example |
| 25B | M-12 | Comparative Compound (c) | Cpd-3(B-18) | 69% | 55% | Comparative Example |
| 26B | " | A-7 | — | 32 | 25 | Comparative Example |
| 27B | " | A-16 | — | 30 | 28 | Comparative Example |
| 28B | " | A-32 | — | 34 | 27 | Comparative Example |
| 29B | M-12 | A-33 | — | 35 | 28 | Comparative Example |
| 30B | " | — | B-19 | 69 | 52 | Comparative Example |
| 31B | " | — | B-27 | 68 | 50 | Comparative Example |
| 32B | " | — | B-31 | 64 | 44 | Comparative Example |
| 33B | " | A-7 | Cpd-3(B-18) | 84 | 79 | This Invention |
| 34B | " | A-16 | " | 82 | 75 | This Invention |
| 35B | " | A-32 | " | 83 | 79 | This Invention |
| 36B | " | A-33 | " | 72 | 78 | This Invention |
| 37B | " | A-7 | B-3 | 74 | 62 | This Invention |
| 38B | M-12 | A-32 | B-3 | 74% | 62% | This Invention |

TABLE 2-continued

| Sample | Magenta Coupler | Color image Stabilizer 1 | Color image stabilizer 2 | Residual Magenta Density Xe, 8 Days 200,000 lux Initial Density 1.0 | Initial Density 0.5 | Remarks |
|---|---|---|---|---|---|---|
| 39B | " | A-16 | B-31 | 71 | 58 | This Invention |
| 40B | " | A-33 | " | 61 | 59 | This Invention |
| 41B | " | A-7 | B-19 | 84 | 79 | This Invention |
| 42B | " | A-16 | " | 81 | 75 | This Invention |
| 43B | " | A-32 | B-27 | 82 | 79 | This Invention |
| 44B | " | A-33 | " | 82 | 78 | This Invention |
| 45B | " | A-7 | B-35 | 83 | 79 | This Invention |
| 46B | " | A-16 | " | 80 | 75 | This Invention |
| 47B | " | A-32 | " | 82 | 79 | This Invention |
| 48B | " | A-33 | " | 81 | 78 | This Invention |

It is clear from Table 2 that the samples of the present invention had excellent light fastness, and that they were especially good in respect of light fading in the low density regions of low magenta dye concentration.

EXAMPLE 3

Samples were prepared in the same way as Samples 29A to 55A in Example 1 except that the color image stabilizers (Cpd-8) and (Cpd-9) in the third layer were omitted. The samples were exposed and processed in the same way as in Example 1 and on subjecting these samples to a fading test (60° C, 70% RH, 2 weeks) the occurrence of magenta staining to an extent of from 0.37 to 0.42 was observed.

The color image stabilizers (Cpd-8) and (Cpd-9) clearly had an effect on the image storage stability, and especially on the prevention of magenta staining.

EXAMPLE 4

The coated samples prepared in Example 2 were exposed using the method described in Example 2 and the imagewise exposed samples of photosensitive material were subjected to continuous processing in running tests using a paper processor in accordance with the processing operations indicated below until replenishment of the color development reached twice the tank capacity, and colored images were obtained.

| Processing Operation | Temperature (°C.) | Time (sec.) | Replenishment Rate* | Tank Capacity |
|---|---|---|---|---|
| Color Development | 35 | 45 | 161 ml | 17 liters |
| Bleach-fix | 30–36 | 45 | 215 ml | 17 liters |
| Stabilization (1) | 30–37 | 20 | — | 10 liters |
| Stabilization (2) | 30–37 | 20 | — | 10 liters |
| Stabilization (3) | 30–37 | 20 | — | 10 liters |
| Stabilization (4) | 30–37 | 30 | 248 ml | 10 liters |
| Drying | 70–85 | 60 | | |

*Replenishment rate per square meter of photosensitive material. (A four tank counter flow system from stabilization (4) Stabilization (1) was used)

The composition of each processing bath was as indicated below.

| | Tank Solution | Replenisher |
|---|---|---|
| Color Development Bath | | |
| Water | 800 ml | 800 ml |
| Ethylenediamine tetra-acetic acid | 2.0 grams | 2.0 grams |
| 1-Hydroxyethylidene-1,1-diphosphonic acid | 0.3 gram | 0.3 gram |
| Triethanolamine | 8.0 grams | 8.0 grams |
| Sodium chloride | 1.4 grams | — |
| Potassium carbonate | 25 grams | 25 grams |
| N-Ethyl-N-(β-methanesulfonamidoethyl)-3-methyl-4-aminoaniline sulfate | 5.0 grams | 7.0 grams |
| Diethylhydroxylamine | 4.2 grams | 6.0 grams |
| Fluorescent whitener (4,4'-diaminostilbene based) | 2.0 grams | 2.5 grams |
| Water to make up to | 1000 ml | 1000 ml |
| pH (25° C.) | 10.05 | 10.45 |
| Bleach-fix Bath (Tank Solution = Replenisher) | | |
| Water | | 400 ml |
| Ammonium thiosulfate (700 g/l) | | 100 ml |
| Sodium sulfite | | 17 grams |
| Ethylenediamine tetra-acetic acid, iron(III) ammonium salt | | 55 grams |
| Ethylenediamine tetra-acetic acid, di-sodium salt | | 5 grams |
| Glacial acetic acid | | 9 grams |
| Water to make up to | | 1000 ml |
| pH (25° C.) | | 5.40 |
| Stabilizer Bath (Tank Solution = Replenisher) | | |
| Formalin (37%) | | 0.1 gram |
| Formalin/sulfurous acid adduct | | 0.7 gram |
| 5-Chloro-2-methyl-4-isothiazolin-3-one | | 0.02 gram |
| 2-Methyl-4-isothiazolin-3-one | | 0.01 gram |
| Copper sulfate | | 0.005 gram |
| Water to make up to | | 1000 ml |
| pH (25° C.) | | 4.0 |

On subjecting each sample so obtained to fading tests as described in Example 2, the samples of the present invention had very high light fastness as in Example 2, and this effect was clearly not dependent on the method of development processing.

EXAMPLE 5

A color photographic material was prepared by the lamination coating of the first to the twelfth layers indicated below on a paper support which had been laminated on both sides with polyethylene. Titanium white as a white pigment and a trace of ultramarine as a blue dye were included in the polyethylene on the first layer side of the support.

Photosensitive Layer Composition

The components and coated weights in units of g/m$^2$ are indicated below. In the case of silver halides the coated weights are indicated after calculation as silver.

| | |
|---|---|
| First Layer (Gelatin Layer) | |
| Gelatin | 1.30 |
| Second Layer (Anti-halation Layer) | |
| Black colloidal silver | 0.10 |
| Gelatin | 0.70 |
| Third Layer (Low Speed Red Sensitive Layer) | |
| Silver chloroiodobromide EM1 (1 mol % AgCl, 4 mol % AgI, average grain size 0.3 μm, size distribution 10%, cubic grains, core iodide type core/shell) spectrally sensitized with the red sensitizing dyes (ExS-1,2,3) | 0.06 |
| Silver iodobromide emulsion EM2 (5 mol % AgI, average grain size 0.45 μm, size distribution 20%, tabular (aspect ratio = 5)) spectrally sensitized with the red sensitizing dyes (ExS-1,2,3) | 0.10 |
| Gelatin | 1.00 |
| Cyan coupler (ExC-1) | 0.14 |
| Cyan coupler (ExC-2) | 0.07 |
| Anti-color mixing agent (equal amounts of Cpd-2,3,4,9) | 0.12 |
| Coupler dispersion medium (Cpd-5) | 0.03 |
| Coupler solvent (equal amounts of Solv-1,2,3) | 0.06 |
| Fourth Layer (High Speed Red Sensitive Layer) | |
| Silver iodobromide EM3 (6 mol % AgI, average grain size 0.75 μm, size distribution 25%, tabular grains (aspect ratio = 8, core iodide)) spectrally sensitized with the red sensitizing dyes (ExS-1,2,3) | 0.15 |
| Gelatin | 1.00 |
| Cyan coupler (ExC-1) | 0.20 |
| Cyan coupler (ExC-2) | 0.10 |
| Anti-color mixing agent (equal amounts of Cpd-2,3,4,9) | 0.15 |
| Coupler dispersion medium (Cpd-5) | 0.03 |
| Coupler solvent (equal amounts of Solv-1,2,3) | 0.10 |
| Fifth Later (Intermediate Layer) | |
| Magenta colloidal silver | 0.02 |
| Gelatin | 1.00 |
| Anti-color mixing agent (Cpd-6,7) | 0.08 |
| Anti-color mixing agent solvent (Solv-4,5) | 0.16 |
| Polymer latex (Cpd-8) | 0.10 |
| Sixth Layer (Low Speed Green Sensitive Layer) | |
| Silver chloroiodobromide EM4 (1 mol % AgCl, 2.5 mol % AgI, average grain size 0.28 μm, grain size distribution 12%, cubic grains, core iodide type core/shell) spectrally sensitized with the green sensitizing dye (ExS-4) | 0.04 |
| Silver iodobromide EM5 (2.8 mol % AgI, average grain size 0.45 μm, grain size distribution 12%, tabular (aspect ratio = 5)) spectrally sensitized with the green sensitizing dye (ExS-4) | 0.06 |
| Gelatin | 0.80 |
| Magenta coupler (ExM-1) | 0.10 |
| Anti-color fading agent 1 | — |
| Anti-color fading agent 2 (Cpd-9) | 0.10 |
| Anti-staining agent (Cpd-10) | 0.01 |
| Anti-staining agent (Cpd-11) | 0.001 |
| Anti-staining agent (Cpd-12) | 0.01 |
| Coupler dispersion medium (Cpd-5) | 0.05 |
| Coupler solvent (Solv-4,6) | 0.15 |
| Seventh Layer (High Speed Green Sensitive Layer) | |
| Silver iodobromide EM6 (3.5 mol % AgI, average grain size 0.9 μm, grain size distribution 23%, tabular (aspect ratio = 9, uniform iodide type) spectrally sensitized with the green sensitizing dye (ExS-4) | 0.10 |
| Gelatin | 0.80 |
| Magenta coupler (ExM-1) | 0.10 |
| Anti-color fading agent 3 | — |
| Anti-color fading agent 4 (Cpd-9) | 0.10 |
| Anti-staining agent (Cpd-10) | 0.01 |
| Anti-staining agent (Cpd-11) | 0.001 |
| Anti-staining agent (Cpd-12) | 0.01 |
| Coupler dispersion medium (Cpd-5) | 0.05 |
| Coupler solvent (Solv-4,6) | 0.15 |
| Eighth Layer (Yellow Filter Layer) | |
| Yellow colloidal silver | 0.20 |
| Gelatin | 1.00 |
| Anti-color mixing agent (Cpd-7) | 0.06 |
| Anti-color mixing agent solvent (Solv-4,5) | 0.15 |
| Polymer latex (Cpd-8) | 0.10 |
| Ninth Layer (Low Speed Blue Sensitive Layer) | |
| Silver chloroiodobromide EM7 (2 mol % AgCl, 2.5 mol % AgI, average grain size 0.35 μm, grain size distribution 8%, cubic grains, core iodide type core/shell) spectrally sensitized with the blue sensitizing dyes (ExS-5,6) | 0.07 |
| Silver iodobromide EM8 (2.5 mol % AgI, average grain size 0.45 μm, grain size distribution 16%, tabular (aspect ratio = 6)) spectrally sensitized with the blue sensitizing dyes (ExS-5,6) | 0.10 |
| Gelatin | 0.50 |
| Yellow coupler (ExY-1) | 0.20 |
| Anti-staining agent (Cpd-11) | 0.001 |
| Anti-color fading agent (Cpd-6) | 0.10 |
| Coupler dispersion medium (Cpd-5) | 0.05 |
| Coupler solvent (Solv-2) | 0.05 |
| Tenth Layer (High Speed Blue Sensitive Layer) | |
| Silver iodobromide EM9 (2.5 mol % AgI, average grain size 1.2 μm, grain size distribution 21%, tabular (aspect ratio = 14)) spectrally sensitized with the blue sensitizing dyes (ExS-5,6) | 0.25 |
| Gelatin | 1.00 |
| Yellow coupler (ExY-1) | 0.40 |
| Anti-staining agent (Cpd-11) | 0.002 |
| Anti-color fading agent (Cpd-6) | 0.10 |
| Coupler dispersion medium (Cpd-5) | 0.15 |
| Coupler solvent (Solv-2) | 0.10 |
| Eleventh Layer (Ultraviolet Absorbing Layer) | |
| Gelatin | 1.50 |
| Ultraviolet absorber (Cpd-1,3,13) | 1.00 |
| Anti-color mixing agent (Cpd-6,14) | 0.06 |
| Dispersion medium (Cpd-5) | |
| Ultraviolet absorber solvent (Solv-1,2) | 0.15 |
| Anti-irradiation dye (Cpd-15,16) | 0.02 |
| Anti-irradiation dye (Cpd-17,18) | 0.02 |
| Twelfth Layer (Protective Layer) | |
| Fine grained silver chlorobromide (97 mol % AgCl, average grain size 0.2 μm) | 0.07 |
| Modified "polyvinyl alcohol" | 0.02 |
| Gelatin | 1.50 |
| Gelatin hardening agent (H-1) | 0.17 |

Moreover, "Alcanol XC" (DuPont Co.) and sodium alkylbenzenesulfonate were used as emulsification and dispersion promotors, and succinic acid ester and "Magefac F-120" (Dainippon Ink Co.) were used as coating promotors in each layer. The compounds (Cpd-19,20,21) were used as stabilizers in the layers which contained silver halides or colloidal silver. The compounds used in this example are indicated below.
ExS-1
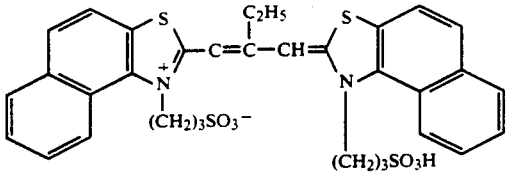
ExS-2
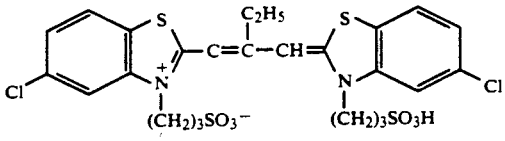
ExS-3
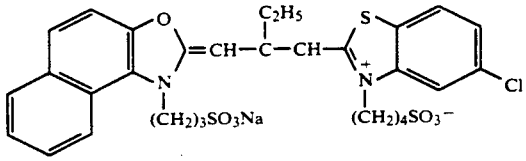
ExS-4
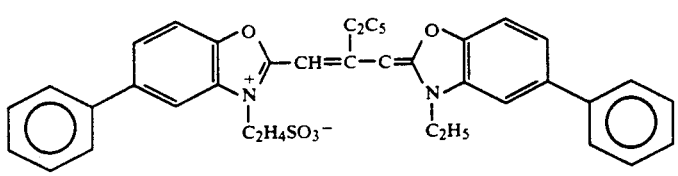
ExS-5
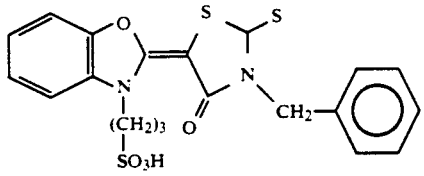
Cpd-1
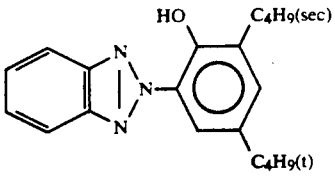
Cpd-2
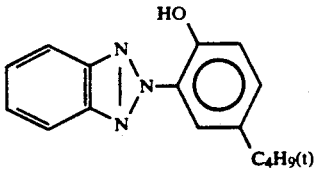
Cpd-3
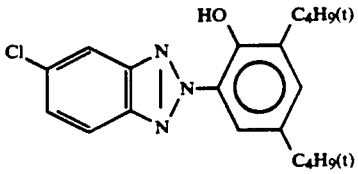

-continued
Cpd-4
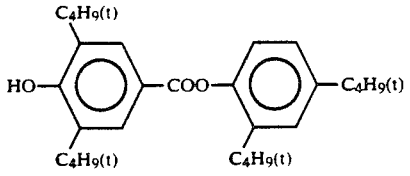
Cpd-5
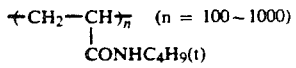
Cpd-6
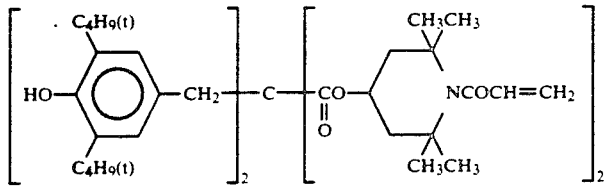
Cpd-7
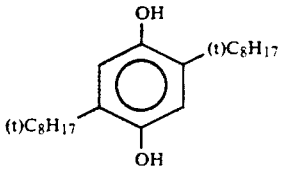
Poly(ethyl acrylate) Cpd-8
Cpd-9
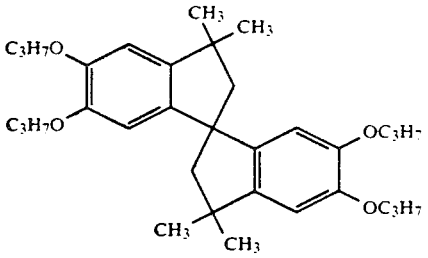
Cpd-10
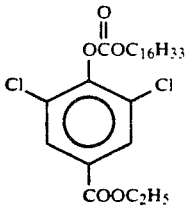
Cpd-11
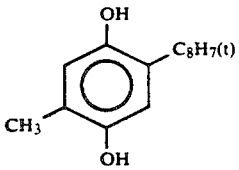
Cpd-12
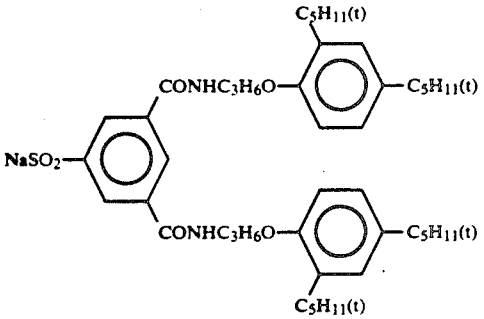

-continued
Cpd-13
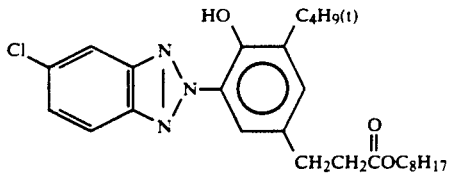
Cpd-14
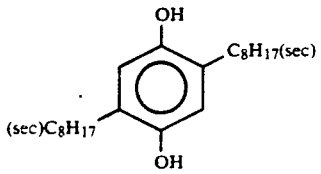
Cpd-15
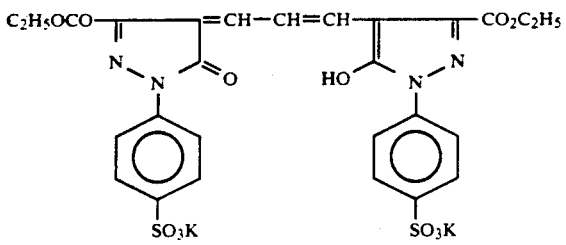
Cpd-16
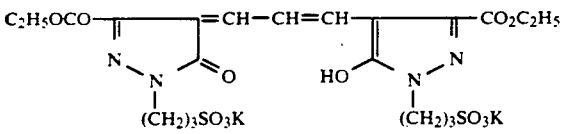
Cpd-17
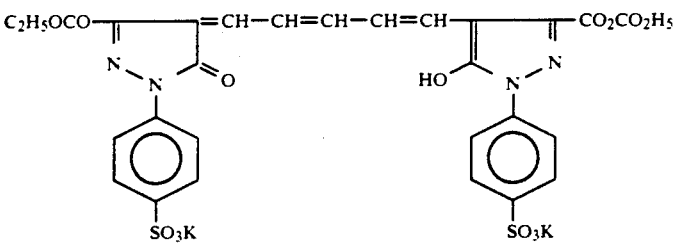
Cpd-18
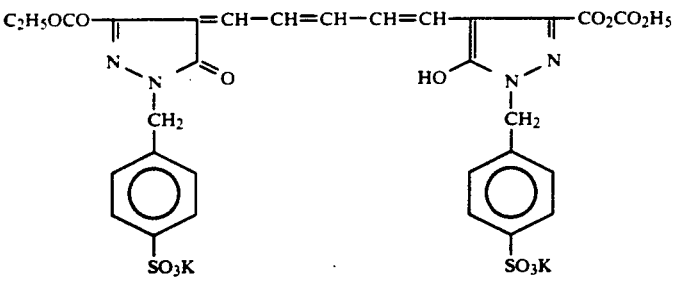
Cpd-19
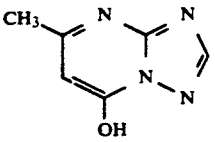
Cpd-20
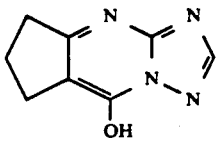

-continued

Cpd-21

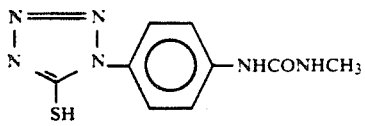

ExC-1

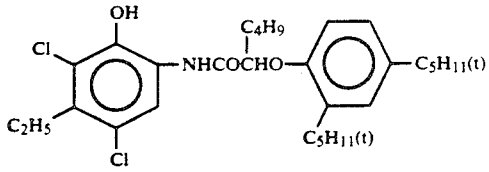

ExC-2

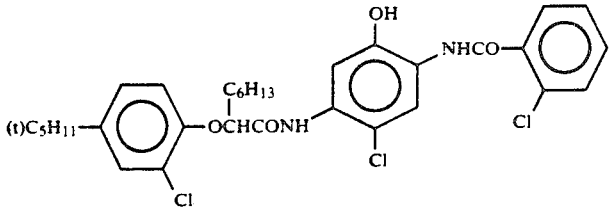

ExM-1

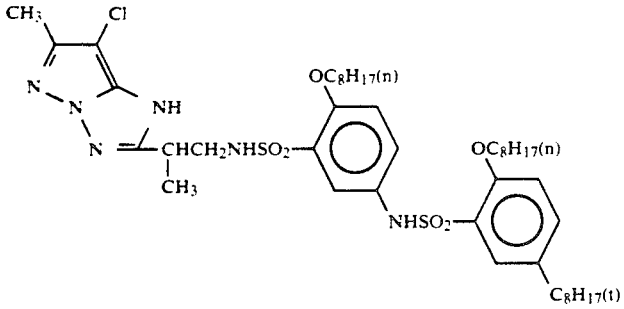

ExY-1

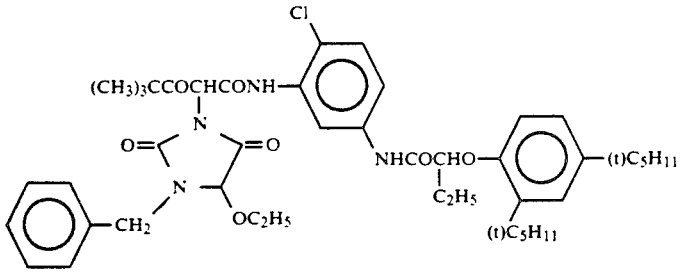

| | |
|---|---|
| Di(2-ethylhexyl) phthalate | Solv-1 |
| Trinonyl phosphate | Solv-2 |
| Di(3-methylhexyl) phthalate | Solv-3 |
| Tricresyl phosphate | Solv-4 |
| Dibutyl phthalate | Solv-5 |
| Trioctyl phosphate | Solv-6 |
| 1,2-Bis(vinylsulfonylacetamido)ethane | Solv-7 |

EMULSION A

Preparation of a Mono-disperse Emulsion which has a (100) Crystal Habit

An aqueous solution of silver nitrate and an aqueous solution containing KBr and KI were added using the double jet method to an aqueous solution of gelatin which was being maintained at 70° C while maintaining a pBr value of 4.5 and a mono-disperse emulsion (edge length 0.68 μm) which had a (100) crystal habit was prepared. This core emulsion was then subjected to shell formation under the conditions outlined below and a final grain size of 0.7 μm and an AgI content of 3 mol % were attained.

Sodium thiosulfate and potassium chloroaurate were added to the above mentioned core emulsion and chemical sensitization was carried out. Subsequently, the shell was precipitated under the same conditions as used for the core formation.

The sample obtained in this way was taken as Sample 1E, and Samples 2E–35E were prepared in the same way as Sample 1E except that the magenta coupler and the anti-color fading agents 1 and 3 (compounds of general formula (A), 50 mol % with respect to the coupler) and the anti-color fading agents 2 and 4 (compounds of general formula (B), 175 mol % with respect to the coupler) in the sixth and seventh layers were combined as shown in Table 3. The comparative compounds and comparative couplers are the same as those in Example 1.

The samples obtained were subjected to photographic processing as indicated below.

Firstly, each sample was subjected to a 3200° K. 200 CMS exposure using an optical wedge.

The exposed samples were then processed in an automatic processor using the processing operations and processing baths indicated below.

| Processing Operations | | |
|---|---|---|
| First Development (Black-and-white development) | 38° C. | 45 seconds |
| Water wash | 38° C. | 45 seconds |
| Reversal Exposure | at least 500 lux | at least 15 seconds |
| Color development | 38° C. | 60 seconds |
| Water wash | 38° C. | 15 seconds |
| Bleach-fix | 38° C. | 60 seconds |
| Water wash | 38° C. | 60 seconds |
| Drying | | |

| Processing Bath Compositions | |
|---|---|
| First Developer | |
| Nitrilo-N,N,N-trimethylene-phosphonic acid, penta-sodium salt | 0.6 gram |
| Diethylenetriamine penta-acetic acid, penta-sodium salt | 4.0 grams |
| Potassium sulfite | 30.0 grams |
| Potassium thiocyanate | 1.2 grams |
| Potassium carbonate | 35.0 grams |
| Hydroquinone mono-sulfonate, sodium salt | 25.0 grams |
| Diethylene glycol | 15.0 ml |
| 1-Phenyl-4-hydroxymethyl-4-methyl-3-pyrazolidone | 2.0 grams |
| Potassium bromide | 5.0 mg |
| Water to make up to | 1000 ml |

-continued

| | |
|---|---|
| | (pH 9.7) |
| Color Developer | |
| Triethanolamine | 8.0 grams |
| N,N-Diethylhydroxylamine | 4.0 grams |
| 3,6-Dithia-1,8-octanediol | 0.2 gram |
| Ethylenediamine tetra-acetic acid, di-sodium salt, di-hydrate | 2.0 grams |
| Sodium sulfite | 0.2 gram |
| Potassium carbonate | 25.0 grams |
| N-Ethyl-N-(β-methane-sulfonamidoethyl)-3-methyl-4-aminoaniline sulfate | 8.0 grams |
| Potassium bromide | 0.5 grams |
| Potassium iodide | 1.0 mg |
| Water to make up to | 1000 ml |
| | (pH 10.4) |
| Bleach-Fixer | |
| 2-Mercapto-1,3,4-triazole | 0.5 gram |
| Ethylenediamine tetra-acetic acid, di-sodium salt, di-hydrate | 5.0 grams |
| Ethylenediamine tetra-acetic acid, Fe(III) ammonium salt, mon-hydrate | 80.0 grams |
| Sodium sulfite | 15.0 grams |
| Sodium thiosulfate (700 g/l solution) | 160.0 ml |
| Glacial acetic acid | 6.0 ml |
| Water to make up to | 1000 ml |
| | (pH 6.0) |

Each sample in which a dye image had been formed in this way was subjected to a fading test. The fading test involved evaluating the residual magenta dye at initial densities of 1.0 and 0.5 after irradiation for 10 days in a xenon tester (Xe) (luminance 200,000 lux). The measurements were made using a Fuji recording densitometer. The results obtained are shown in Table 3.

TABLE 3

| Sample | Magenta Coupler in the Sixth Layer | Anti-fading agent 1 | Anti-fading agent 2 | Magenta Coupler in the Seventh Layer | Anti-fading agent 3 | Anti-fading agent 4 | Residual Magenta Density Xe, 10 Days 200,000 lux: Initial Density 1.0 | Residual Magenta Density Xe, 10 Days 200,000 lux: Initial Density 0.5 | Remarks |
|---|---|---|---|---|---|---|---|---|---|
| 1E | EXM-1(M-1) | — | Cpd-9 (B-18) | EXM-1(M-1) | — | Cpd-9 (B-18) | 65% | 50% | Comparative Example |
| 2E | " | A-25 | Cpd-9 (B-18) | " | A-25 | Cpd-9 (B-18) | 79 | 78 | This Invention |
| 3E | " | A-28 | Cpd-9 (B-18) | " | A-28 | Cpd-9 (B-18) | 78 | 75 | This Invention |
| 4E | " | " | Cpd-9 (B-18) | " | A-25 | Cpd-9 (B-18) | 78 | 76 | This Invention |
| 5E | Comparative Compound (b) | " | Cpd-9 (B-18) | Comparative Coupler (b) | " | Cpd-9 (B-18) | 58 | 43 | Comparative Example |
| 6E | Comparative Compound (b) | Comparative Compound (b) | Cpd-9 (B-18) | Comparative Coupler (b) | Comparative Compound (b) | Cpd-9 (B-18) | 58 | 50 | Comparative Example |
| 7E | EXM-1(M-1) | Comparative Compound (b) | Cpd-9 (B-18) | EXM-1(M-1) | Comparative Compound (b) | Cpd-9 (B-18) | 63 | 52 | Comparative Example |
| 8E | " | Comparative Compound (b) | — | " | Comparative Compound (b) | — | 34 | 25 | Comparative Example |
| 9E | " | A-25 | — | " | A-25 | — | 35 | 27 | Comparative Example |
| 10E | " | A-28 | — | " | A-28 | — | 34 | 27 | Comparative Example |
| 11E | " | " | — | " | A-25 | — | 34 | 25 | Comparative Example |
| 12E | Comparative Compound (b) | Comparative Compound (c) | Cpd-9 (B-18) | Comparative Coupler (b) | Comparative Compound (c) | Cpd-9 (B-18) | 58 | 52 | Comparative Example |
| 13E | Comparative Compound (b) | — | Cpd-9 (B-18) | Comparative Coupler (b) | — | Cpd-9 (B-18) | 57% | 50% | Comparative Example |
| 14E | Comparative Compound (b) | Comparative Compound (c) | — | Comparative Coupler (b) | Comparative Compound (c) | — | 25 | 20 | Comparative Example |
| 15E | Comparative Compound (b) | Comparative Compound (b) | — | Comparative Coupler (b) | Comparative Compound (b) | — | 25 | 18 | Comparative Example |
| 16E | M-4 | Comparative Compound (b) | Cpd-9 (B-18) | M-4 | Comparative Compound (b) | Cpd-9 (B-18) | 69 | 55 | Comparative Example |

TABLE 3-continued

| Sample | Magenta Coupler in the Sixth Layer | Anti-fading agent 1 | Anti-fading agent 2 | Magenta Coupler in the Seventh Layer | Anti-fading agent 3 | Anti-fading agent 4 | Residual Magenta Density Xe, 10 Days 200,000 lux: Initial Density 1.0 | Initial Density 0.5 | Remarks |
|---|---|---|---|---|---|---|---|---|---|
| 17E | " | Comparative Compound (c) | Cpd-9 (B-18) | " | Comparative Compound (c) | Cpd-9 (B-18) | 68 | 57 | Comparative Example |
| 18E | " | A-25 | — | " | A-25 | — | 39 | 30 | Comparative Example |
| 19E | " | " | Cpd-9 (B-18) | " | " | Cpd-9 (B-18) | 82 | 79 | This Invention |
| 20E | " | " | Cpd-9 (B-18) | EXM-1(M-1) | A-28 | Cpd-9 (B-18) | 82 | 77 | This Invention |
| 21E | Comparative Compound (c) | — | Cpd-9 (B-18) | M-4 | " | Cpd-9 (B-18) | 75 | 78 | This Invention |
| 22E | Comparative Compound (c) | — | Cpd-9 (B-18) | " | A-25 | Cpd-9 (B-18) | 75 | 77 | This Invention |
| 23E | M-4 | A-25 | Cpd-9 (B-18) | " | " | Cpd-9 (B-18) | 82 | 79 | This Invention |
| 24E | " | A-28 | Cpd-9 (B-18) | " | A-28 | Cpd-9 (B-18) | 80 | 80 | This Invention |
| 25E | M-4 | A-28 | B-29 | M-4 | A-28 | B-29 | 84 | 82 | This Invention |
| 26E | " | A-25 | " | " | A-25 | " | 83 | 80 | This Invention |
| 27E | M-7 | " | " | " | " | " | 77 | 79 | This Invention |
| 28E | " | " | Cpd-9 (B-18) | " | " | Cpd-9 (B-18) | 79 | 80 | This Invention |
| 29E | M-10 | " | Cpd-9 (B-18) | " | " | Cpd-9 (B-18) | 72 | 69 | This Invention |
| 30E | " | — | Cpd-9 (B-18) | " | — | Cpd-9 (B-18) | 58 | 40 | Comparative Example |
| 31E | " | A-25 | B-39 | M-21 | A-25 | Cpd-9 (B-18) | 75 | 72 | This Invention |
| 32E | M-4 | — | Cpd-9 (B-18) | M-4 | — | Cpd-9 (B-18) | 68 | 55 | Comparative Example |
| 33E | M-4* | A-25 | Cpd-9 (B-18) | M-4* | A-25 | Cpd-9 (B-18) | 82 | 80 | This Invention |
| 34E | M-4** | " | Cpd-9 (B-18) | M-4** | " | Cpd-9 (B-18) | 82 | 80 | This Invention |
| 35E | M-4*** | " | Cpd-9 (B-18) | M-4*** | " | Cpd-9 (B-18) | 82 | 79 | This Invention |

*, , *. The compounds indicated below were added in an amount of 10 mol % with respect to the coupler in each case.

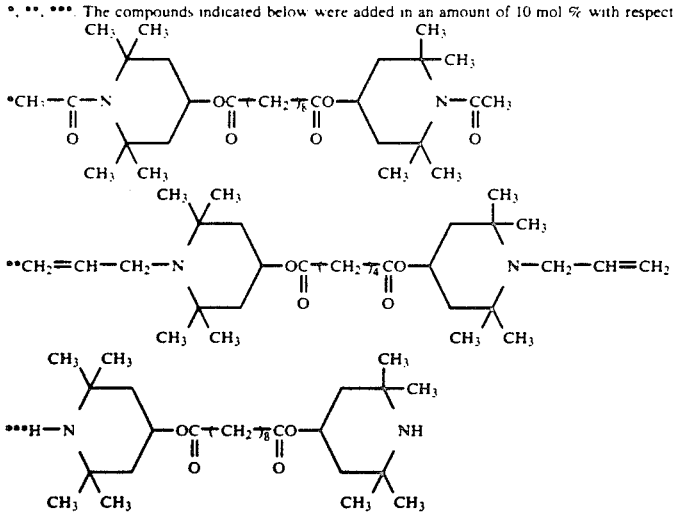

It is clear from Table 3 that the samples of the present invention had excellent light fastness, and that they were especially good in respect of light fading in the low density regions of low magenta dye concentration, and these effects were surprising and could not be predicted from the conventional technique.

EXAMPLE 6

A multi-color photosensitive material comprising each of the layers of which the compositions are indicated below was prepared on a cellulose triacetate film support of thickness 127 μm on which an under-layer had been established. The numerical values indicate the amounts added per square meter. Moreover, the effects of the compounds added are not limited to the application disclosed.

First Layer (Anti-halation Layer)

-continued

| | |
|---|---|
| Black colloidal silver | 0.25 gram |
| Gelatin | 1.9 gram |
| Ultraviolet absorber U-1 | 0.04 gram |
| Ultraviolet absorber U-2 | 0.1 gram |
| Ultraviolet absorber U-3 | 0.1 gram |
| Ultraviolet absorber U-6 | 0.1 gram |
| High boiling point organic solvent Oil-1 | 0.1 gram |
| Second Layer (Intermediate Layer) | |
| Gelatin | 0.40 gram |
| Compound Cpd-D | 10 mg |
| High boiling point organic solvent Oil-3 | 40 mg |
| Third Layer (Intermediate Layer) | |
| Fogged fine grain silver iodobromide emulsion (average grain size 0.06 μm, AgI content 1 mol %) | 0.05 gram as silver |
| Gelatin | 0.4 gram |
| Fourth Layer (Low Speed Red Sensitive Emulsion Layer) | |
| Silver iodobromide emulsion (a 1:1 mixture of a mono-disperse cubic emulsion of average grain size 0.4 μm, AgI content 4.5 mol %, and a mono-disperse emulsion of average grain size 0.3 μm, AgI content 4.5 mol %) which had been spectrally sensitized with the sensitizing dyes S-1 and S-2 | 0.4 gram as silver |
| Gelatin | 0.8 gram |
| Coupler C-1 | 0.20 gram |
| Coupler C-9 | 0.05 gram |
| Compound Cpd-D | 10 mg |
| High boiling point organic solvent Oil-2 | 0.10 gram |
| Fifth Layer (Medium Speed Red Sensitive Emulsion Layer) | |
| Silver iodobromide emulsion (a mono-disperse cubic emulsion of average grain size 0.5 μm and AgI content 4 mol %) which had been spectrally sensitized with the sensitizing dyes S-1 and S-2 | 0.4 gram as silver |
| Gelatin | 0.8 gram |
| Coupler C-1 | 0.2 gram |
| Coupler C-2 | 0.05 gram |
| Coupler C-3 | 0.2 gram |
| High boiling point organic solvent Oil-2 | 0.1 gram |
| Sixth Layer (High Speed Red Sensitive Emulsion Layer) | |
| Silver iodobromide emulsion (mono-disperse twined crystal grains of average grain size 0.7 μm and AgI content 2 mol %) which had been spectrally sensitized with the sensitizing dyes S-1 and S-2 | 0.4 gram as silver |
| Gelatin | 1.1 gram |
| Coupler C-3 | 0.7 gram |
| Coupler C-1 | 0.3 gram |
| Seventh Layer (Intermediate Layer) | |
| Gelatin | 0.6 gram |
| Dye D-1 | 0.02 gram |
| Eighth Layer (Intermediate Layer) | |
| Fogged silver iodobromide emulsion (average grain size 0.06 μm, AgI content 0.3 mol % | 0.02 gram as silver |
| Gelatin | 1.0 gram |
| Anti-color mixing agent Cpd-A | 0.2 gram |
| Ninth Layer (Low Speed Green Sensitive Emulsion Layer) | |
| Silver iodobromide emulsion (a 1:1 mixture of a mono-disperse cubic emulsion of average grain size 0.4 μm, AgI content 4.5 mol %, and a mono-disperse emulsion of average grain size 0.2 μm, AgI content 4.5 mol %) which had been spectrally sensitized with the sensitizing dyes S-3 and S-4 | 0.5 gram as silver |
| Gelatin | 0.5 gram |
| Coupler C-4 | 0.20 gram |
| Coupler C-7 | 0.10 gram |
| Coupler C-8 | 0.10 gram |

-continued

| | |
|---|---|
| Compound Cpd-B | 0.03 gram |
| Compound Cpd-F | 0.02 gram |
| Compound Cpd-G | 0.02 gram |
| Compound Cpd-D | 10 mg |
| High boiling point organic solvent Oil-1 | 0.1 gram |
| High boiling point organic solvent Oil-2 | 0.1 gram |
| Tenth Layer (Intermediate Speed Green Sensitive Emulsion Layer) | |
| Silver iodobromide emulsion (a mono-disperse cubic emulsion of average grain size 0.5 μm, AgI content 3 mol %) which had been spectrally sensitized with the sensitizing dyes S-3 and S-4 | 0.4 gram as silver |
| Gelatin | 0.6 gram |
| Coupler C-4 | 0.1 gram |
| Coupler C-7 | 0.1 gram |
| Coupler C-8 | 0.1 gram |
| Compound Cpd-B | 0.03 gram |
| Compound Cpd-F | 0.02 gram |
| Compound Cpd-G | 0.05 gram |
| High boiling point organic solvent Oil-2 | 0.01 gram |
| Eleventh Layer (High Speed Green Sensitive Emulsion Layer) | |
| Silver iodobromide emulsion (a mono-disperse tabular emulsion of average grain size 0.6 μm (calculation is based on a calculated diameter), AgI content 1.3 mol %, average diameter/thickness ratio 7) which had been spectrally sensitized with the sensitizing dyes S-3 and S-4 | 0.5 gram as silver |
| Gelatin | 1.0 gram |
| Coupler C-4 | 0.4 gram |
| Coupler C-7 | 0.2 gram |
| Coupler C-8 | 0.2 gram |
| Compound Cpd-B | 0.08 gram |
| Compound Cpd-F | 0.02 gram |
| Compound Cpd-G | 0.02 gram |
| High boiling point organic solvent Oil-1 | 0.02 gram |
| High boiling point organic solvent Oil-2 | 0.02 gram |
| Twelfth Layer (Intermediate Layer) | |
| Gelatin | 0.6 gram |
| Dye D-2 | 0.05 gram |
| Thirteenth Layer (Yellow Filter Layer) | |
| Yellow colloidal silver | 0.1 gram as silver |
| Gelatin | 1.1 gram |
| Anti-color mixing agent Cpd-A | 0.01 gram |
| High boiling point organic solvent Oil-1 | 0.01 gram |
| Fourteenth Layer (Intermediate Layer) | |
| Gelatin | 0.6 gram |
| Fifteenth Layer (Low Speed Blue Sensitive Emulsion Layer) | |
| Silver iodobromide emulsion (a 1:1 mixture of a mono-disperse cubic emulsion of average grain size 0.4 μm, AgI content 3 mol %, and a mono-disperse cubic emulsion of average grain size 0.2 μm, AgI content 3 mol %) which had been spectrally sensitized with the sensitizing dyes S-5 and S-6 | 0.6 gram as silver |
| Gelatin | 0.8 gram |
| Coupler C-5 | 0.6 gram |
| High boiling point organic solvent Oil-2 | 0.02 gram |
| Sixteenth Layer (Intermediate Speed Blue Sensitive Emulsion Layer) | |
| Silver iodobromide emulsion (a mono-disperse cubic emulsion of average grain size 0.5 μm, AgI content 2 mol %) which had been spectrally sensitized with the sensitizing dyes S-5 and S-6 | 0.4 gram as silver |
| Gelatin | 0.9 gram |
| Coupler C-5 | 0.3 gram |

-continued

| | |
|---|---|
| Coupler C-6 | 0.3 gram |
| High boiling point organic solvent Oil-2 | 0.02 gram |
| Seventeenth Layer (High Speed Blue Sensitive Emulsion Layer) | |
| Silver iodobromide emulsion (tabular grains 0.7 μm, calculation is based on a calculated diameter, AgI content 1.5 mol %, average diameter/thickness value 7) which had been spectrally sensitized with the sensitizing dyes S-5 and S-6 | 0.4 gram as silver |
| Gelatin | 1.2 grams |
| Coupler C-6 | 0.7 gram |
| Eighteenth Layer (First Protective Layer) | |
| Gelatin | 0.7 gram |
| Ultraviolet absorber U-1 | 0.04 gram |
| Ultraviolet absorber U-3 | 0.03 gram |
| Ultraviolet absorber U-4 | 0.03 gram |
| Ultraviolet absorber U-5 | 0.05 gram |
| Ultraviolet absorber U-6 | 0.05 gram |
| High boiling point organic solvent Oil-1 | 0.02 gram |
| Formalin scavenger Cpd-C | 0.8 gram |
| Dye D-3 | 0.05 gram |
| Nineteenth Layer (Second Protective Layer) | |
| Fogged fine grained silver iodobromide emulsion (average grain size 0.06 μm, AgI content 1 mol %) | 0.1 gram as silver |
| Gelatin | 0.4 gram |
| Twentieth Layer (Third Protective Layer) | |
| Gelatin | 0.4 gram |
| Poly(methyl methacrylate) (average particle diameter 1.5 μm) | 0.1 gram |
| 4:6 methyl methacrylate:acrylic acid copolymer (average particle size 1.5 μm) | 0.1 gram |
| Silicone oil | 0.03 gram |
| Surfactant W-1 | 3.0 mg |

The gelatin film hardening agent H-1 and surfactants for coating and emulsification purposes were also added to each layer in addition to the components indicated above.

Moreover, 1,2-benzisothiazolin-3-one, 2-phenoxyethanol and phenethyl alcohol were added as fungicides and biocides.

Moreover, in the emulsions used here the term "mono-dispersion" signifies that the variation coefficient is not more than 20%.

C-1

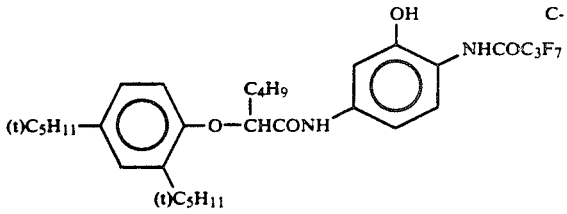

C-2

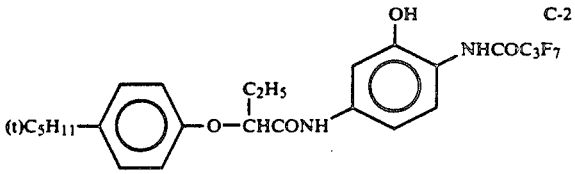

-continued

C-3

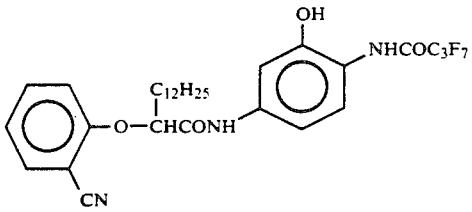

C-4

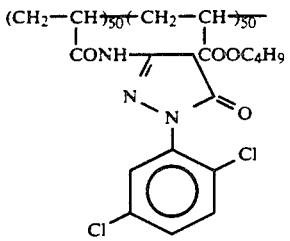

The numbers indicate wt %
Average molecular weight: About 25,000

C-5

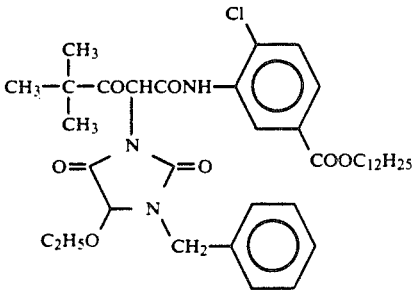

C-6

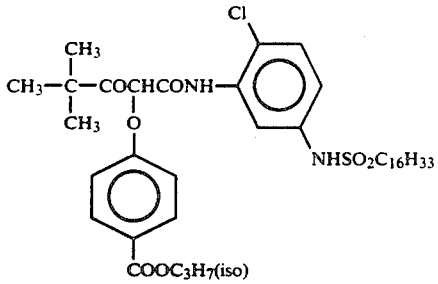

C-7

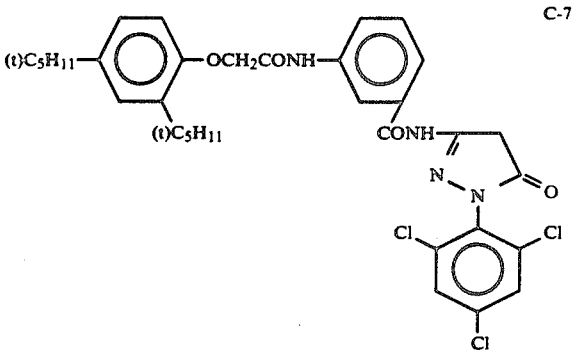

-continued
C-8
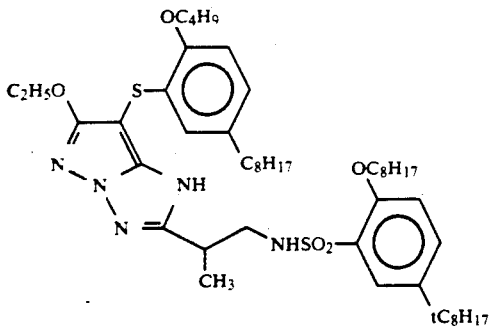
C-9
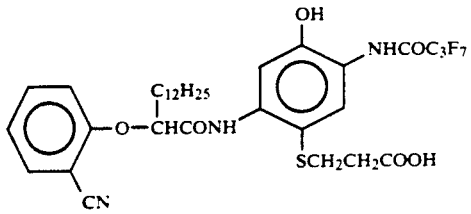
Dibutyl phthalate — Oil-1
Tricresyl phosphate — Oil-2
Oil-3
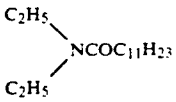
Cpd-A
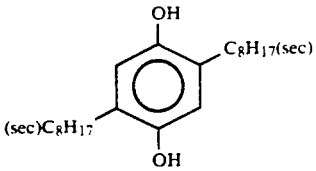
Cpd-B
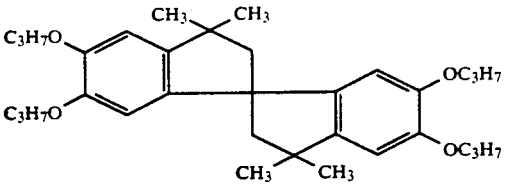
Cpd-C
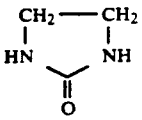
Cpd-D
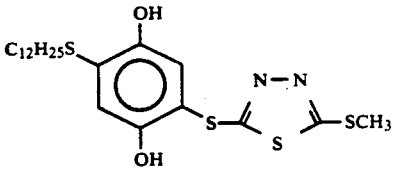
-continued
Cpd-F
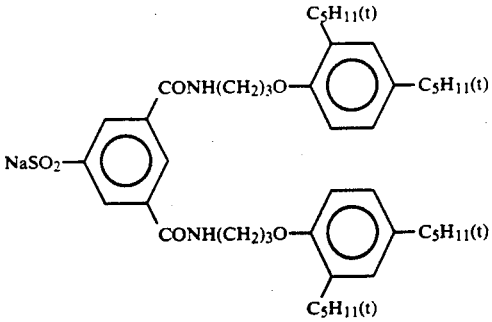
Cpd-G
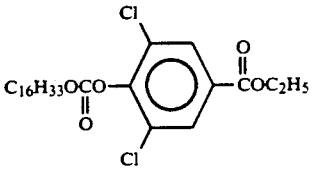
U-1
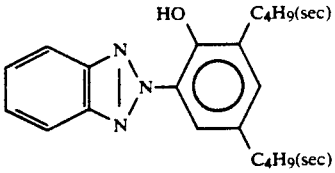
U-2
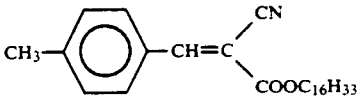
U-3
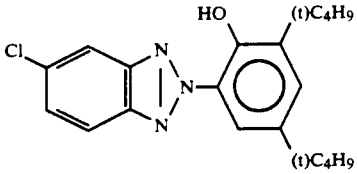
U-4
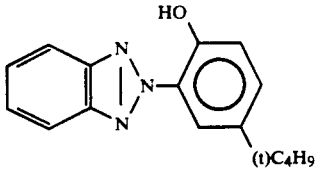
U-5
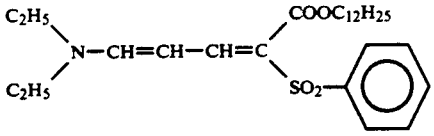
U-6
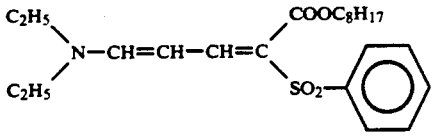
S-1
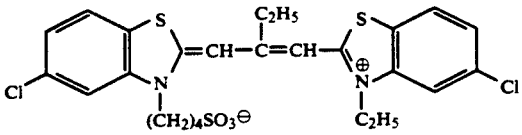

-continued

S-2

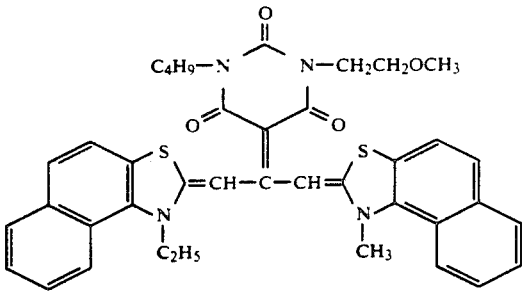

S-3

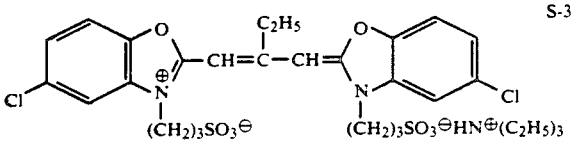

S-4

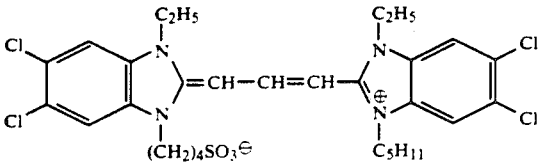

S-5

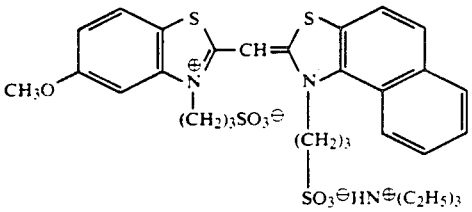

S-6

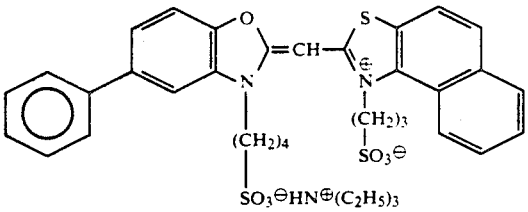

D-1

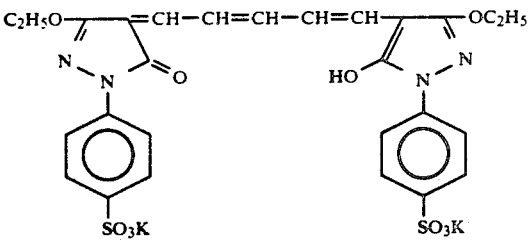

D-2

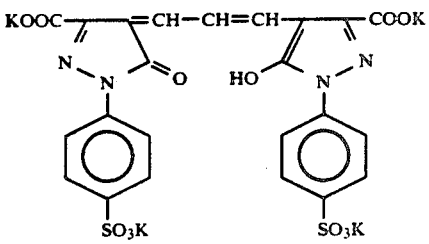

-continued

D-3

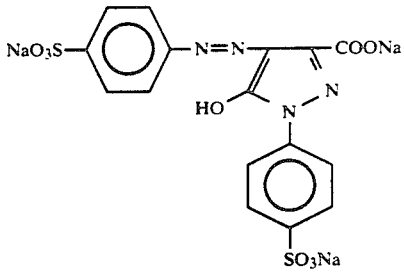

H-1

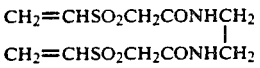

W-1

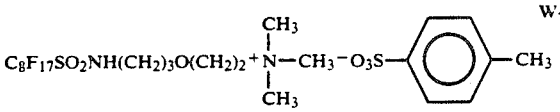

The sample obtained in this way was taken as Sample 1F. Samples 2F to 17F were prepared in the same way as Sample 1F except that the magenta coupler C-8 and compound Cpd-B in the ninth, tenth and eleventh layers were modified as shown in Table 4 (number of mol per square meter as before), and a compound of general formula (A) (2 mol % with respect to the magenta coupler C-8) was combined as shown in Table 4.

The comparative compounds used were the same as in Example 1.

The samples so obtained were subjected to photographic processing as indicated below.

Firstly, each sample was given a 4800° K. 20 CMS exposure using an optical wedge.

The exposed samples were then processed in an automatic processor using the processing operations and processing bath compositions indicated below.

Processing Operations

| Process | Time | Temperature |
|---|---|---|
| First development | 6 minutes | 38° C. |
| Water wash | 2 minutes | 38° C. |
| Reversal | 2 minutes | 38° C. |
| Color development | 6 minutes | 38° C. |
| Conditioning | 2 minutes | 38° C. |
| Bleach | 6 minutes | 38° C. |
| Fix | 4 minutes | 38° C. |
| Water wash | 4 minutes | 38° C. |
| Stabilization | 1 minute | 38° C. |
| Drying | | Normal Temperature |

The composition of each processing bath was as follows:

Black and White Development

| | |
|---|---|
| Water | 700 ml |
| Nitrilo-N,N,N-trimethylene-phosphonic acid, penta-sodium salt | 2 grams |
| Sodium sulfite | 20 grams |
| Hydroquinone-mono-sulfate | 30 grams |
| Sodium carbonate (mono-hydrate) | 30 grams |
| 1-Phenyl-4-methyl-4-hydroxy-methyl-3-pyrazolidone | 2 grams |
| Potassium bromide | 2.5 grams |
| Potassium thiocyanate | 1.2 grams |
| Potassium iodide (0.1% solution) | 2.0 ml |
| Water to make up to | 1000 ml |

Reversal Bath

| | |
|---|---|
| Water | 700 ml |
| Nitrilo-N,N,N-trimethylene- | 3 grams |

-continued

| | |
|---|---|
| phosphonic acid, penta-sodium salt | |
| Stannous chloride (di-hydrate) | 1 gram |
| p-Aminophenol | 0.1 gram |
| Sodium hydroxide | 8 grams |
| Glacial acetic acid | 15 ml |
| Water to make up to | 1000 ml |
| Color Development Bath | |
| Water | 700 ml |
| Nitrilo-N,N,N-trimethylene-phosphonic acid, penta-sodium salt | 3 grams |
| Sodium sulfite | 7 grams |
| Tri-sodium phosphate dodecahydrate | 36 grams |
| Potassium bromide | 1 gram |
| Potassium iodide (0.1% solution) | 90 ml |
| Sodium hydroxide | 3 grams |
| Citrazinic acid | 1.5 grams |
| N-Ethyl-(β-methanesulfonamido-ethyl)-3-methyl-4-aminoaniline sulfate | 11 grams |
| 3,6-Dithia-1,8-octanediol | 1 gram |
| Water to make up to | 1000 ml |
| Conditioner | |
| Water | 700 ml |
| Sodium sulfite | 12 grams |
| Ethylenediamine tetra-acetic acid, di-sodium salt, di-hydrate | 8 grams |
| 1-Thioglycerine | 0.4 gram |
| Glacial acetic acid | 3 ml |
| Water to make up to | 1000 ml |

-continued

| | |
|---|---|
| Bleach Bath | |
| Water | 800 ml |
| Ethylenediamine tetra-acetic acid, di-sodium salt (di-hydrate) | 2 grams |
| Ethylenediamine tetra-acetic acid, Fe(III) ammonium salt (di-hydrate) | 120 grams |
| Potassium bromide | 100 grams |
| Water to make up to | 1000 ml |
| Fixer bath | |
| Water | 800 ml |
| Sodium thiosulfate | 80.0 grams |
| Sodium sulfite | 5.0 grams |
| Sodium bisulfite | 5.0 grams |
| Water to make up to | 1000 ml |
| Stabilizer Bath | |
| Water | 800 ml |
| Formalin (37%) | 5.0 grams |
| Fuji "Driwel" (surfactant made by the Fuji Film Co.) | 5.0 ml |
| Water to make up to | 1000 ml |

Fading tests were carried out using each sample in which a dye image had been formed in this way. The fading test involved evaluating the residual magenta dye at initial densities of 1.0 and 0.5 after irradiation for 4 days in a xenon tester (Xe) (luminance 200,000 lux). The measurements were made using a Fuji recording densitometer. The results obtained are shown in Table 4.

TABLE 4

| Sample | Magenta Coupler C-8 or the Substitute Coupler | Compound Cpd-B or Substitute Compound | Compound of General Formula (A) | Residual Magenta Density Xe, 200,000 lux, 4 Days: Initial Density 1.0 | Initial Density 0.5 | Remarks |
|---|---|---|---|---|---|---|
| 1F | C-8 | Cpd-8 (B-18) | — | 50% | 27% | Comparative Example |
| 2F | " | " | Comparative Compound (b) | 50 | 28 | Comparative Example |
| 3F | " | " | Comparative Compound (c) | 52 | 28 | Comparative Example |
| 4F | " | " | A-9 | 68 | 60 | This Invention |
| 5F | " | " | A-16 | 69 | 60 | This Invention |
| 6F | " | " | A-32 | 67 | 63 | This Invention |
| 7F | M-4/M-7 = 1/1 | " | A-9 | 70 | 65 | This Invention |
| 8F | " | " | A-16 | 69 | 63 | This Invention |
| 9F* | " | " | A-16 | 70 | 65 | This Invention |
| 10F | " | " | — | 53 | 30 | Comparative Example |
| 11F | M-18 | B-27 | — | 42 | 20 | Comparative Example |
| 12F | M-18 | B-27 | A-9 | 60% | 57% | This Invention |
| 13F | " | " | A-16 | 65 | 59 | This Invention |
| 14F | " | " | A-32 | 63 | 59 | This Invention |
| 15F | C-8 | — | A-9 | 29 | 15 | Comparative Example |
| 16F | " | — | A-16 | 29 | 14 | Comparative Example |
| 17F | " | — | A-32 | 27 | 14 | Comparative |

TABLE 4-continued

| Sample | Magenta Coupler C-8 or the Substitute Coupler | Compound Cpd-B or Substitute Compound | Compound of General Formula (A) | Residual Magenta Density Xe. 200,000 lux. 4 Days: Initial Density 1.0 | Initial Density 0.5 | Remarks |
|---|---|---|---|---|---|---|
| | | | | | | Example |

*The two compounds indicated below were added in amounts of 10 mol % with repect to M-4

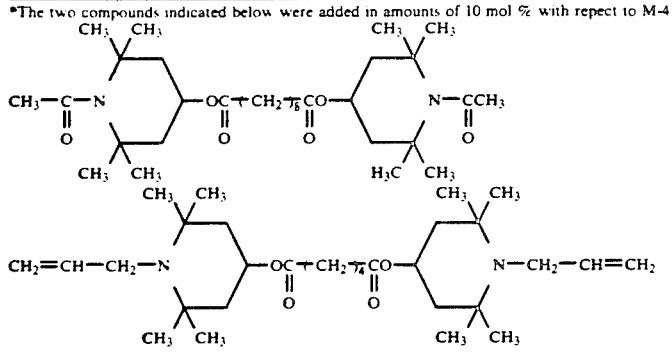

It is clear from Table 4 that, even in these silver halide color photographs, the samples of the present invention had excellent light fastness, and that they were especially good in respect of light fading in the low density regions of low magenta dye concentration.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material wherein at least one pyrazoloazole dye forming coupler, at least one compound which can be represented by formula (A) and a compound represented by formula (B) are included in the same layer,

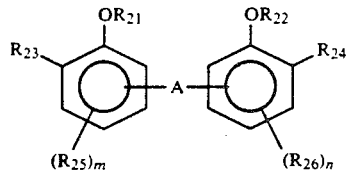

(A)

wherein A represents a single bond,

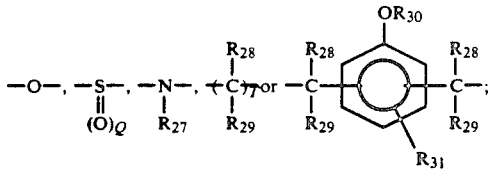

$R_{21}$ and $R_{22}$ each represent a hydrogen atom,

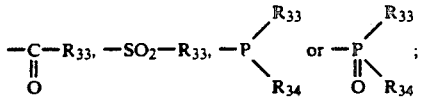

$R_{23}$ and $R_{24}$ each represent a halogen atom, and aryl group, an alkoxy group, an aryloxy group, an alkylthio group, an arylthio group, an acyl group, an alkoxycarbonyl group, an aryloxycarbonyl group, an acylamino group, an alkylsulfonamido group, an arylsulfonamido group, an imido group, an acyloxy group, an alklysulfonyl group, an arylsulfonyl group, an alkylsulfonyloxy group, an arylsulfonyloxy group, an alkoxycarbonylamino group, an aryloxycarbonylamino group, a carbamoylamino group, a sulfamoylamino group, a carbamoyl group, a sulfamoyl group or

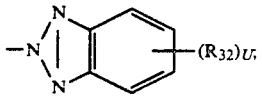

m and n represent integers of value from 1 to 3; $R_{25}$ and $R_{26}$ each represent a substituent group as designated for $R_{23}$ or an alkyl group, and when m or n are two or more the plural $R_{25}$ groups and the plural $R_{26}$ groups may be the same or different; $R_{21}$ and $R_{22}$, $R_{21}$ and $R_{23}$, $R_{22}$ and $R_{24}$, $R_{23}$ and $R_{25}$, and $R_{25}$ and $R_{26}$, may be joined together to form a five to eight membered ring; $R_{27}$ represents a hydrogen atom, an alkyl group, an acyl group, an alkylsulfonyl group, an arylsulfonyl group, an alkoxycarbonyl group or an aryloxycarbonyl group; $R_{28}$ and $R_{29}$ each represent a hydrogen atom, an alkyl group, an aryl group or an aralkyl group; $R_{30}$ is defined the same as $R_{21}$; and $R_{31}$ and $R_{32}$ are each defined the same as $R_{25}$; $R_{33}$ and $R_{34}$ represent an alkyl group, an aryl group, an aralkyl group, an alkoxy group or an aryloxy group; Q and U each represent 0, 1 or 2; and T represents 1 or 2

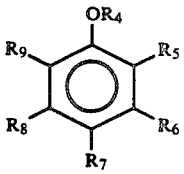

(B)

wherein $R_4$ represents an alkyl group, an alkenyl group, an aryl group, a heterocyclic group or a silyl group; $R_5$, $R_6$, $R_7$, $R_8$ and $R_9$ may be the same or different, each representing a hydrogen atom, an alkyl group, an alkenyl group, an aryl group, a substituted amino group, an alkylthio group, an arylthio group, a halogen atom,

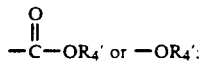

$R_4'$ has the same significance as $R_4$; and $R_4$ and $R_5$, $R_5$ and $R_6$, or $R_6$ and $R_7$ may be joined together to form a five or six membered ring or a spiro structure.

2. A silver halide color photographic material as in claim 1, wherein the compound represented by formula (A) is a compound represented by formula (A-I)

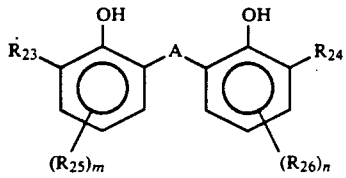

(A-I)

wherein $R_{23}$, $R_{24}$, $R_{25}$, $R_{26}$, A, m and n are the same as defined respectively in connection with general formula (A).

3. A silver halide color photographic material as in claim 2, wherein A represents

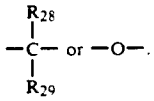

4. A silver halide color photographic material as in claim 1, wherein the pyrazoloazole dye forming coupler is represented by formula (M):

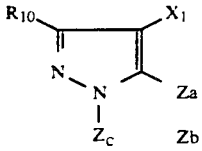

(M)

wherein $R_{10}$ represents a hydrogen atom or a substituent group;

$X_1$ represents a hydrogen atom or a group which can be eliminated by a coupling reaction with an oxidized product of a primary aromatic amine color developing agent;

Za, Zb and Zc represent a substituted or unsubstituted methine group, =N— or —NH—, provided that one of the bonds Za-Zb and Zb-Zc is a double bond and the other is a single bond, wherein when the Zb-Zc bond is a carbon - carbon double bond it may be part of an aromatic ring, and further provided that dimers or larger oligomers may be formed via $R_{10}$ or $X_1$, or via the substituted methine group when Za, Zb or Zc is a substituted methine group.

5. A silver halide color photographic material as in claim 4, wherein the amount of compound represented by formula (A) is from 1 to 300 mol % with respect to the coupler represented by general formula (M).

6. A silver halide color photographic material as in claim 1, wherein at least one of wherein at least one of $R_5$ to $R_9$ represent a substituted amino group, an alkylthio group, an arylthio group or —$OR_4$ wherein $R_4'$ is as defined in claim 1; and $R_4$ and $R_5$, $R_5$ and $R_6$, or $R_6$ and $R_7$ may be joined together to form five or six membered ring or a spiro structure.

7. A silver halide color photographic material as in claim 1, wherein the compound represented by general formula (B) is represented by formulae (B-I) to (B-VIII):

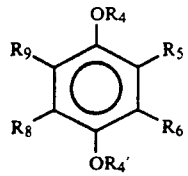

(B-I)

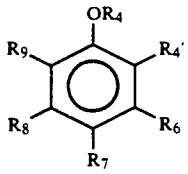

(B-II)

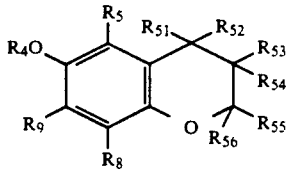

(B-III)

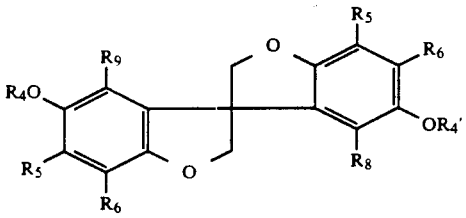

(B-IV)

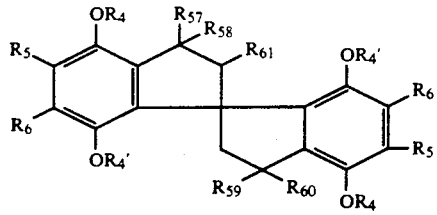

(B-V)

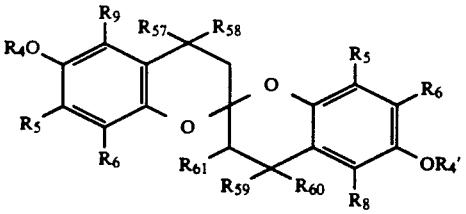

(B-VI)

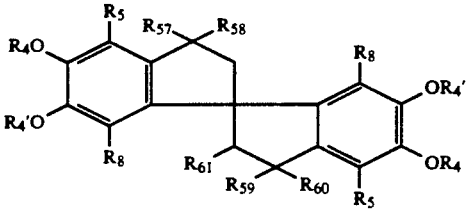

(B-VII)

-continued (B-VIII)

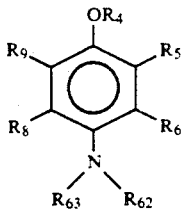

wherein $R_4$, $R_4'$, $R_5$, $R_6$, $R_7$, $R_8$ and $R_9$ have the same definitions as the corresponding groups in formula (B);

$R_{51}$ to $R_{61}$ may be the same or different, each representing a hydrogen atom, an alkyl group or an aryl group;

$R_{54}$ and $R_{55}$, and $R_{55}$ *l and* $R_{56}$ may be joined together to form a 5- to 7-membered hydrocarbyl ring;

$R_{62}$ and $R_{63}$ may be the same or different, each representing a hydrogen atom, an alkyl group, an aryl group, an acyl group, an oxycarbonyl group or a sulfonyl group, provided that $R_{62}$ and $R_{63}$ cannot both at the same time be hydrogen atoms, and further provided that $R_{62}$ and $R_{63}$ may be joined together to form a 5- to 7-membered ring.

8. A silver halide color photographic material as in claim 7, wherein $R_4$ and $R_4'$ are alkyl groups or aryl groups.

9. A silver halide color photographic material as in claim 7, wherein $R_5$ to $R_9$ are hydrogen atoms, alkyl groups or aryl groups.

10. A silver halide color photographic material as in claim 1, wherein the amount of compounds of formula (B) is from 2 to 400 mol % with respect to the magenta coupler.

11. A silver halide color photographic material as in claim 1, wherein said layer containing said pyrazoloazole dye forming coupler further contains a compound represented by formula (V):

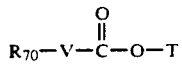

or (VI):

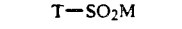

wherein $R_{70}$ represents an alkyl group, an alkenyl group, an aryl group, or a heterocyclic group;

V represents —O— or a single bond;

T represents an aryl group or a heterocyclic group; and

M represents a hydrogen atom or a group of atoms which forms an inorganic or an organic salt.

12. A silver halide color photographic material as in claim 1, wherein said pyrazoloazole coupler and the compounds of formulae (A) and (B) are present in a green-sensitive layer.

13. A silver halide color photographic material as in claim 1, wherein $R_{23}$ and $R_{24}$ each represent an alkoxy group, an aryloxy group, an alkylthio group, an arylthio group, an acylamino group, an alkylsulfonamido group, an arylsulfonamido group, an imido group, an acyloxy group, an alkylsulfonyloxy group, an arylsulfonyloxy group, an alkoxycarbonylamino group, an aryloxycarbonylamino group, a carbamoylamino group, a sulfamoylamino group, an acyl group, or

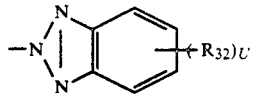

(wherein $R_{32}$ and U are defined in claim 1).

14. A silver halide color photographic material as in claim 13, wherein $R_{23}$ and $R_{24}$ each represent an alkoxy group, an acylamino group, an alkoxycarbonylamino group or a carbamoyl group.

15. A silver halide color photographic material as in claim 1, wherein $R_{25}$ and $R_{26}$ are substituted in para position with respect to $—OR_{21}$ and $—OR_{22}$ group respectively.

16. A silver halide color photographic material as in claim 1, wherein $R_{25}$ and $R_{26}$ each represent an alkyl group, an acylamino group, an alkylsulfonamido group or arylsulfonamido group.

17. A silver halide color photographic material as in claim 1, wherein 1 at least one of $R_{28}$ and $R_{29}$ represent a hydrogen atom.

18. A silver halide color photographic material as in claim 17, wherein $R_{28}$ represents a hydrogen atom and $R_{29}$ represents an alkyl group, an aryl group or alalkyl group.

* * * * *